US010513357B2

(12) United States Patent
Langen

(10) Patent No.: US 10,513,357 B2
(45) Date of Patent: Dec. 24, 2019

(54) METHOD AND APPARATUS FOR CLOSING A BOX

(71) Applicant: H. J. Paul Langen, Brampton (CA)

(72) Inventor: H. J. Paul Langen, Brampton (CA)

( * ) Notice: Subject to any disclaimer, the term of this patent is extended or adjusted under 35 U.S.C. 154(b) by 768 days.

(21) Appl. No.: 14/646,321

(22) PCT Filed: Mar. 14, 2013

(86) PCT No.: PCT/CA2013/000230
§ 371 (c)(1),
(2) Date: May 20, 2015

(87) PCT Pub. No.: WO2014/078931
PCT Pub. Date: May 30, 2014

(65) Prior Publication Data

US 2015/0291295 A1 Oct. 15, 2015

Related U.S. Application Data

(60) Provisional application No. 61/729,211, filed on Nov. 21, 2012.

(51) Int. Cl.
*B65B 5/00* (2006.01)
*B65B 7/26* (2006.01)
(Continued)

(52) U.S. Cl.
CPC ..... *B65B 7/26* (2013.01); *B65B 5/06* (2013.01); *B65B 7/24* (2013.01); *B65B 43/52* (2013.01); *B65B 5/00* (2013.01)

(58) Field of Classification Search
CPC ..... B65B 7/26; B65B 7/20; B65B 7/24
See application file for complete search history.

(56) References Cited

U.S. PATENT DOCUMENTS 1,434,230 A 10/1922 Shawver
1,471,924 A 10/1923 Saylor et al.
(Continued)

FOREIGN PATENT DOCUMENTS

GB 2 096 093 A 10/1982

OTHER PUBLICATIONS

International Search Report dated Aug. 8, 2013 in relation to PCT Application No. PCT/CA2013/000230 filed Mar. 14, 2013.
(Continued)

*Primary Examiner* — Chelsea E Stinson

(57) ABSTRACT

An apparatus for closing a flap on an open end of a box may include a device having a slot and a mechanism operable to provide a relative motion between the slot and the flap. The relative motion may cause the flap to be received into the slot and the flap to be reoriented to a closed position. A method of closing an open end of a box being conveyed downstream, with the open end facing transversely, may include two operations. With a trailing minor flap on the open end being held in a substantially upstream-pointing open position, the opposing leading minor flap on the open end may be closed from a substantially downstream-pointing open position to a substantially upstream-pointing closed position. With the leading minor flap being held in the closed position, the trailing minor flap may be closed from the open position to a substantially downstream-pointing closed position.

36 Claims, 87 Drawing Sheets

(51) Int. Cl.

| | |
|---|---|
| ***B65B 7/24*** | (2006.01) |
| ***B65B 5/06*** | (2006.01) |
| ***B65B 43/52*** | (2006.01) |

(56) References Cited

U.S. PATENT DOCUMENTS

| | | | | |
|---|---|---|---|---|
| 2,900,778 | A | 8/1959 | Hartbauer | |
| 5,115,625 | A * | 5/1992 | Barbulesco | B65B 5/024 53/242 |
| 5,440,852 | A * | 8/1995 | Lam | B65B 7/20 53/377.2 |
| 7,174,698 | B2 | 2/2007 | Spatafora et al. | |
| 7,832,183 | B2 * | 11/2010 | Jacob | B65B 51/026 53/207 |
| 2008/0110135 | A1 * | 5/2008 | Jacob | B65B 7/20 53/491 |
| 2009/0277134 | A1 * | 11/2009 | Jacob | B65B 7/20 53/377.4 |

OTHER PUBLICATIONS

Written Opinion dated Aug. 8, 2013 in relation to PCT Application No. PCT/CA2013/000230 filed Mar. 14, 2013.

International Preliminary Report on Patentability dated May 26, 2015 in relation to PCT Application No. PCT/CA2013/000230 filed Mar. 14, 2013.

* cited by examiner (0°)

METHOD AND APPARATUS FOR CLOSING A BOX

CROSS-REFERENCE TO RELATED APPLICATION

This application claim benefits of U.S. provisional patent application No. 61/729,211 filed Nov. 21, 2012, the contents of which are incorporated herein by reference.

FIELD OF TECHNOLOGY

The present invention relates generally to methods and apparatuses for closing boxes.

BACKGROUND

Boxes are used to package many different kinds of products or items. Some in the packaging industry refer to boxes that are used to package one or more products or items as "cartons." Also in the industry there are containers/boxes that are known by some as "cases". Examples of cases include what are known as regular slotted cases ("RSCs"). In this patent document, including the claims, the words "box" is used to refer to boxes, cartons, and/or cases that can be used to package any type of items including products and/or other cartons. The word "carton" is used interchangeably with "box" or "case" in this document.

Cartons come in many different configurations and are made from a wide variety of materials. Many cartons are foldable and are formed from a flattened state. A flattened carton is commonly called a "carton blank." Foldable cartons may be made from an assortment of foldable materials, including but not limited to cardboard, chipboard, paperboard, corrugated fibreboard, other types of corrugated materials, plastic materials, composite materials, and the like and possibly even combinations thereof.

In many known systems, carton blanks may be serially retrieved from a carton magazine in which they are held in a flattened state, reconfigured from the flattened state into an erected state, and placed in a slot on a carton conveyor. The erected carton may then be moved by the carton conveyor to a loading station where the carton may be filled with one or more items or products and then sealed. The blanks may be in what is known as a "knocked-down" state. A "knock down" or "KD" blank may be have a partially folded configuration and may be partially glued or otherwise sealed along one side seam, thus being formed in a generally flattened tubular shape. Erection of KD blanks may involve pulling apart opposite panels to reconfigure the carton blank from a flattened tubular configuration to an open tubular configuration. In the latter configuration, the carton may be referred to as an erected carton blank or carton, and may be suitable for delivery to a carton conveyor.

In some applications, the carton may have one side closed by folding and sealing the bottom flaps, and may then be loaded or filled with one or more items or products from the opposite side while on the carton conveyor. In this configuration, an open end of the carton may face generally perpendicularly to a conveyor on which the carton may be conveyed, and the items or products may be "side-loaded" substantially horizontally into the carton. Subsequently, any required additional flap closing (folding) and sealing such as with glue or tape may be carried out to enclose and completely close and seal the carton with one or more items or products contained therein.

Alternately, for example an erected carton blank can be reoriented from a side orientation to an upright orientation with the opening facing upwardly. The erected carton can then be moved to a loading station or loading system where it can be "top-loaded" with one or more items, such as products or other carton containing products. The top opening can then be closed by folding over and sealing the top flaps. Top loading may be preferred if it is desired for gravity to help keep loaded items or products in place just prior to carton sealing. This may come at the expense of higher complexity. Whereas side-load systems can generally erect, load and seal cartons on the same carton conveyor, top-load system often require separate systems for each of these actions. Typically, a top-load system consists of a carton erector machine to erect the carton blank, a top-loading machine to load the erected blank, a carton sealing machine to close the carton after sealing and a carton conveyor to transport the cartons between these machines.

SUMMARY

According to one aspect of the present disclosure there is provided an apparatus for closing a flap on an open end of a box, the apparatus comprising: (a) a device having a slot; (b) a mechanism operable to provide a relative motion between the slot and the flap, the relative motion operable to cause the flap to be received into the slot to reorient the flap to a closed position.

According to another aspect of the present disclosure there is provided an apparatus for closing opposing first and second flaps on an open end of a box, the apparatus comprising: (a) a rail with a first slot and a second slot defined therein; and (b) a mechanism operable to provide a first relative motion between the first slot and the first flap of the box, the first relative motion operable to cause the first slot to receive and close the first flap, the mechanism also operable to provide a second relative motion, opposite to the first relative motion, between the second slot and the second flap of the box, the second relative motion operable to cause the second slot to receive and close the second flap.

According to another aspect of the present disclosure there is provided an apparatus for closing a carton, the apparatus comprising: (a) a carton conveyor for conveying a carton longitudinally with an open end of the carton facing transversely, the open end of the conveyed carton having a leading minor flap and a trailing minor flap; and (b) a minor flap closing device comprising: (i) a first rail section comprising a first slot for receiving and closing the leading minor flap of the carton; and (ii) a second rail section comprising a second slot for receiving and closing a trailing minor flap of the carton.

According to another aspect of the present disclosure there is provided a method of closing an open end of a box, the box being carried downstream by a conveyor with the open end facing transversely, the method comprising: (a) with a trailing minor flap on the open end of the box being held in a substantially upstream-pointing open position, closing the opposing leading minor flap on the open end of the box from a substantially downstream-pointing open position to a substantially upstream-pointing closed position; and (b) with the leading minor flap being held in the substantially upstream-pointing closed position, closing the trailing minor flap from the substantially upstream-pointing open position to a substantially downstream-pointing closed position.

According to another aspect of the present disclosure there is provided a method of packaging a product in a box, the box having an open end, the box being carried downstream from a product loading station to a flap closing station by a conveyor with the open end facing transversely, the method comprising: (a) at the loading station loading a product sideways through the open end of the box; (b) moving the box with the loaded product on the conveyor downstream to the flap closing station; (c) at the flap closing stations and with a trailing minor flap on the open end of the box in a substantially upstream-pointing open position, closing the opposing leading minor flap on the open end of the box from a substantially downstream-pointing open position to a substantially upstream-pointing closed position; and (d) with the leading minor flap in the substantially upstream-pointing closed position, closing the trailing minor flap from the substantially upstream-pointing open position to a substantially downstream-pointing closed position.

According to another aspect of the present disclosure there is provided a system comprising: (a) a loading station for side-loading one of more products into a plurality of boxes; and (b) a minor flap closing device comprising: (i) a first rail section comprising a first slot for receiving and closing a leading minor flap of each of the plurality of loaded boxes; and (ii) a second rail section comprising a like plurality of slots, each slot of the plurality of slots for receiving and closing a trailing minor flap of a respective one of the plurality of loaded boxes.

According to another aspect of the present disclosure there is provided an apparatus for closing generally opposing first and second flaps on an open end of a box, the first and second flaps having distal edges oriented in a generally parallel first direction, the apparatus comprising: (a) a longitudinally extending guide rail having a first slot and a second slot defined therein, the first and second slots being generally oriented in the first direction; and (b) a mechanism operable to provide a first relative motion between the first slot and the first flap of the box, the first relative motion being in a second longitudinal direction that is generally perpendicular to the first direction, and the first relative motion operable to cause the first slot to receive and close the first flap, the mechanism also operable to provide a second relative motion between the second slot and the second flap of the box, the second relative motion being in a third longitudinal direction that is generally perpendicular to the first direction, and generally parallel but opposite to the second direction, the second relative motion for causing the second slot to receive and close the second flap.

According to another aspect of the present disclosure there is provided an apparatus for closing opposing first and second flaps at a first end of a box, and for closing opposing third and fourth flaps on a second end of the box opposite to the first end, the apparatus comprising: (a) a first rail having a first slot and a second slot defined therein; (b) a first closing mechanism operable to provide a first relative motion between the first slot and the first flap of the box, the first relative motion for causing the first slot to receive and close the first flap, the mechanism also operable to provide a second relative motion, opposite to the first relative motion, between the second slot and the second flap of the box, the second relative motion for causing the second slot to receive and close the second flap; (c) a second rail disposed on an opposite side of the box to the first rail, the second rail having a third slot and a fourth slot defined therein; (d) a second closing mechanism operable to provide a third relative motion between the third slot and the third flap of the box, the third relative motion for causing the third slot to receive and close the third flap, the mechanism also operable to provide a fourth relative motion, opposite to the first relative motion, between the fourth slot and the fourth flap of the box, the fourth relative motion for causing the fourth slot to receive and close the fourth flap.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate, by way of example only, embodiments of the present invention:

FIGS. 79 to 95 are top left front perspective views of an alternative box closing apparatus employing reverse product loading arms.

DETAILED DESCRIPTION

Figures 1, 1A:
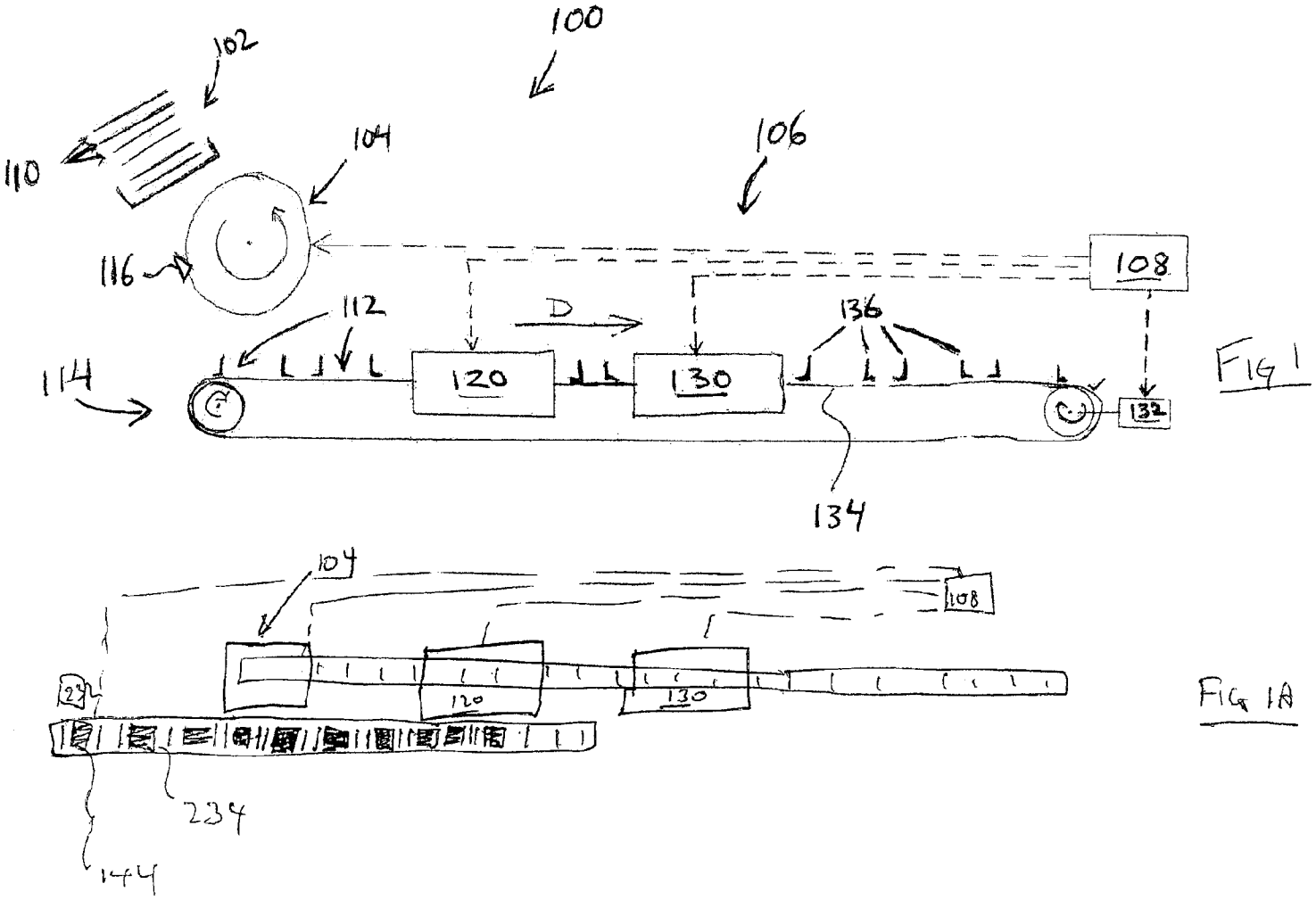
FIG. 1 is a schematic diagram of an example box closing system.
FIG. 1A is a top plan schematic diagram of the system of FIG. 1.

Referring to FIG. 1, an example box closing system 100 is schematically represented. The box closing system 100 includes a carton magazine 102, a carton feeder 104, a box closing apparatus 106 and a controller 108. The example box closing system 100 erects cartons from knock down (KD) carton blanks (i.e. flattened tubular carton blanks), loads the erected cartons with a product, closes (folds) the minor and major flaps of the carton and seals the carton with the product contained therein.

The carton magazine 102 holds a stack of carton blanks, referred to herein individually or collectively as carton blank(s) 110. In the present embodiment, the blanks are KD carton blanks that may be made from a foldable material such as cardboard, chipboard, paperboard, corrugated fibreboard, other types of corrugated materials, plastic materials, composite materials, and the like and possibly combinations thereof. As a non-limiting example, the carton material may for example be 1/16 inch cardboard.

The carton feeder 104 is a device that serially retrieves carton blanks 110 from carton magazine 102, reconfigures each retrieved carton blank 110 from its flattened state into an erected state, and places the erected carton into a slot 112 on the carton conveyor 114 of box closing apparatus 106. The carton feeder 104 may for example be a conventional type of rotary carton feeder with at least one erector head 116, which may comprise a suction cup in some embodiments. In the illustrated embodiment, the carton feeder 104 operates under the control of controller 108 of FIG. 1 (described below).

The box closing apparatus 106, which is schematically represented in FIG. 1, shall be described below in conjunction with the top right perspective view, top left perspective view, and top plan view of an example apparatus 106 shown in FIGS. 2, 34 and 59 respectively.

Referring to FIG. 1, the box closing apparatus 106 includes a carton conveyor 114 (also referred to as simply a conveyor or as a conveying system), a product loading station 120, and a minor flap closing station 130. Other stations and components of the box closing apparatus 106 are omitted from FIG. 1 for clarity, but will be described below in conjunction with other figures.

The carton conveyor 114 used for conveying the cartons 110 may be a conventional carton conveyor that is used to convey cartons in a packaging system. For example, carton conveyor may comprise a pair of parallel conveyor chains 134 with upstanding carton flights 136 attached to the chains (see FIGS. 1 and 2). The carton flights 136 may be generally secured to and aligned between the two continuous chains 134 which are supported at each ends by chain sprockets and between the sprockets by conveyor rails. In the present embodiment, a set of four flights 136 defines a carton slot 112 for holding a single carton 110 it is conveyed by the conveyor through the box closing apparatus 106. For example, as shown in FIG. 2, four labelled flights 136 define a carton slot 112 that is shown as being empty. The empty slot 112 is shown adjacent to another carton slot 112 that is occupied, i.e. holds a carton 110. In the illustrated carton conveyor 114, each carton 110 is placed into slots 112 with the open carton ends facing in a transverse direction relative to the longitudinal direction of conveyance D of the carton conveyor 114 (which transverse direction is sidewards in the illustrated example). A chain track 135 partially surrounds each conveyor chain 134 (see FIG. 2).

Referring again to FIG. 1, the carton conveyor 114 may further comprise an actuator 132, which may be a servo drive motor for example, for driving the conveyor, in a direction of conveyance D, under control of controller 108 (described below). An encoder associated with the actuator 132 may provide signals indicative of the position of the conveyor chain and the flights thereon, to controller 108. In the present embodiment, the conveyor 114 is driven intermittently, with periodic dwell periods of non-movement of the conveyor during product loading at product loading station 120 and minor flap closing at minor flap closing station 130, as will be described. This is not necessarily the case for all embodiments. In some embodiments, the conveyor may move continuously. This possibility will be described later. The servo drive/actuator 132 of the present embodiment may be positioned at any suitable location on the box closing apparatus 106.

Referring to FIGS. 1 and 1A, the product loading station 120 is a station at which one of more products 144 are side-loaded into an open end of the carton 110. Products 144 may be delivered product loading station by conventional devices such as a product conveyor sub-system and/or a robotic sub-system. For example a product conveyor 234 may be provided having a plurality of buckets secured to conveyor chains and being driven by an actuator 232. Actuator 232 may be like actuator 132 and may also be controlled by controller 108. Conveyor 234 may be arranged in generally parallel orientation compared to conveyor 114 and may be driven in intermittent movement. The product may be, by way of non-limiting example, one or more packaged food items, one or more loose items such rolls of garbage bags, or otherwise. Additionally in some embodiments, the products 144 may themselves be cartons containing other items or products and those cartons may be loaded by such a system into other boxes.

Also, instead of a product conveyor, a pick and place robotic system may be employed to deliver products 144 from a supply of products 144 to a position where the products may be pushed through guides 148 into the cartons 110. The product loading station 120 of system 100 is illustrated in more detail in FIGS. 2 and 34.

Figure 2:
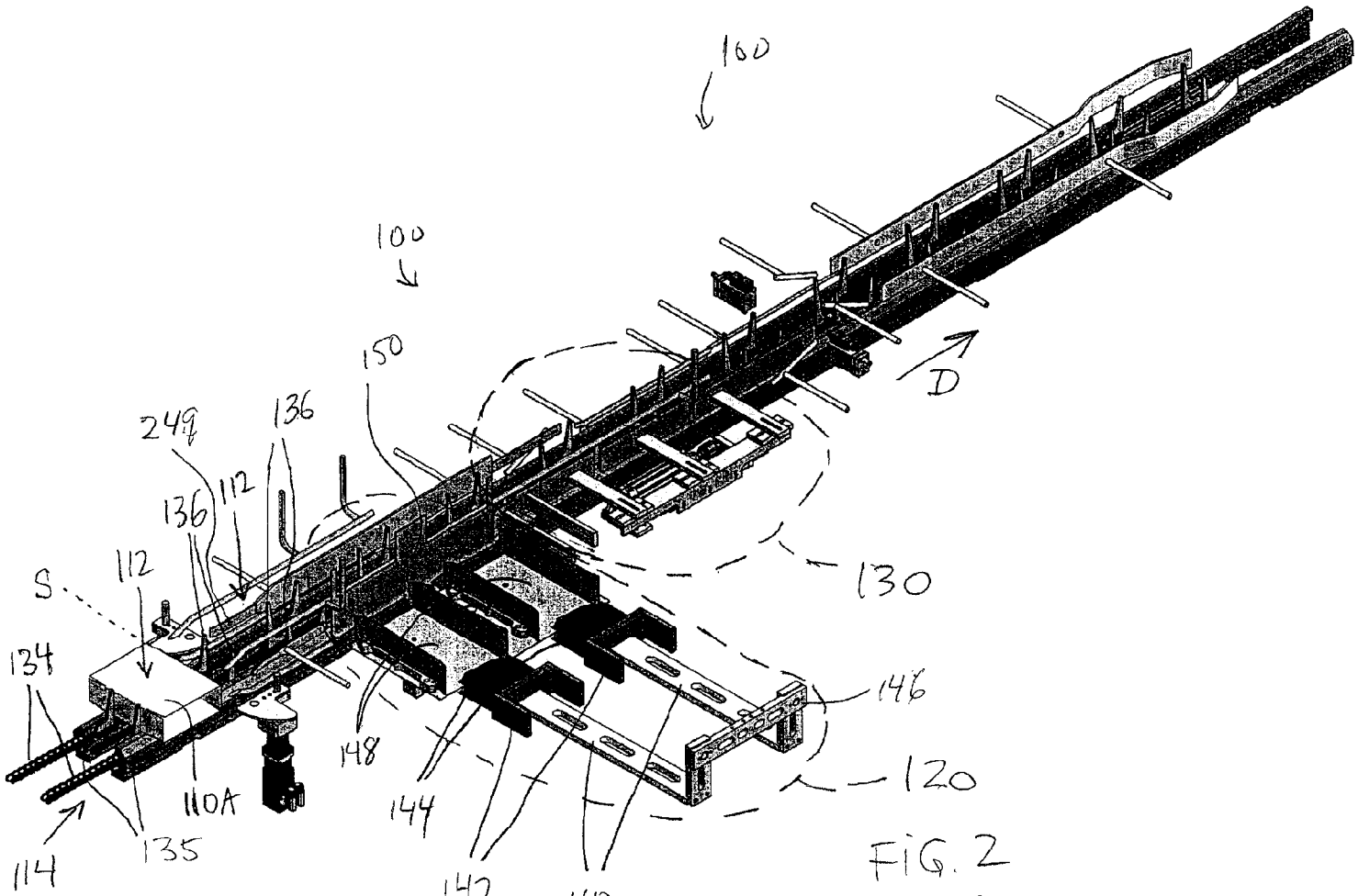
FIGS. 2 to 33 are top right perspective views of an example box closing apparatus of the system of FIG. 1 in various states of operation.
Figure 34:
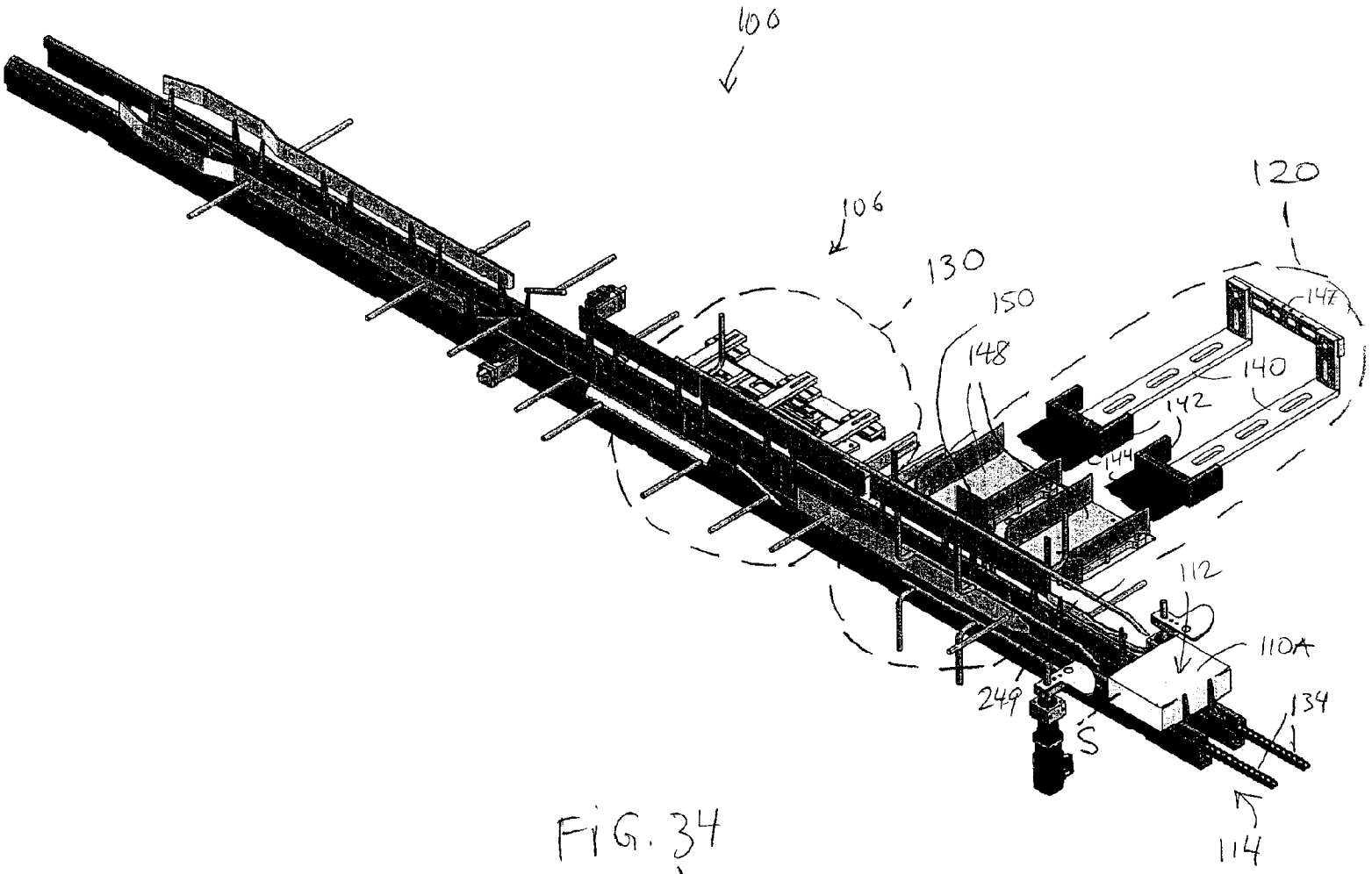
FIGS. 34 to 58 are top left perspective views of the example box closing apparatus of FIGS. 2 to 33 in various states of operation.

Referring to FIGS. 2 and 34, it can be seen that the product loading station 120 includes a pair of reciprocating arms 140. The arms reciprocate in a direction that is substantially transverse (i.e. perpendicular) to the longitudinal conveying direction D of the carton conveyor 114. The arms 140 are connected by a connecting member 146 so that the arms reciprocate in unison. The arms 140 and connecting member may be supported for reciprocating movement by suitable support frame components. For example, arms 140 may be received in and supported by support rails (not shown). The arms 140 may be driven in reciprocating movement by any suitable means such as being interconnected to a double acting pneumatic piston apparatus with electronic valves controlling the flow of compressed air to the pneumatic cylinder (all not shown). The electronic valves may be controlled by controller 108. By having two arms 140 move in unison, two cartons 110 can be side-loaded with product simultaneously in the illustrated embodiment. Each arm 140 has a pusher end 142 that may pass through side opening in the buckets of product conveyor 234 for pushing a respective product 144 into the carton 110. The pusher ends 142 attached to reciprocating arms may pass through the bucket of conveyor 234 (not shown) through the guides 148 and into an open end of a respective carton 110 during side loading (i.e. during transverse loading). In alternative embodiments, the number of cartons that are loaded simultaneously may be greater than two. Alternatively, the cartons may be loaded one at a time in other embodiments. In some embodiments, the number of reciprocating arms may match a number of cartons that are being loaded simultaneously. In other embodiments, alternate sub-systems for side loading products 144 into the open side of cartons 110 may be employed, so long as they do not interfere with the flap opening and closing mechanisms described herein.

Figure 14:
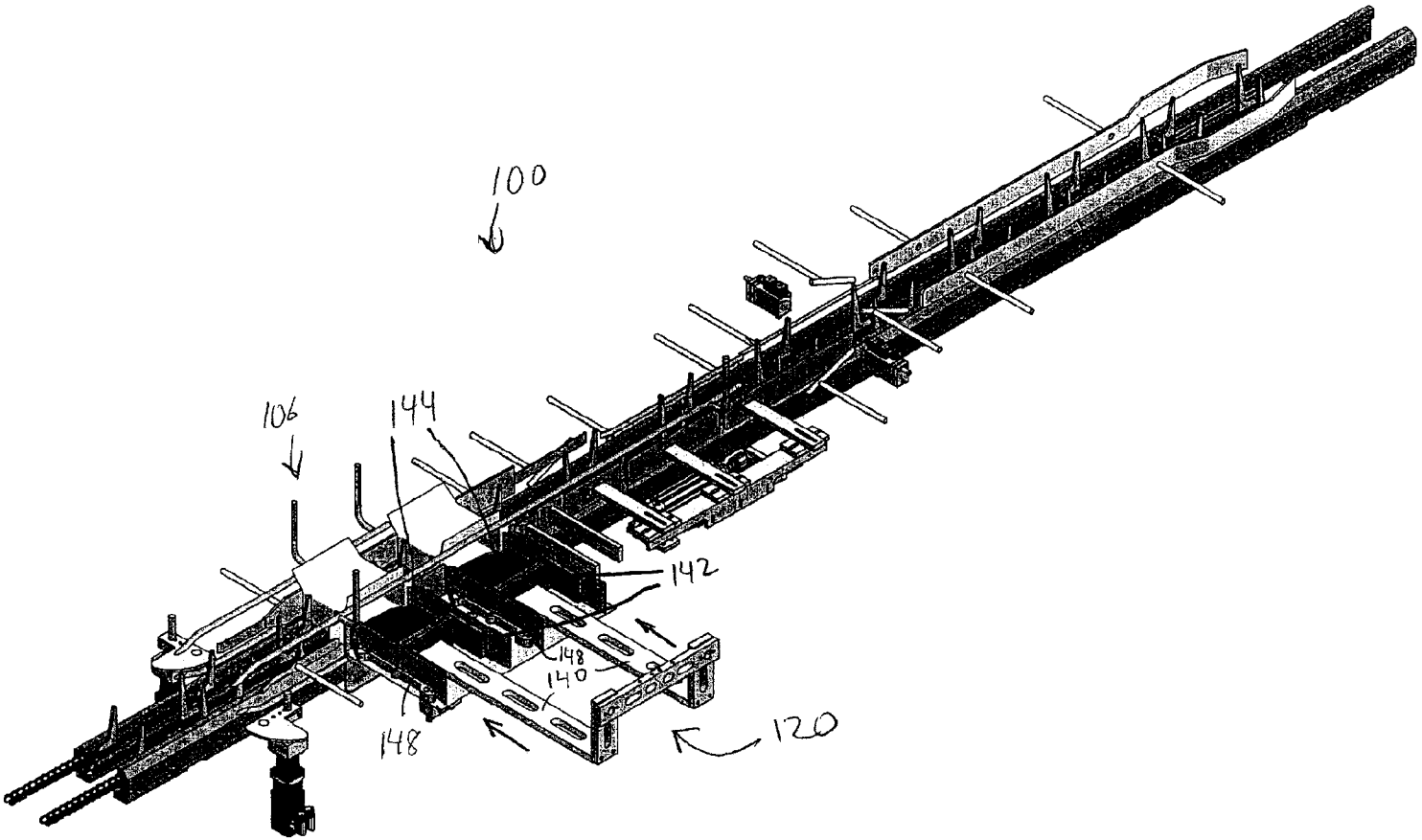
Figure 15:
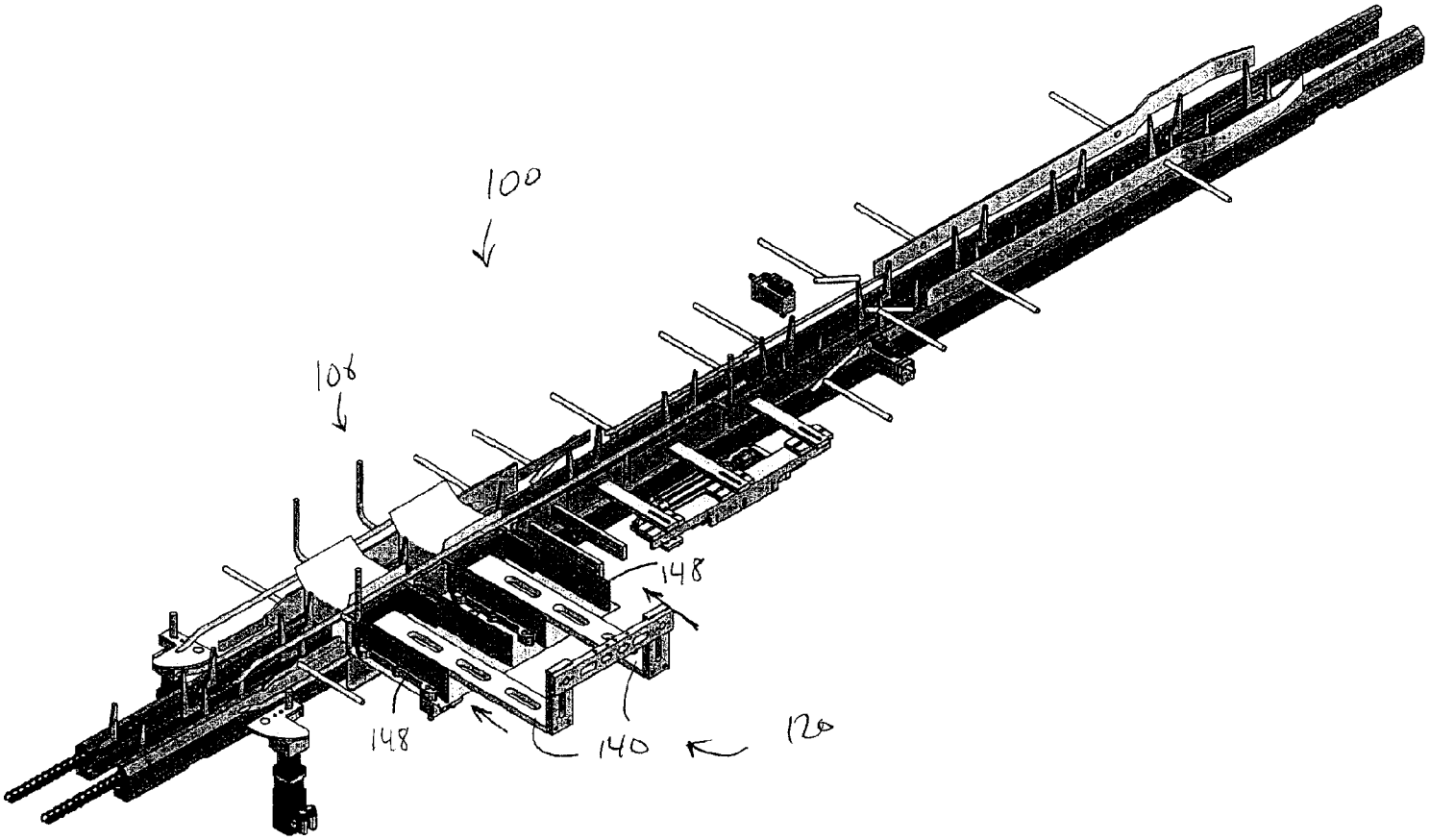

Referring back to the product loading station 120 as depicted in FIGS. 2 and 34, a pair of channel-shaped product guides 148 aligned with the reciprocating arms 140 guide the product 144 from the buckets (not shown) of the product conveyor 234 into the open ends of their respective cartons 110 as the product 144 is pushed by the pusher ends 142 during side-loading. The box closing apparatus 106 further comprises a reciprocating gate 150, is adjacent to the conveyor 114, between the product guides 148 and the conveyor 114. The reciprocating gate 150 may be a plate made from any suitable material such as steel or aluminium, and may reciprocate substantially vertically between a closed (raised)

position, as shown in FIGS. 2 and 34 for example, and an open (lowered) position, as shown in FIG. 14 for example.

Figure 70A:
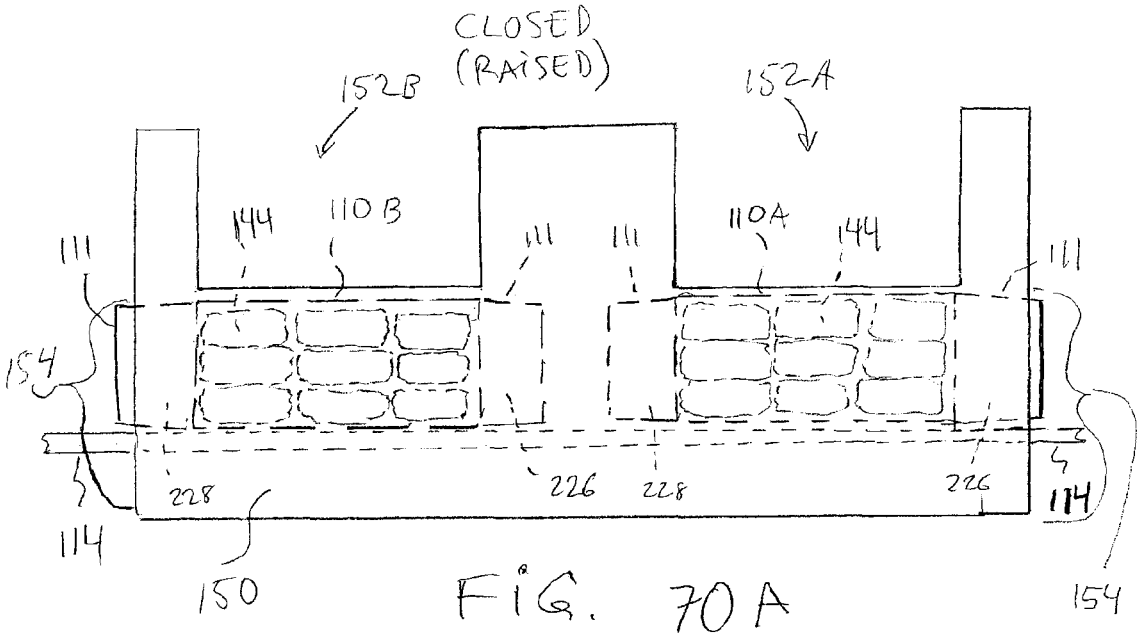
FIGS. 70A and 70B illustrate a reciprocating gate portion of the box closing apparatus of FIGS. 2 to 58 in greater detail.
Figure 70B:
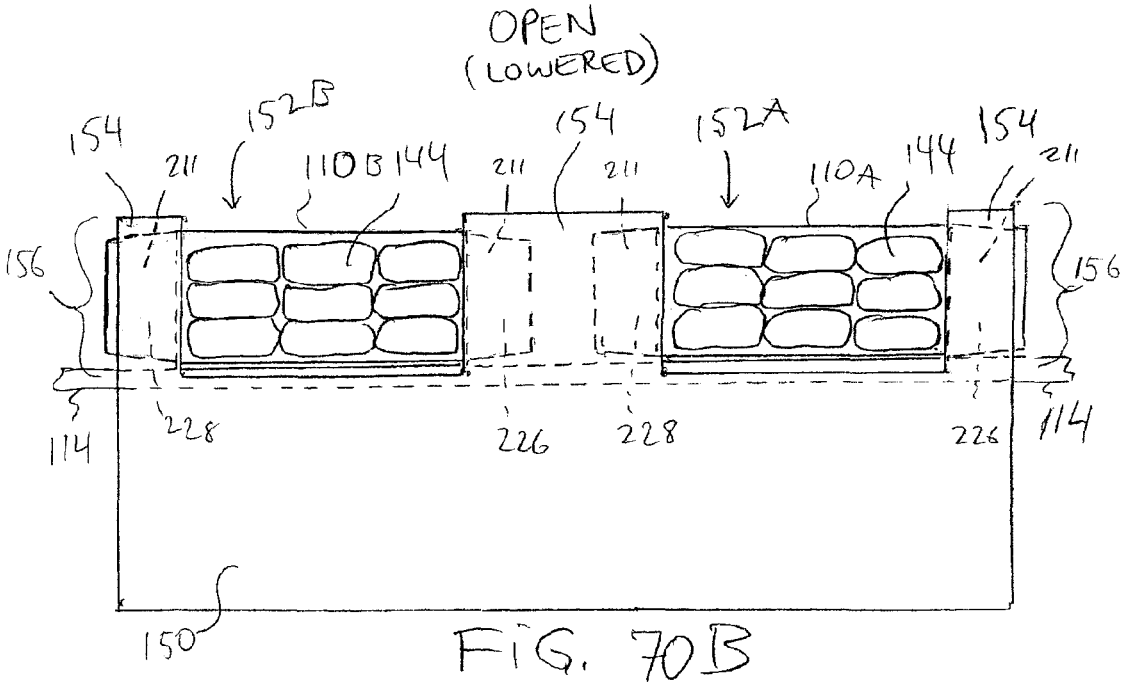

The reciprocating gate 150 is shown in greater detail in FIGS. 70A and 70B. The views of FIGS. 70A and 70B are side elevation views from the direction of the reciprocating arms 140, looking towards the carton conveyor 114.

Referring to FIGS. 70A and 70B, it can be seen that the example reciprocating gate 150 is generally rectangular, although it may have other shapes in other embodiments. The reciprocating gate 150 has two open areas 152A and 152B (referred to generically or collectively as open area(s) 152). Each open area 152 is slightly larger than, and similarly shaped as, an open end of a single carton 110. This is to permit simultaneous end loading of two cartons 110 when the gate 150 is in the open position. Generally, the number of open areas 152 may match a number of cartons 110 that are being simultaneously loaded, which may be only one or greater than two in alternative embodiments.

As perhaps best seen in FIGS. 2 and 34 in conjunction with FIG. 70A, when in the closed (raised) position, a lower portion 154 of the gate 150 forms a rail adjacent to the carton conveyor 114. After product loading (e.g. as shown in FIG. 70A), the lower portion 154 of the gate acts as a barrier to prevent product egress, i.e. to prevent any product 144 that has been loaded into cartons 110 from falling out of the opens of the cartons as the loaded cartons 110 are conveyed further downstream. The lower portion 154 of the gate 150 also acts to keep the minor flaps 111 of the cartons 110 at substantially right angles to the respective carton side walls to which the minor flaps are connected, both before and after loading. This is referred to as the fully open (or simply "open") position of the minor flaps 111. It will be appreciated that the terms "substantially right angle" and "fully open" as used herein may include angles slightly larger than 90 degrees (e.g. up to 100 degrees or possibly slightly greater) of a minor flap in relation to the minor panel to which the flap is connected. The precise angular measure of a minor flap relative to its associated minor panel may in part be determined by a proximity of an adjacent rail, along which the distal tip of the minor flip is currently riding or sliding along, to the end (i.e. to the loading end 218 or non-loading end 220) of the carton to which the minor flap is connected. The more proximate the rail to the end of the carton, the closer the angle may be to 90 degrees. This angle may change slightly as the carton is conveyed along the carton conveyor 114, e.g. as the distal tip of a resilient minor flap rides or slides along different rails whose transverse offset from the lateral edge (e.g. loading end) of the carton varies (e.g. like the different rail portions 172, 174, 176, 178 and 180 of FIG. 60). The riding or sliding contact is maintained in view of the material memory of the carton resiliently urging the distal tip of the minor flap against each one of the different rails. The minor flap closure technique that is described herein thus does not necessarily require the angle of the minor flap to be closed (relative to the minor panel to which the flap is connected) to be exactly 90 degrees or to be within only several degrees of that angle. In the "fully open" position, the leading minor flap 226 points substantially downstream. In a closed position, the leading minor flap 226 points substantially upstream. Conversely, in the "fully open" position, the trailing minor flap 228 points substantially upstream. In a closed position, the trailing minor flap 228 points substantially downstream.

Referring now to FIG. 14 and FIG. 70B, when the reciprocating gate 150 in the open (lowered) position, the open areas 152 in the gate 150 align with the open ends of their respective cartons 110 to permit the product 144 to be loaded into the cartons 110. At the same time, the upper portion 156 of the gate 150 still serves to hold open the minor flaps 111 of the cartons 110 in their open positions. This prevents the minor flaps 111 from closing during product loading, e.g. due to the memory of the carton material (i.e. the tendency of the material to return to its original state, e.g. flat), which could undesirably impede or obstruct the loading of the product 144 into the cartons.

Referring to FIGS. 1, 2 and 34, the minor flap closing station 130 is where the minor flaps 111 of a carton 110, on the loading end 218 of the carton, are closed. As will be appreciated, the minor flap closing station 130 is designed to prevent product egress during closure of the minor flaps. In the illustrated embodiment, the minor flap closing station 130 is used to close only the minor flaps on the loading end of the carton. In other embodiments, it is possible that the minor flaps on both ends (i.e. on both the loading and non-loading ends) of a carton may be closed at a minor flap closing station.

Figure 60:
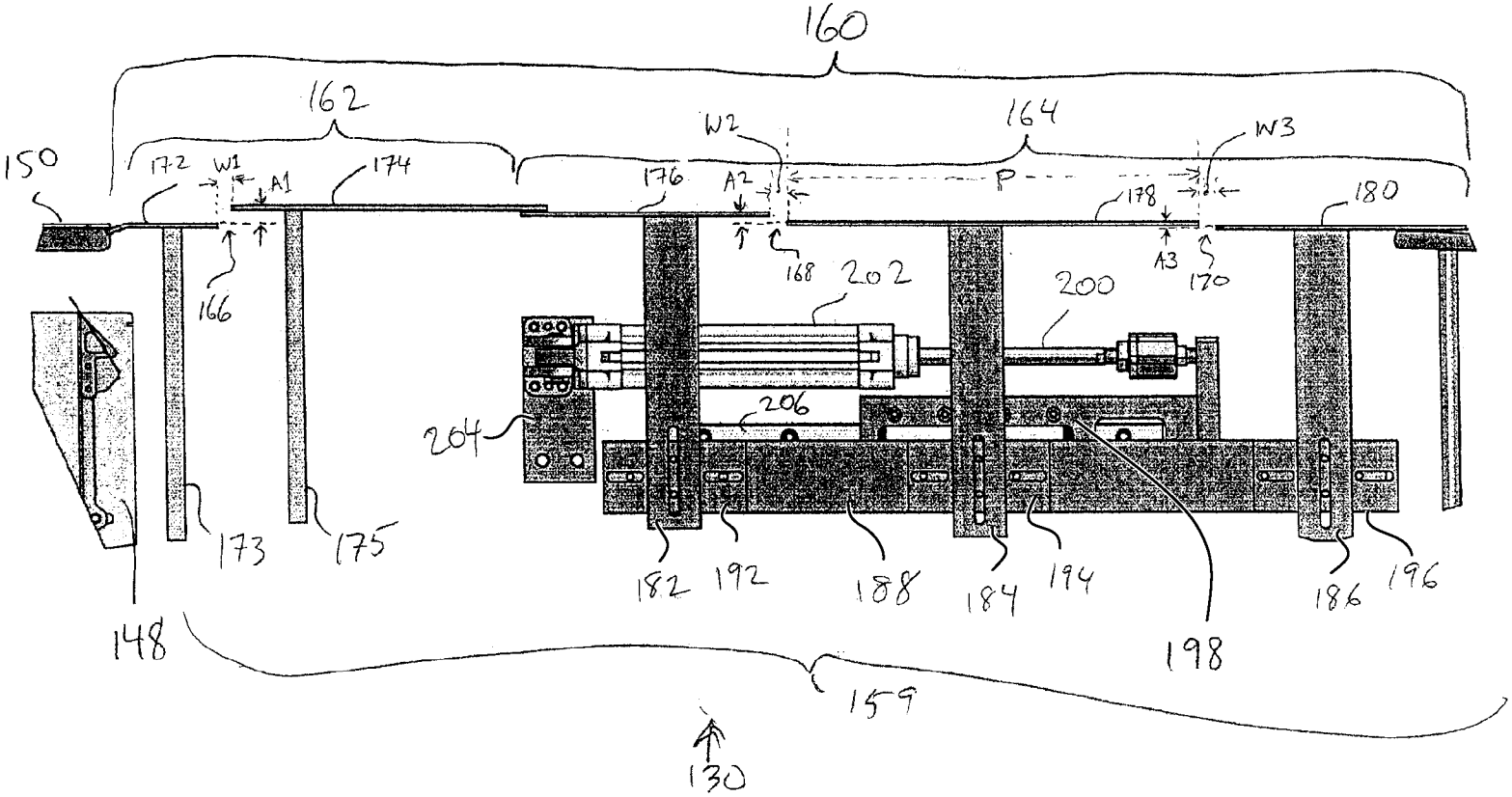
FIG. 60 is a top plan view showing a portion of the box closing apparatus of FIG. 59 in greater detail.

A portion of the minor flap closing station 130 is shown in greater detail in FIG. 60, which is an enlarged top plan view. It will be appreciated that the carton conveyor 114 is omitted from FIG. 60, for the sake of clarity. As illustrated, the minor flap closing station 130 comprises a minor flap closing device 159 comprising a longitudinal carton guide rail 160, adjacent to the carton conveyor 114. The rail 160 has a fixed section 162 and a movable, longitudinally reciprocating section 164. These sections may be referred to as the fixed rail 162 and reciprocating (or movable) rail 164, respectively.

The fixed rail section 162 of the minor flap closing device 159 is defined by two stationary rail portions 172 and 174 that are attached to bars 173 and 175 respectively. Bars 172 and 174 may be suitably attached to part of a support frame (not shown). The rail portions 172 and 174 define a slot 166 therebetween, i.e. within the fixed rail 162. This slot, which may be referred to as the leading minor flap closing slot 166, is used to catch and fold the leading minor flap on the loading end 218 of a carton 110 (e.g. leading minor flap 226 in FIG. 61 or 70A, for example, as described below) as the carton is conveyed past the slot. The rail portions 172 and 174 are separated by a width W1, which is the width of slot 166 as measured longitudinally. The downstream rail portion 174 (being so identified based on the direction D of conveyance) is offset inwardly, i.e. towards the conveyor 114, by an offset A1, relative to rail portion 172. That is, the downstream side of the slot 166 is inwardly offset relative to the upstream side of the slot. Put another way, the slot 166 is partially upstream-facing. As will be appreciated, this may facilitate receiving or "catching" of a leading minor flap within the slot as a carton 110 is conveyed by conveyor 114 past the slot 166. In some embodiments, the offset A1 may be omitted (i.e. may equal zero). This may be done, e.g., if the desired "catching" effect can be achieved without the offset (possibly due to the memory of the leading, downstream-pointing minor flap 111, which may tend to point the flap transversely from the conveyor 114). The width W1 and/or offset A1 of the slot 166 may be adjustable in some embodiments.

In some embodiments, the rail portions 172 and 174 may each be formed as longitudinally extending plates and be made from a thin material, such as 1/16 inch or ten gauge sheet metal for example. The reason is that a slight offset between the rails 172 and 174 in that case may be sufficient for the planar rail portions 172 and 174 to be fully non-coplanar with respect to each other. Such an arrangement may tend to limit a risk of a downstream-pointing leading minor flap 226 that is being conveyed downstream, impacting an upstream edge of the rail portion 174 as it is thrust through the slot 166. Depending upon such factors as carton material resiliency, conveyor speed, and slot width, it may not be required for the rail portions 172 and 174 to be fully non-coplanar in every embodiment.

Referring to FIG. 60, the reciprocating rail 164 section of the minor flap closing device 159 has a pair of slots 168 and 170 defined therewithin, which may be referred to as trailing minor flap closing slots 168 and 170. The distance between the slots 168 and 170 is substantially equal to a pitch P of the conveyor 114 (i.e. the distance between corresponding points on adjacent cartons). These slots are used to substantially simultaneously fold the trailing minor flaps (e.g. trailing minor flap 228 in FIG. 61 or FIG. 70A, for example, as described below) of a pair of cartons 110 that are temporarily stationary (i.e. in a dwell period) on the carton conveyor 114, adjacent to the reciprocating rail. The slots 168 and 170 operate in essentially the opposite way as the leading minor flap closing slot 166 in the sense that, rather than the cartons 110 being conveyed past the fixed slot 166 to cause the leading minor flap to close, the slots 168 and 170 are conveyed, by way of downstream movement of the reciprocating rail 164 in which the slots are defined, past respective trailing minor flaps of two adjacent cartons 110, to cause those trailing minor flaps to close.

It will be observed that, in the present embodiment, there is only one slot 166 for closing leading minor flaps but two slots 168 and 170 for closing the trailing minor flaps of two respective cartons. The single slot 166 is sufficient for the closing leading minor flaps of all cartons 110 that are conveyed past it, because mere conveyance (i.e. indexing) of a carton past the slot 166 causes the leading minor flap to close (as will be described below in greater detail). In contrast, the design choice for having two slots 168 and 170 for closing trailing minor flaps was made in part due to the fact that the upstream product loading station 120 is designed to simultaneously load two cartons 110, and due to the fact that the product loading is performed with the cartons being stationary (i.e. with the carton conveyor 114 in a dwell period). In particular, in order to receive and close a trailing minor flap of a carton 110 using a slot in an adjacent rail, it is desired to cause the slot to move in a downstream direction relative to the carton, past the flap. While it would also be possible to move the carton upstream relative to the slot, such upstream movement may be considered detrimental to throughput. The use of a pair of slots 168 and 170, separated by a distance substantially equal to the pitch P, allows the reciprocating rail 164 to substantially simultaneously close the trailing minor flaps 228 of each of a pair of stationary loaded cartons 110 during the dwell period. If only a single slot were used to close the trailing minor flaps 228 of two cartons during the dwell period, it may be necessary to move the reciprocating rail 164 longitudinally over a distance that is greater than the pitch P between cartons. Moreover, if such a slot were required to move downstream past the leading minor flap 226 of carton 110B to reach the trailing minor flap 228 of carton 110A, the slot might catch and undesirably re-open the leading minor flap 226 of carton 110B. Thus, it may be desirable, although not necessarily required, for the number of slots in the reciprocating rail of the minor flap closing station 130 to match the number of cartons being simultaneously loaded at the upstream product loading station 120.

Referring to FIG. 60, the slots 168 and 170 in the reciprocating rail 164 are defined by three rail portions 176, 178 and 180 mounted on respective arms 182, 184 and 186. The arms 182, 184, 186 are in turn mounted to respective plates 192, 194 and 196, and the plates are mounted to a longitudinal member 188. The lateral position of arms 182, 184 and 186 is individually adjustable, and the longitudinal position of plates 192, 194 and 196 is individually adjustable.

The first two rail portions 176 and 178 are separated by a width W2, and the second two rail portions 178 and 180 are separated by a width W3. The upstream rail portion 176 is offset inwardly, i.e. towards the conveyor 114, by an offset A2 relative to middle rail portion 178. Similarly, the middle rail portion 178 is offset inwardly by an offset A3 relative to the downstream rail portion 180. That is, the upstream side of each of slots 168 and 170 is inwardly offset relative to the downstream side of the slot. Put another way, each of the slots 168 and 170 is partially downstream facing. As will be appreciated, this may facilitate receiving or "catching" of respective trailing minor flaps within the slots the slots move downstream past respective cartons 110. It will be appreciated that the offsets A2 and A3 may be omitted (i.e. may equal zero) in some embodiments, for similar reasons that the offset A1 may be omitted in some embodiments. The widths W2 or W3 and offsets A2 and A3 are adjustable by way of adjustment of the arms 182, 184, 186 and plates 192, 194, 196. However, it is possible that the width or offset (if any) of either one or both of the slots 168, 170 may be fixed in some embodiments.

In some embodiments, the rail portions 176, 178 and 180 may each be formed as longitudinally extending plates and may be made from a thin material, such as 1/16 inch or ten gauge sheet metal for example. The reason is that a slight offset between the rail portions in that case may be sufficient for the planar rail portions 176, 178 and 180 to be fully non-coplanar with respect to one another. Such an arrangement may tend to limit a risk of a upstream-pointing trailing minor flap 228, impacting an upstream edge of the rail portion 176 or 178 as the flap 228 is thrust through the slot 168 or 170 respectively. Depending upon such factors as carton material resiliency, speed of the reciprocating rail 164, and width of slots 168 and 170, it may not be required for rail portions 176 and 178, or rail portions 178 and 180, to be fully non-coplanar in every embodiment.

The longitudinal member 188 is fixedly mounted to a carriage 198. Carriage 198 may in turn be configured for sliding longitudinal movement along a supporting rail member 206 (FIG. 60). Rail member 206 may be supported on part of a support frame (not shown).

Carriage 198 may be operable to reciprocate longitudinally by the action of reciprocating piston arm 200 relative to the fixed cylinder 202 mounted to fixed mounting bar 204. Mounting bar 204 may also be attached to the support frame (not shown). The piston arm 200 and cylinder 202 may for example comprise a double-acting pneumatic actuator, such as the model DFM-25-80-P-A-KF Part #170927 made by Festo. The pneumatic actuator may be supplied with pressurized air communicated through electronic solenoid valves for causing the piston arm to retract and extend. The solenoid valves may for example be a model CPE14-M1Bh-5J-1/8 made by Festo and may be controlled by controller 108. Alternatively, a linear servo drive system may be provided for this actuator. Such a servo drive system could be controlled by controller 108. The minor flap closing device 159 is considered to include, among other components, the piston arm 200, cylinder 202, carriage 198, longitudinal member and arms 182, 184, 186.

Referring again to FIG. 1, the box closing system 100 also comprises a controller 108. The controller 108 generally controls the operation of the box closing system 100, including subsystems such as the carton feeder 104 and various box closing apparatus subsystems including the carton conveyor 114, the product loading station 120, and the minor flap closing device 159 at the minor flap closing station 130. The control of these subsystems is illustrated schematically by dashed lines in FIG. 1. The controller 108 may also receive input from various sensors, such as optical sensors or encoders for example, which are not expressly illustrated. These sensors may provide feedback regarding the presence of cartons at certain positions within the system 100 or of the position of various moving parts within the system 100 for example. To controller 108 may also control other actuators in box closing apparatus 106, such as servo motors or DC motors, drives, vacuums, vacuum generators and vacuum cups for example. Controller 108 may be any suitable controller, such as a programmable logic controller ("PLC"). For example, controller 108 may be or may include a unit chosen from the Logix 5000 series devices made by Allen-Bradley/Rockwell Automation, such as the ControlLogix 5561 device.

Electrical power can be supplied to the controller 108, and to all the various actuators, motors and sensors that are described herein. Compressed air can also be supplied to vacuum generators and pneumatic actuators that may be used to drive certain components, such as the reciprocating gate 150 or the reciprocating rail 164, through valve devices such as solenoid valves that are controlled by controller 108. Servo motors may be connected to and in communication with servo drives that are in communication with and controlled by controller 108.

In some embodiments, a human operator may input commands and/or view status of the box closing system 100 through a Human Machine Interface (HMI) module, in electronic communication with controller 108, that may be physically attached to box closing system 100 for example.

Various other components of the box closing apparatus 106 will be described during the description of operation of the system 100.

Operation of the box closing system 100 is described below with reference to the top right perspective views of FIGS. 2 to 33, the top left perspective views of FIGS. 34 to 58, and the top plan views of FIGS. 59 and 60. FIGS. 2 to 33 show the progression of a single example pair of cartons through the box closing apparatus 106 from a top right perspective, and FIGS. 34 to 58 show the progression of that same example pair of cartons through the box closing apparatus 106 from a top left perspective. Reference will also be made to FIGS. 61-68, which show perspective views of a carton 110 in various states or configurations as it is manipulated by the box closing system 100.

In each of FIGS. 2 to 58, a parenthesized measurement (e.g. 0", 2.5", etc.) appears below the figure label. This measurement represents a current distance, in inches, of a leading edge of a leading carton 110A from a baseline starting position S (see FIG. 2) along the carton conveyor 114. The larger the distance, the further the carton has been conveyed downstream along the conveyor 114. The indicated distance may facilitate correlation of carton position between right and left hand perspective views (e.g. in both of FIGS. 3 and 5, the distance is 2.5"; thus the figures are correlated in terms of lead carton position). A caveat is that, during dwell periods (e.g. as shown in FIGS. 12 to 17 and 44 to 49), the current distance may remain the same (e.g. 36"), despite the fact that other actions may be occurring (e.g. product loading or minor flap closing). Thus, when two figures indicate the same parenthesized current distance, they do not necessarily represent the same moment in time.

Figure 61:
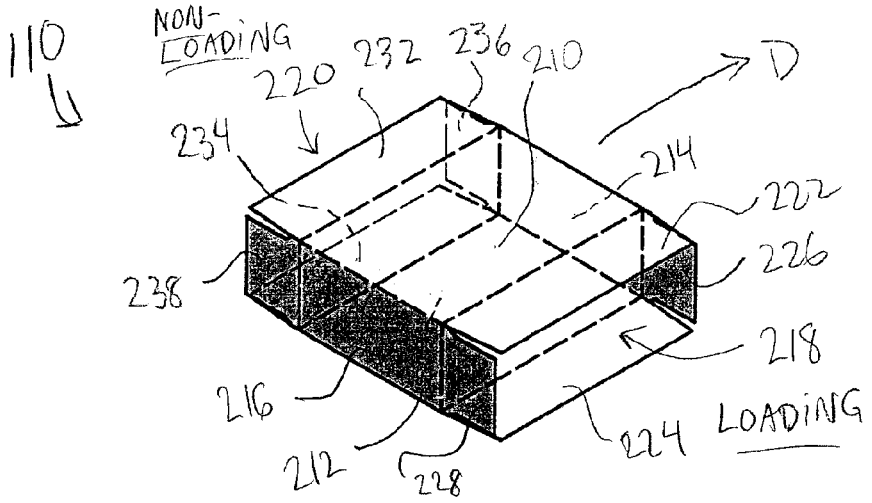
FIGS. 61 to 69 are perspective views of a box in various states as it is manipulated by the box closing apparatus of FIGS. 2 to 58.

Referring to FIG. 1, the erector head 106 of carton feeder 104 picks up a KD carton blank 110 from carton magazine 102, reconfigures the blank from a flattened state into an erected state, and placed the erected carton 110 in a slot 112 on a carton conveyor 114 with open ends facing sidewards, as shown in FIGS. 2 and 34. In FIGS. 2-58, this carton is referred to as carton 110A to distinguish it from another carton 110B that will be shown in FIGS. 6-33 and 38-58. The initial configuration of the erected carton 110 is as shown in FIG. 61. In FIG. 61, the carton is referred to generically as carton 110 (rather than specifically as carton 110A or 110B).

Referring to FIG. 61, a top right perspective view of an example of one kind of carton 110 that can be processed by box closing system 100 is shown. Other types of carton blanks, tubular carton blanks, and tubular carton blanks of different sizes can be processed by alternative embodiments.

The example carton 110 has an upper major panel 210 and an opposed lower major panel 212. These panels are integrally interconnected to a leading minor panel 214 and an opposed trailing minor panel 216, with the terms "leading" and "trailing" being with respect to a direction of conveyance D by carton conveyor 114. The shape of the erect carton 110 is generally cuboid. The major and minor panels 210, 212, 214 and 216 may alternatively be referred to as walls of the carton 110.

The erected carton 110 has a loading end 218 and a non-loading end 220. The distinction between these is that, during product loading at the product loading station 120, the product 144 is loaded through the loading end 218 but not through the non-loading end.

On the loading end 218, an upper major flap 222 and a lower major flap 224 are connected along fold lines to respective walls of the box, namely to upper major panel 210 and lower major panel 212 respectively. Similarly, a leading minor flap 226 and a trailing minor flap 228 are connected along fold lines to leading minor panel 214 and trailing minor panel 216, respectively. Minor flaps accordingly oppose one another at the loading end 218 of the carton 110. It is understood that the fold lines need not be expressly formed and may not be visible in some embodiments. The leading and/or trailing minor flaps 226 and 228 may be referred to generically or collectively as minor flaps 211.

On the non-loading end 220, an upper major flap 232 and a lower major flap 234 are connected along fold lines to upper major panel 210 and lower major panel 212 respectively. Similarly, a leading minor flap 236 and a trailing minor flap 238 are connected along fold lines to leading minor panel 214 and trailing minor panel 216, respectively.

In some embodiments, the fold lines may be formed by a weakened area of material or with a crease forming apparatus. The effect of the fold lines is that a flap can be opened or closed, i.e. swung about an edge of an adjacent panel or wall to which the flap is connected, along the fold line.

Figure 3:
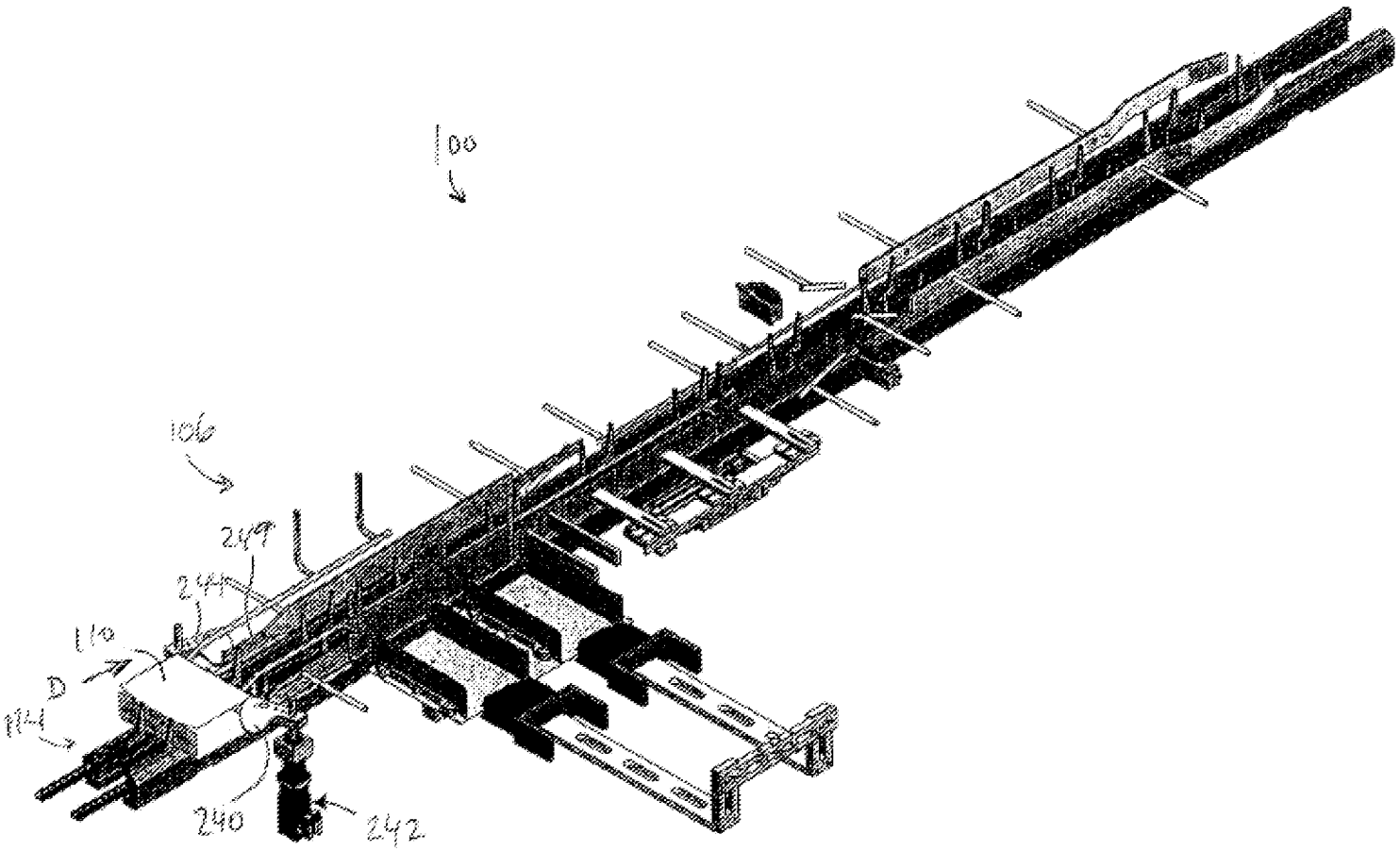
Figure 4:
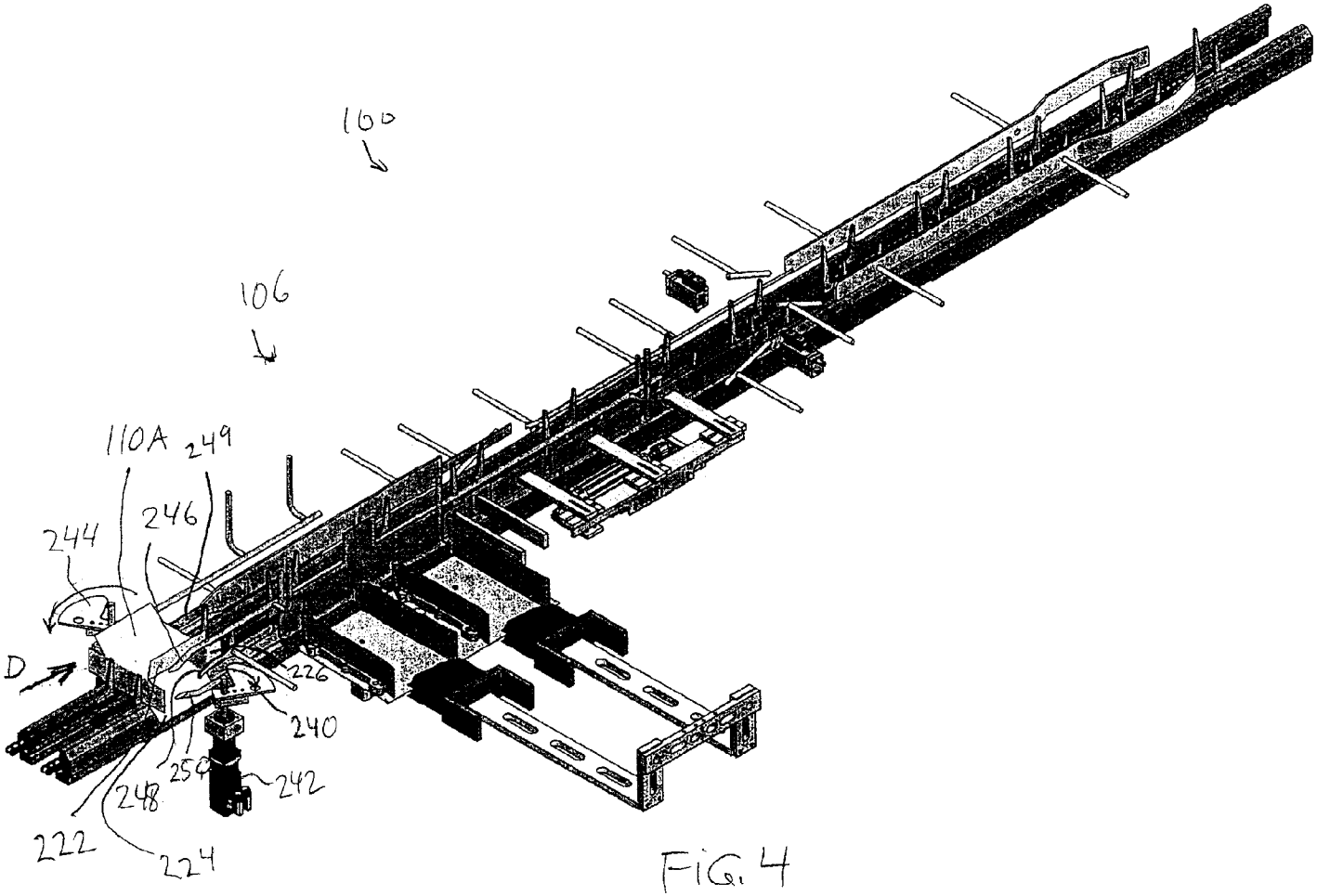
Figure 35:
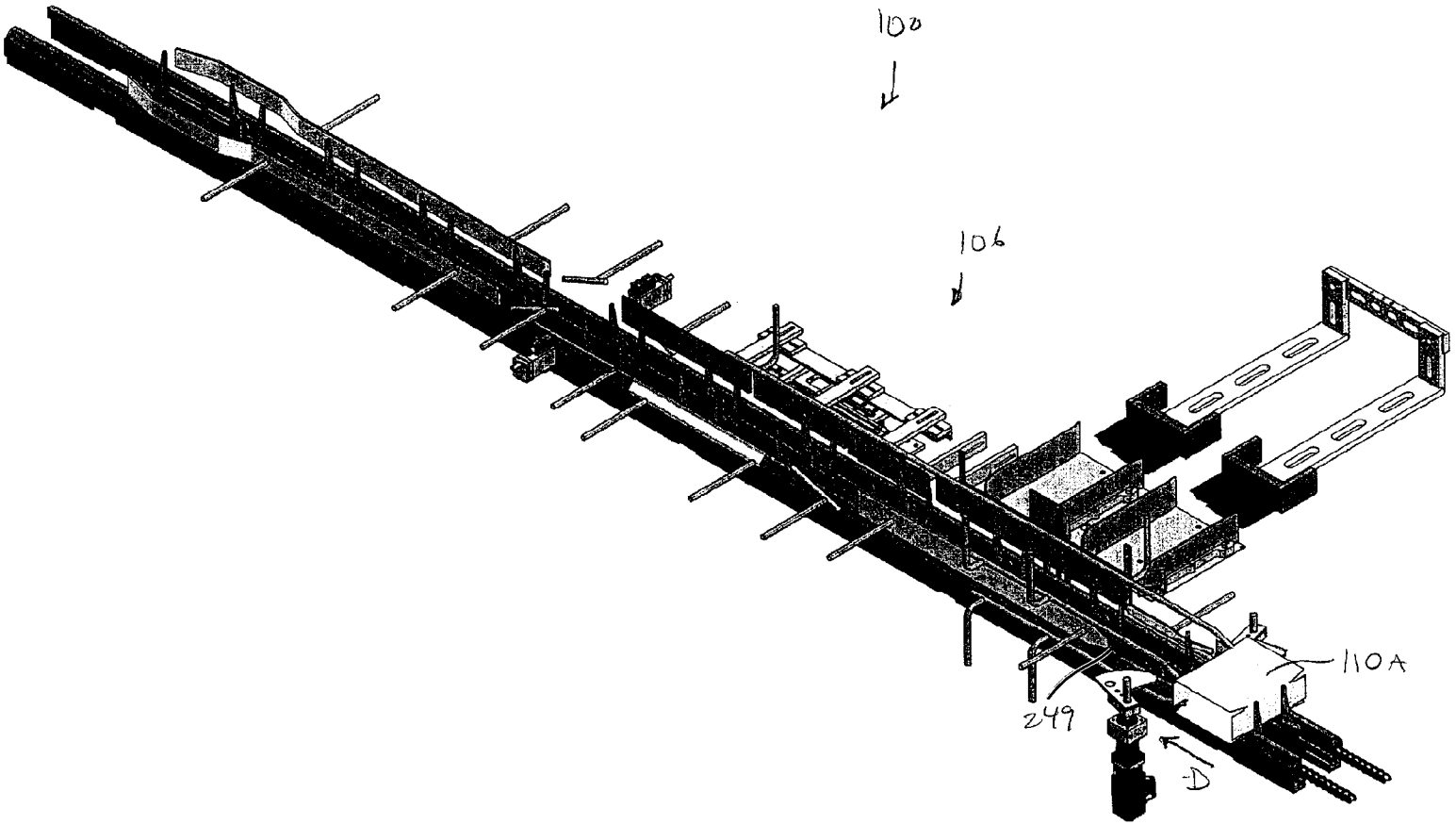
Figure 36:
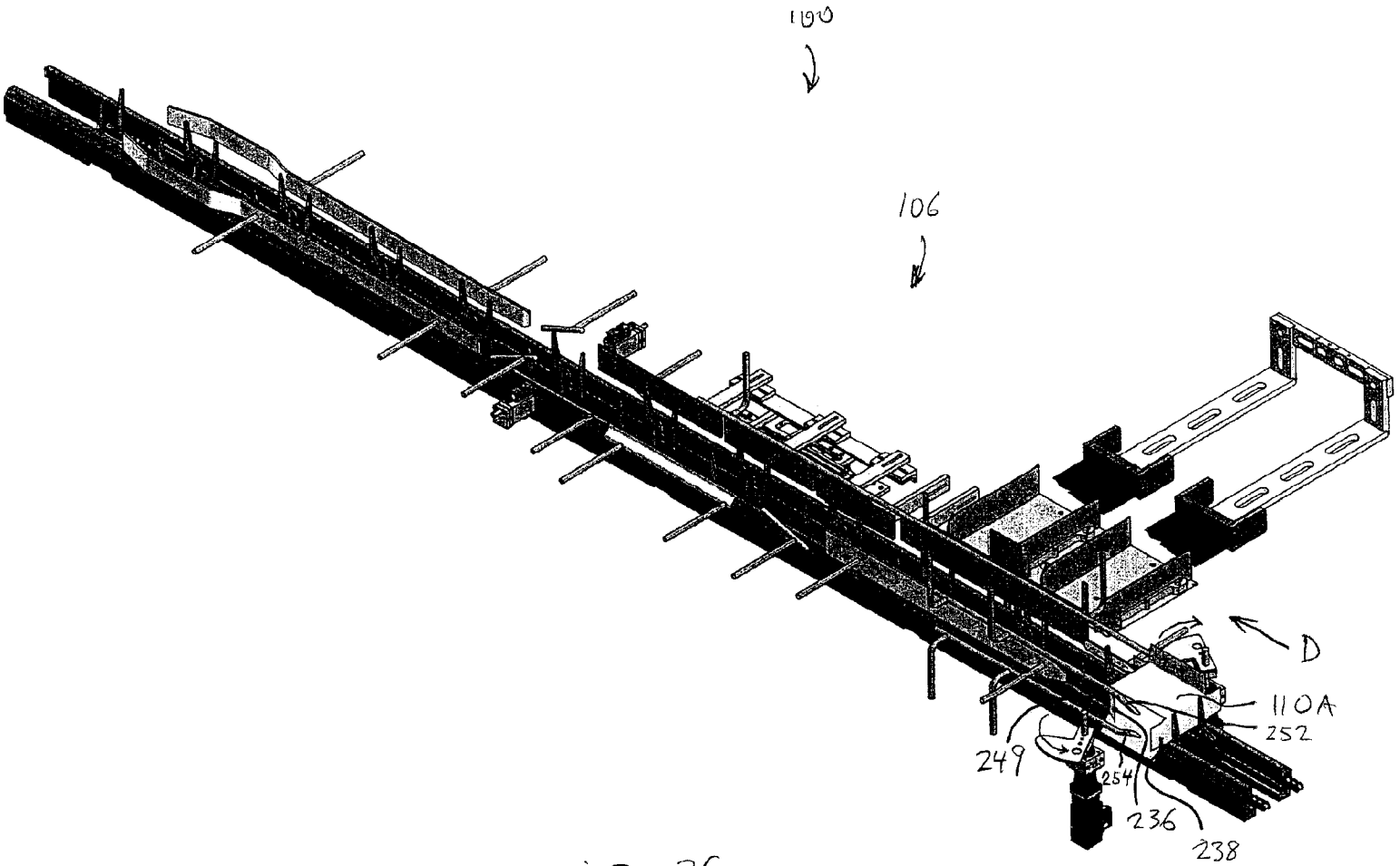
Figure 62:
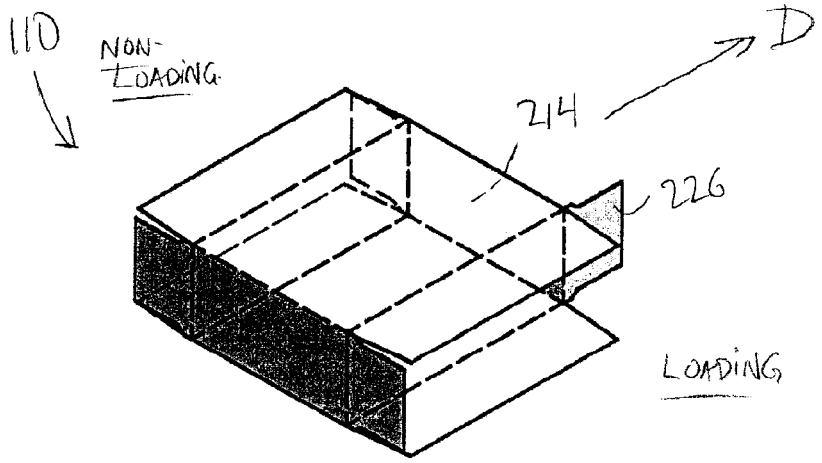

Referring to FIGS. 3 and 35, the carton conveyor 114 conveys the carton 110A downstream until the leading minor panel 214 is adjacent to kicker 240. The kicker 240, driven by an actuator 242 such as a servo motor or other suitable actuator, rotates clockwise, striking an interior side of the leading minor flap 226 with its leading flat edge as the carton 110A continues to be conveyed in downstream direction D. This causes the leading minor flap 226 to swing open in the conveyance direction D, and results in the minor flap 226 pointing outwardly from the carton 110A at substantially a right angle to the adjacent leading minor panel 214, i.e.

downstream in the open position, as shown in FIG. 62. The kicker may be any kind of suitable kicker (rotary, disk, or otherwise).

Moreover, due to the continued downstream conveyance of the carton 110A, before the leading minor flap 226 has an opportunity to return to its original position as shown in FIG. 61 (due to material memory for example), the leading minor flap 226 is caught by the leading, ski-shaped end of stationary guide rail 248 (FIG. 4), which keeps the leading minor flap 226 pointing downstream in the open position as the carton 110A is conveyed downstream, with the flap 226 sliding along the rail 248. It will be appreciated that the timing of the kicker strike upon the flap 226 relative to the conveyor speed and the degree of resiliency of the carton material may necessitate precise control of these elements to avoid, e.g., a premature "snap-back" of the minor flap to a transverse orientation and a resultant inadvertent closure of the leading minor flap 226.

Figure 5:
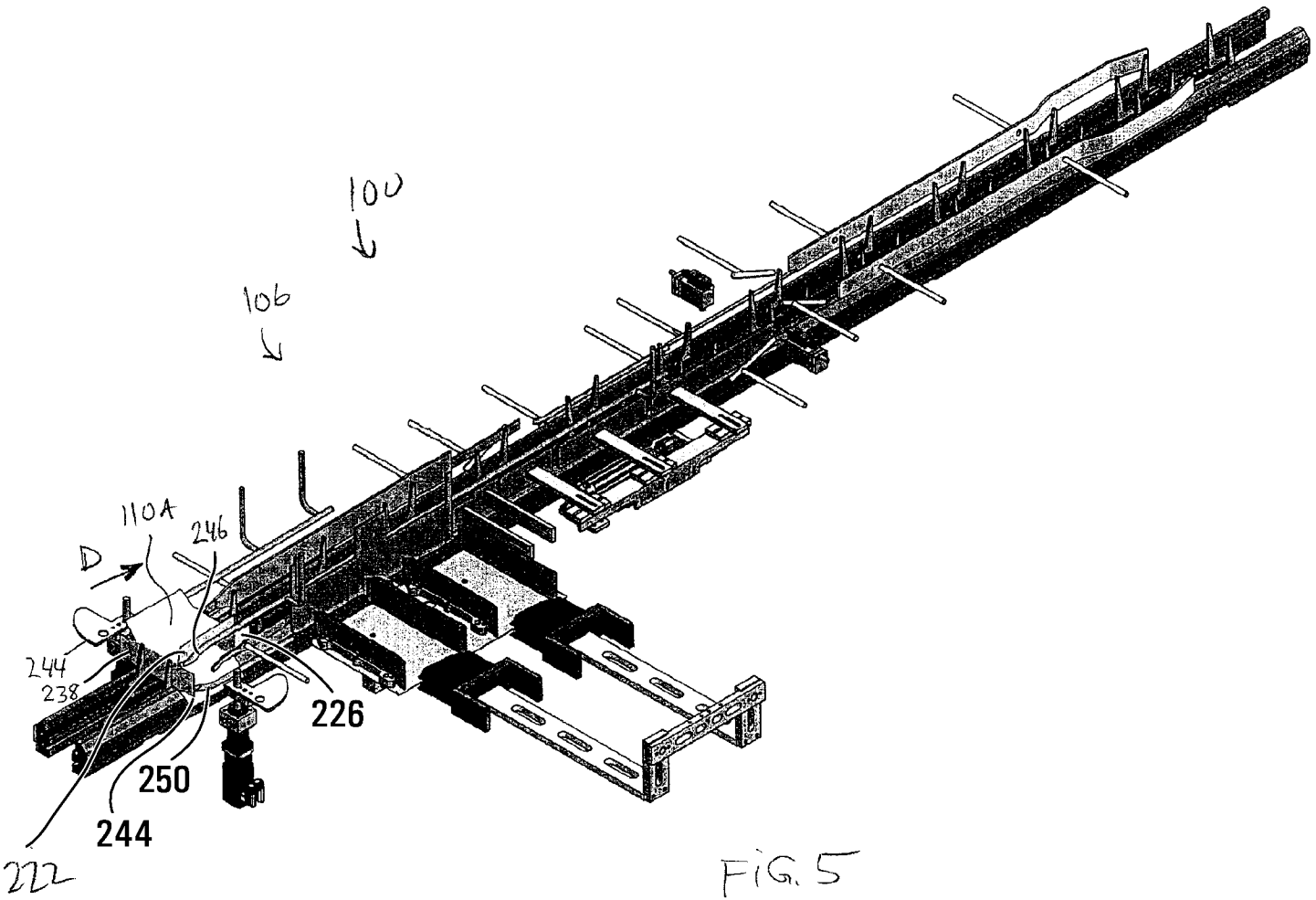

At the same time, the upper and lower major flaps 222 and 224 are spread apart, i.e. folded upwardly and downwardly respectively, to the substantially open positions that are shown in FIG. 5, through contact with the upper major flap lifter rod 246 and the lower major flap lifter rod 250, respectively, as the carton 110A is conveyed in the downstream direction D. The upper major flap 222 is held in this position by the upper major flap lifter rod 246 throughout product loading and at least part of the minor flap closing that occurs subsequently, since the length of rod 246 extends through the product loading station 120 and into the minor flap closing station 130. The lower major flap lifter rod 250 keeps the lower major flap 224 open until the carton reaches the product loading station 120, at which point the gate 150 will hold the lower major flap 224 open. After the product loading station 120, it may not necessarily be required to keep the flap 224 open.

Figure 37:
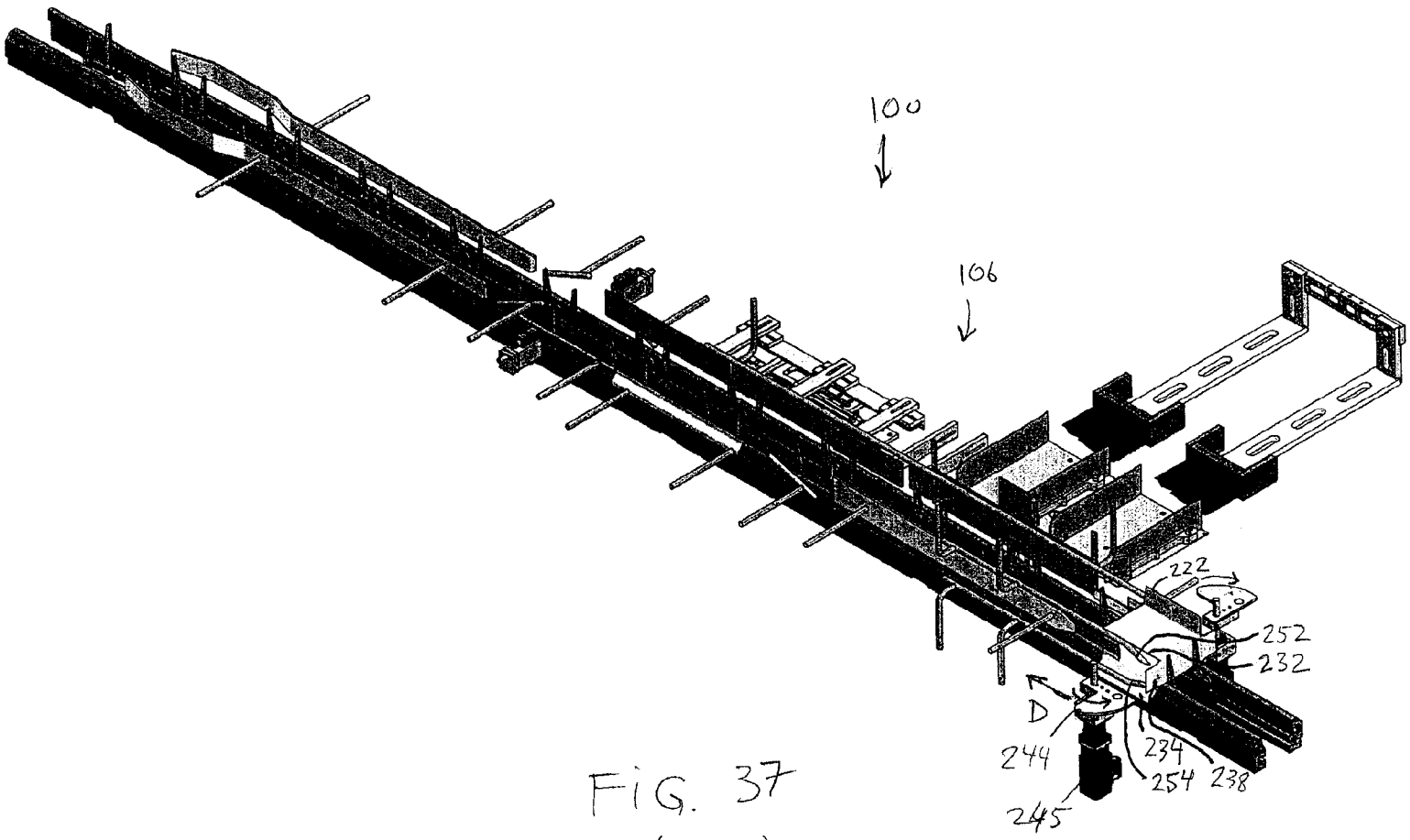

Meanwhile, on the non-loading side of the carton 110A, an opposing guide rail 249 (shown, e.g., in FIGS. 2, 3 and 34) comes into contact with the leading minor flap 236 as the carton 110A is conveyed downstream. This causes the leading minor flap 236 to be folded (see FIG. 36) to a closed position in which the flap 236 is pointing upstream at substantially a right angle to the adjacent leading minor panel 214 (see FIG. 62). Subsequently, the upper and lower major flaps 232 and 234 on the non-loading side are spread apart upwardly and downwardly, respectively, to the substantially open positions that are shown in FIGS. 5 and 37, through contact with the stationary upper major flap lifter rod 252 and the stationary lower major flap lifter rod 254, respectively (see FIG. 37). For clarity, the upper major flap 232 is shown edge-on in the perspective view of FIG. 37 and thus appears as a line in that drawing. The state of the carton 110A at this stage is as shown in FIG. 63.

Figure 6:
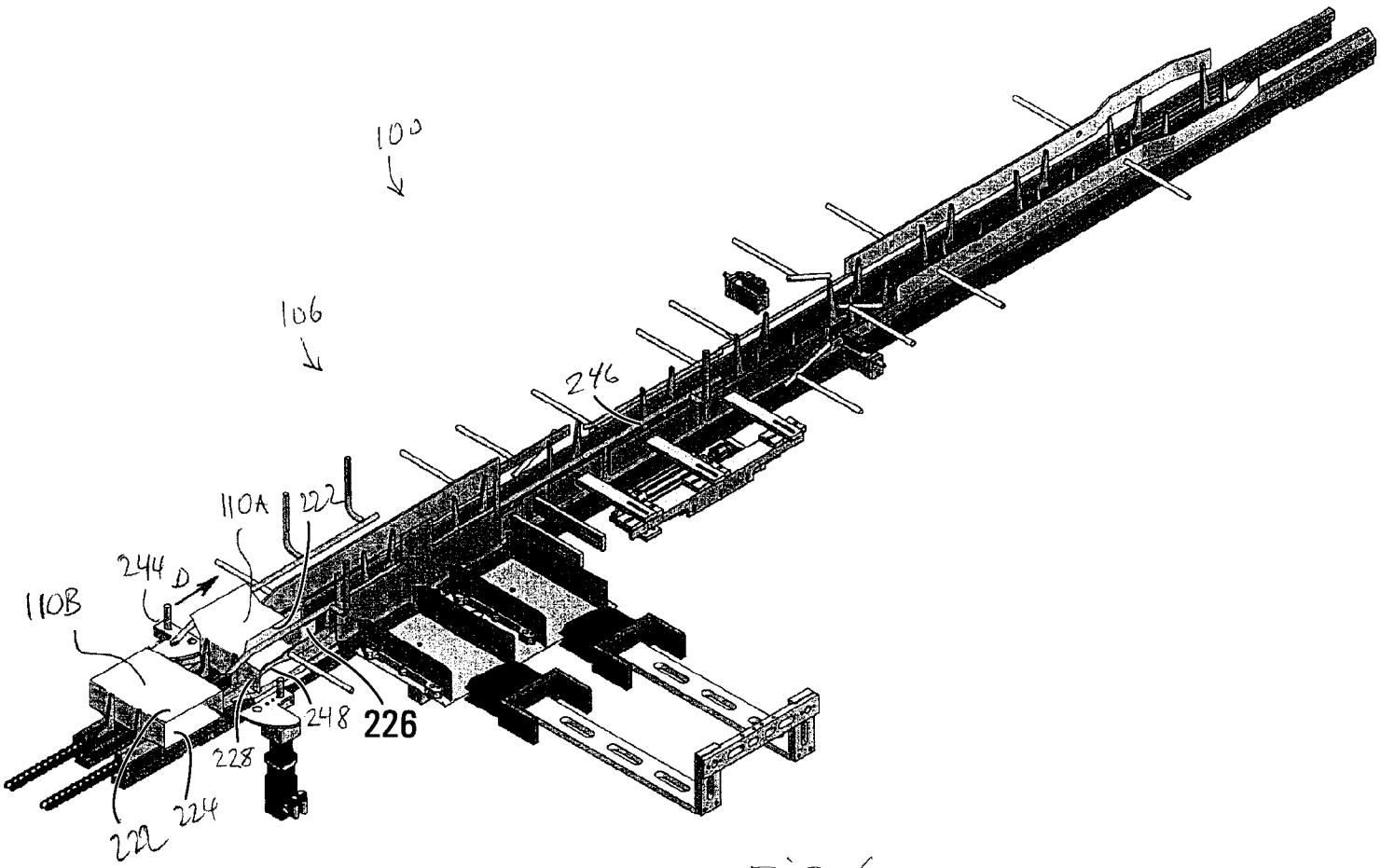
Figure 7:
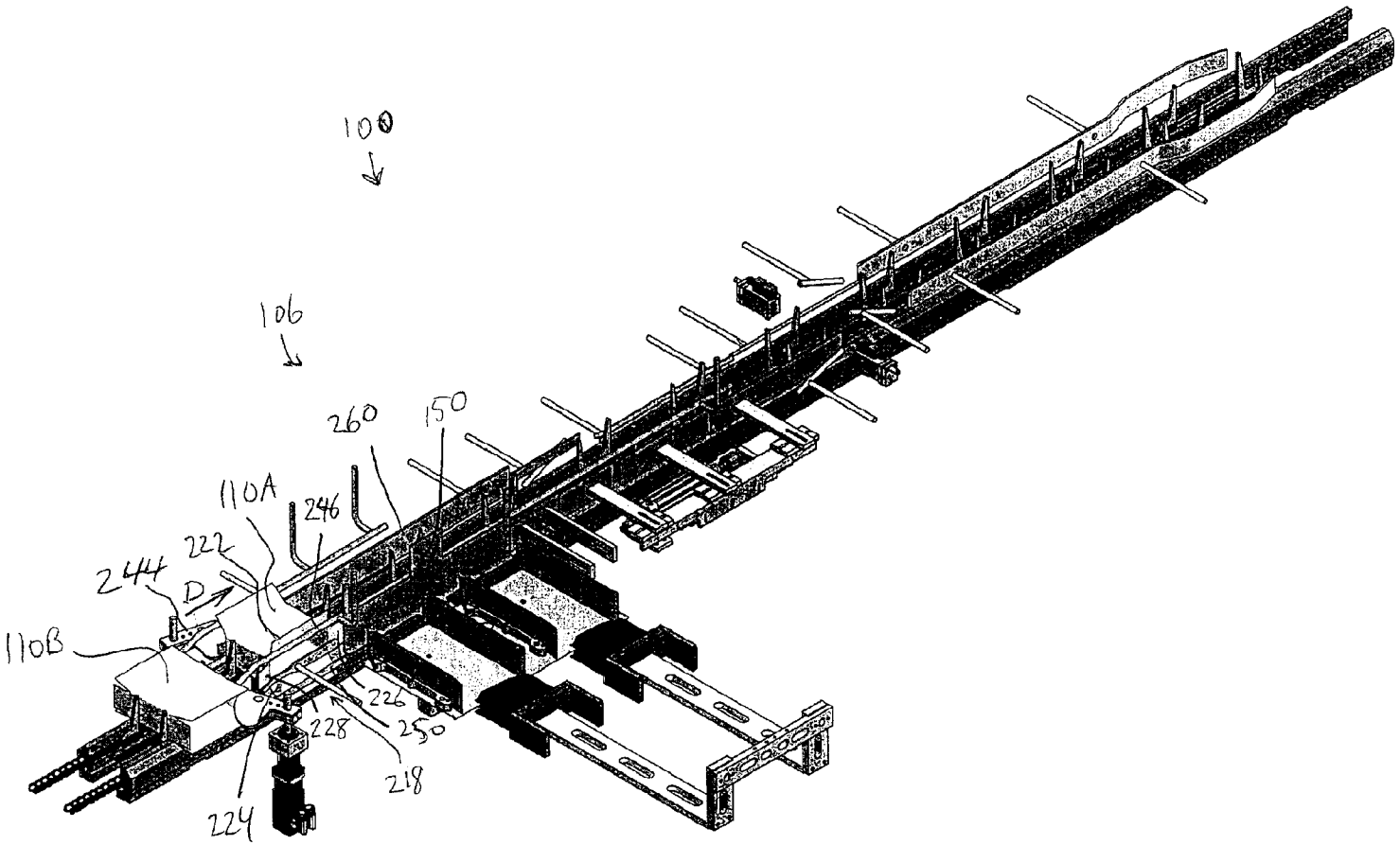
Figure 8:
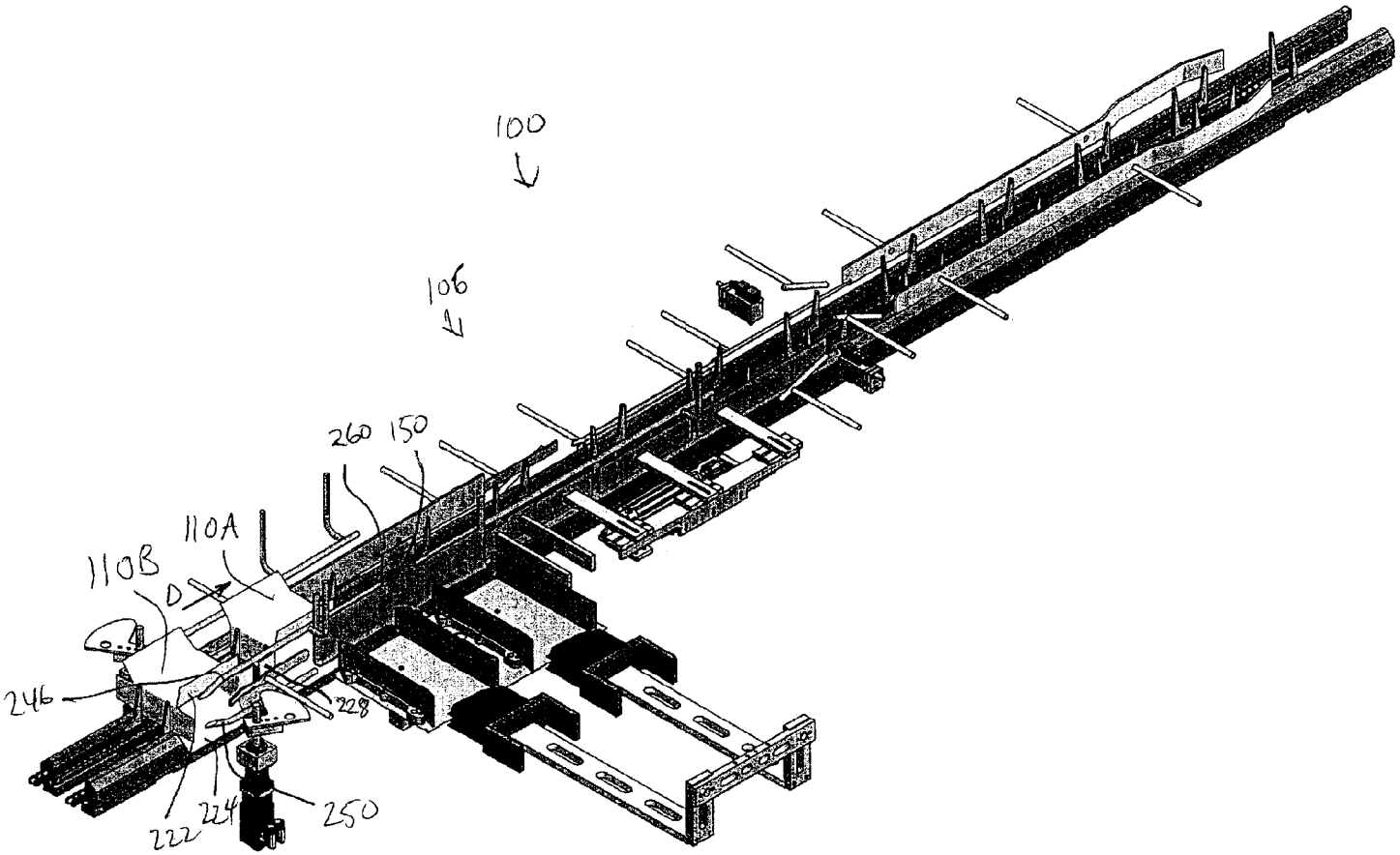
Figure 9:
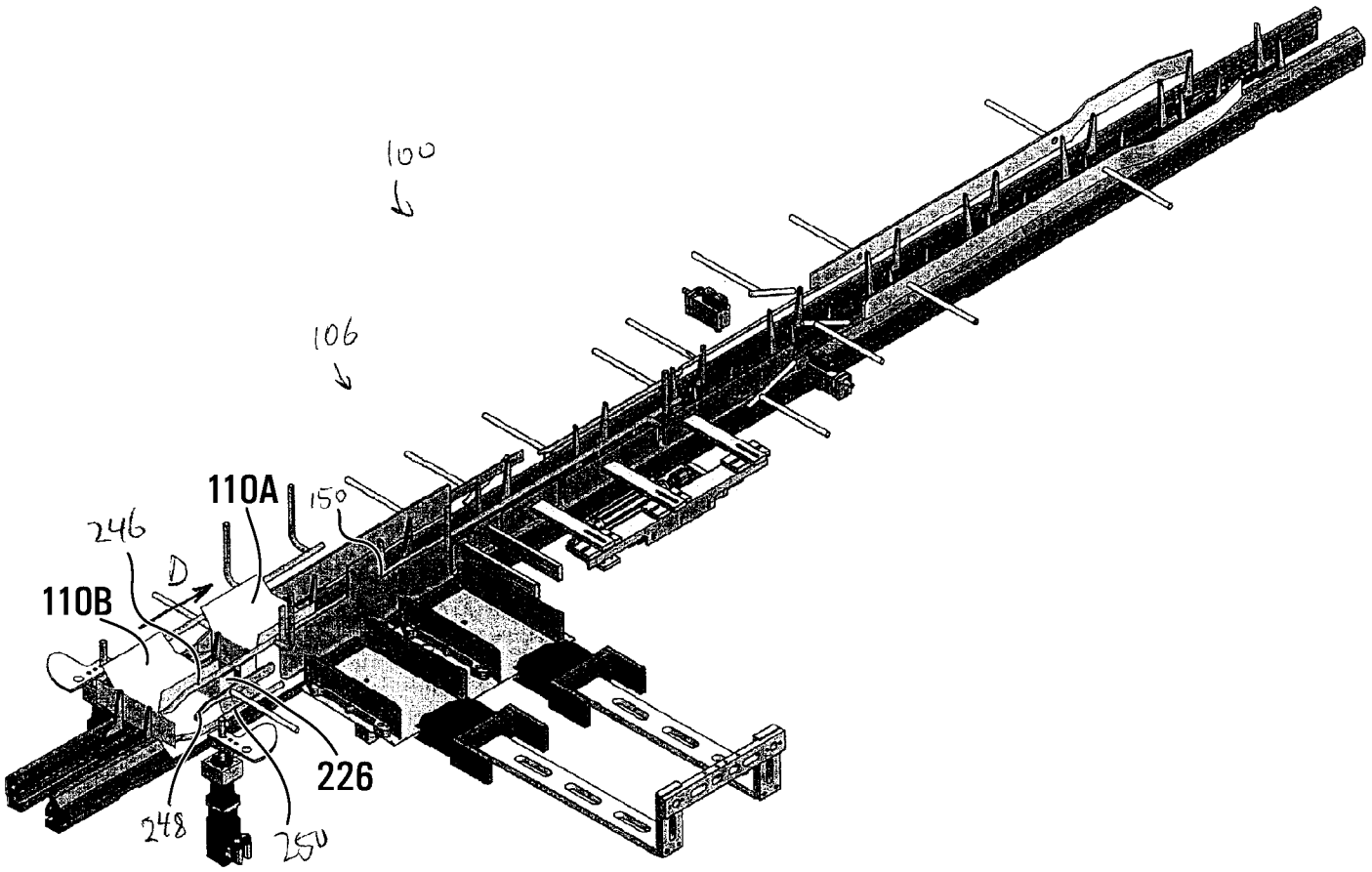
Figure 10:
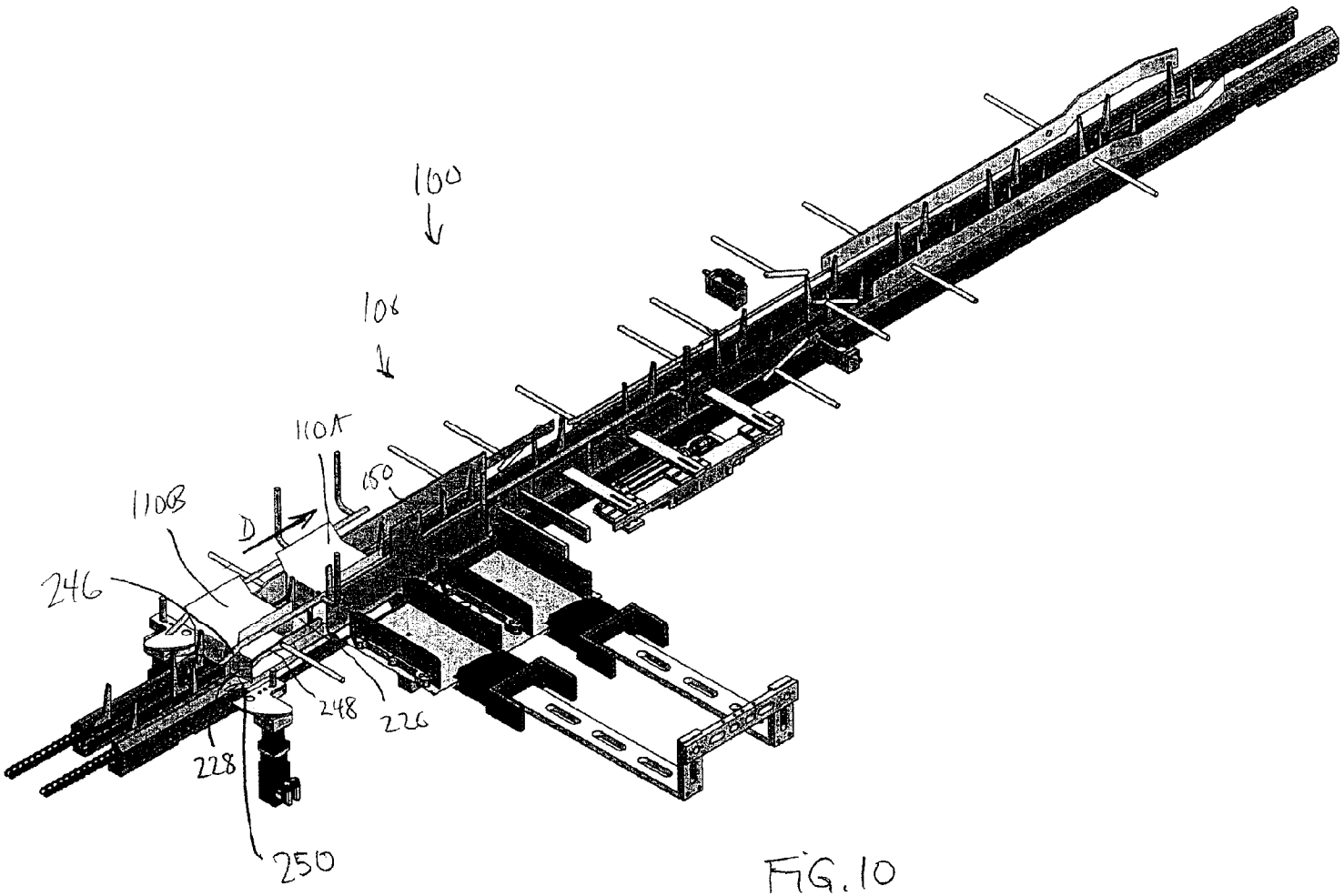
Figure 11:
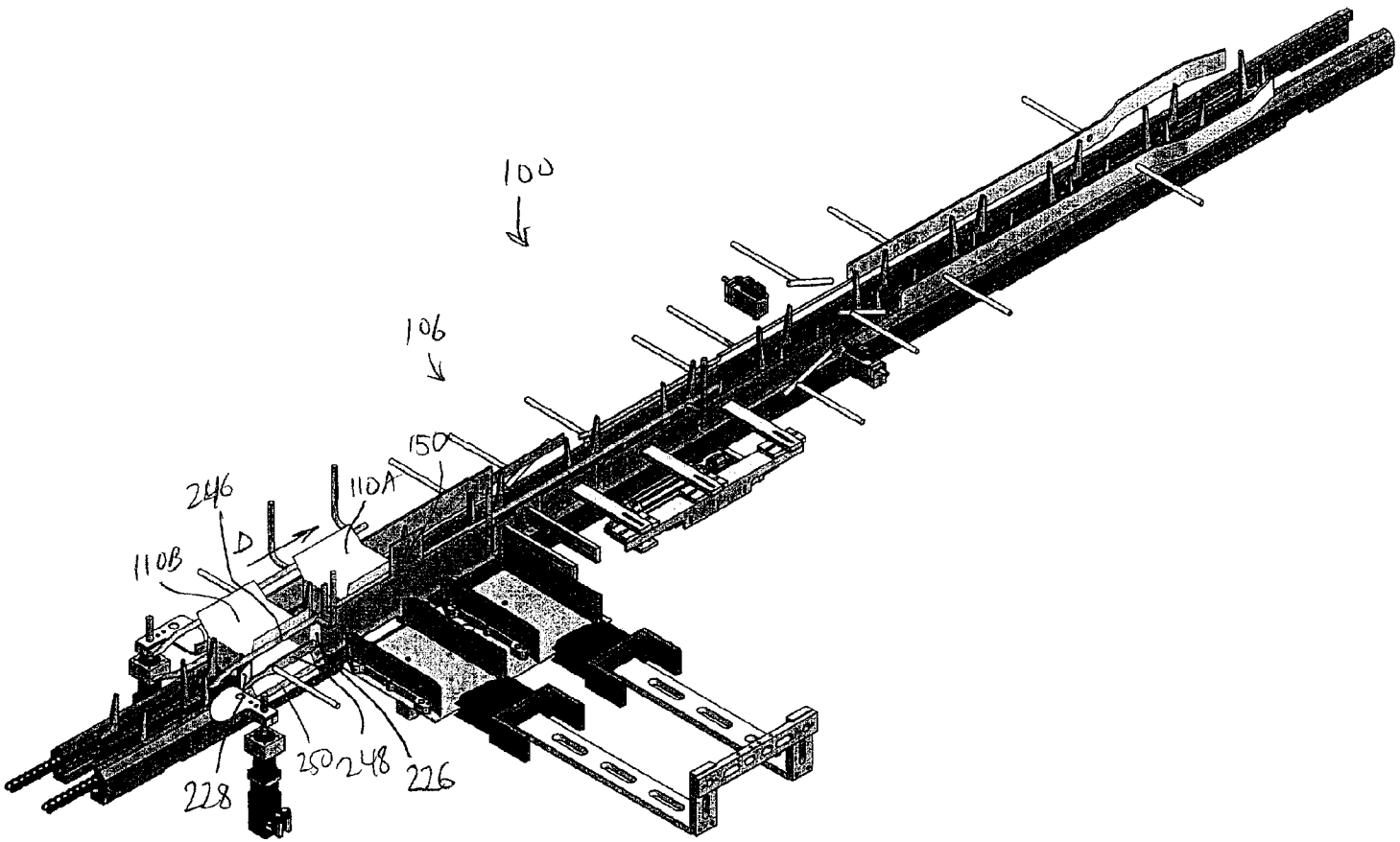
Figure 12:
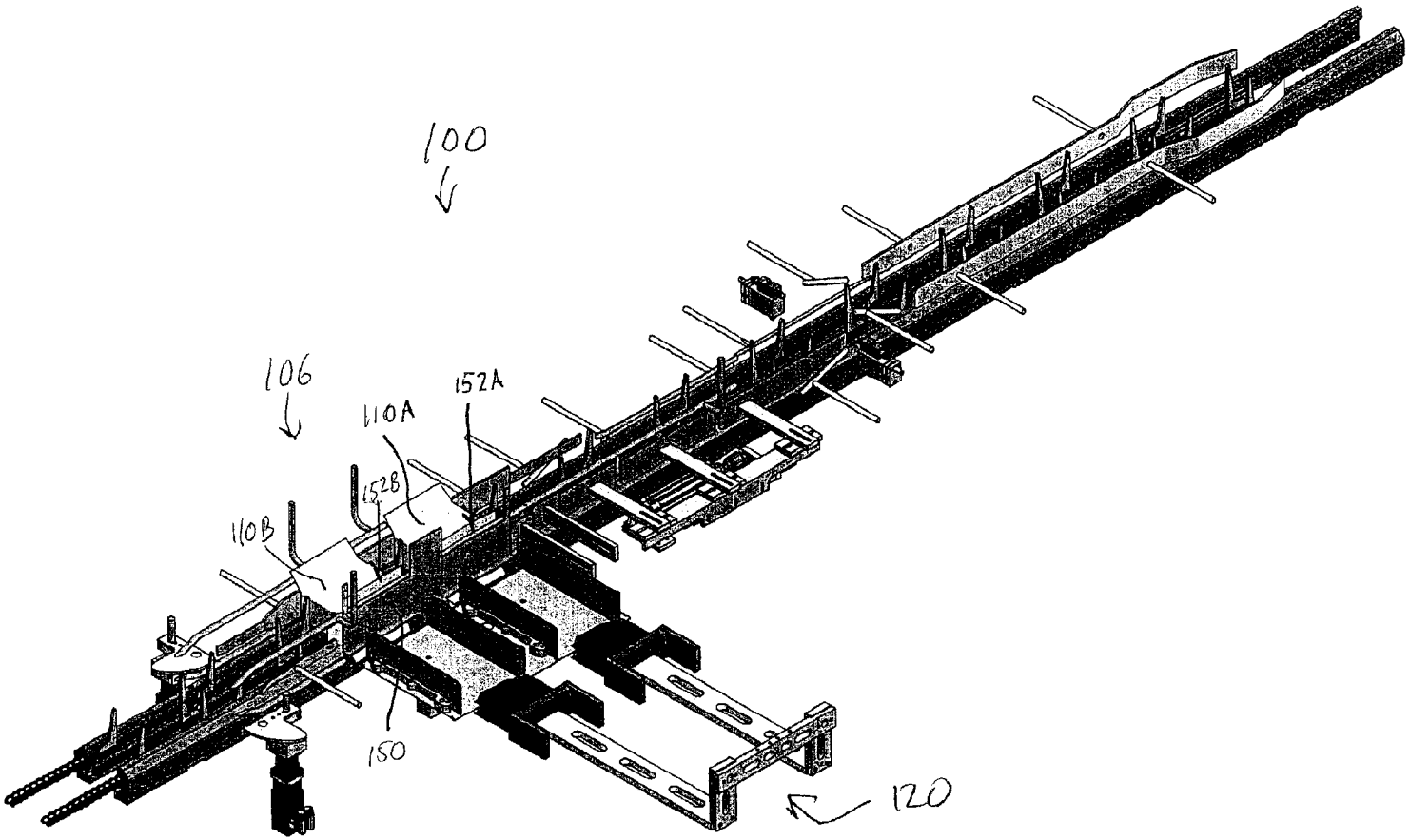
Figure 38:
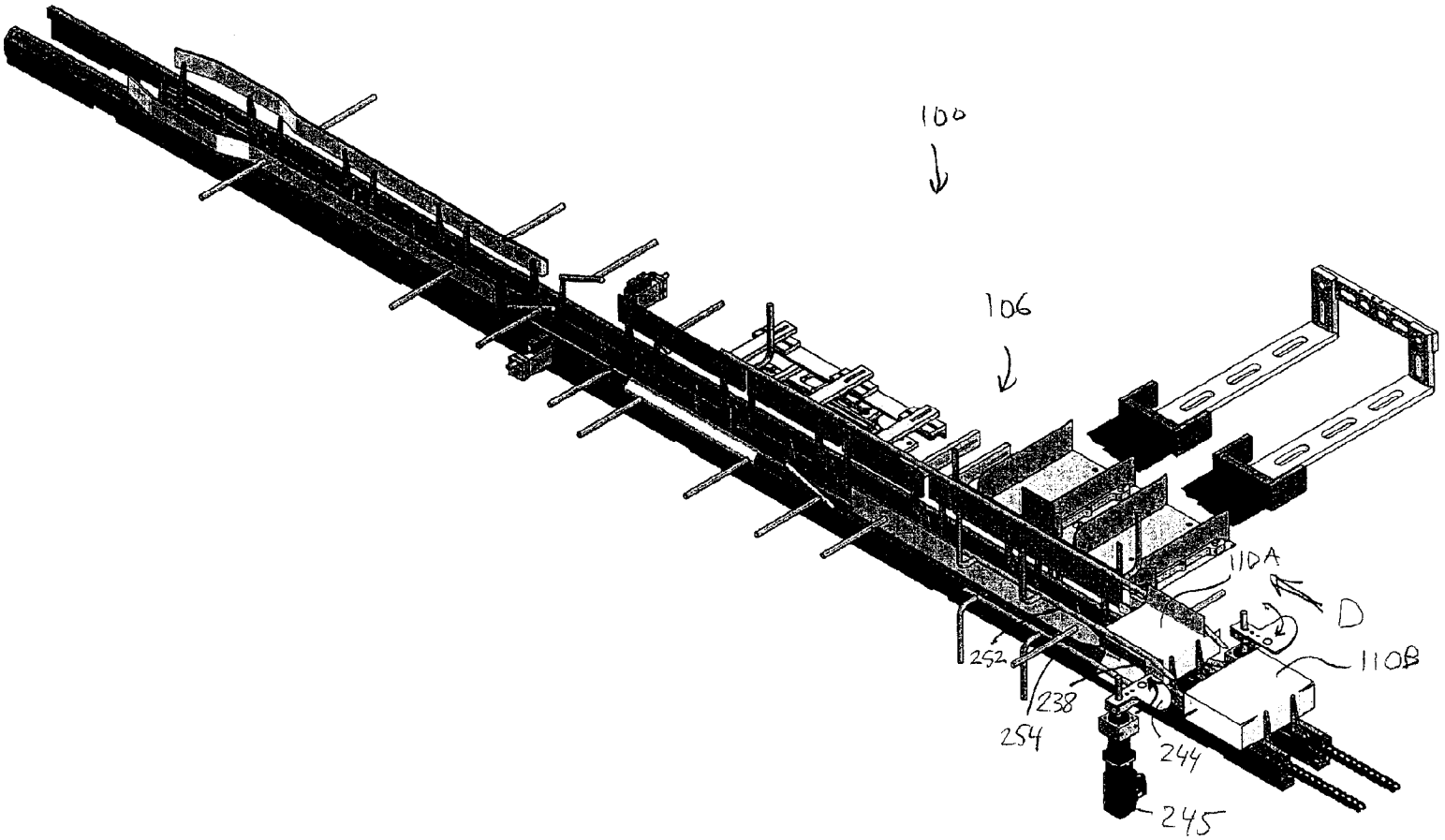
Figure 64:
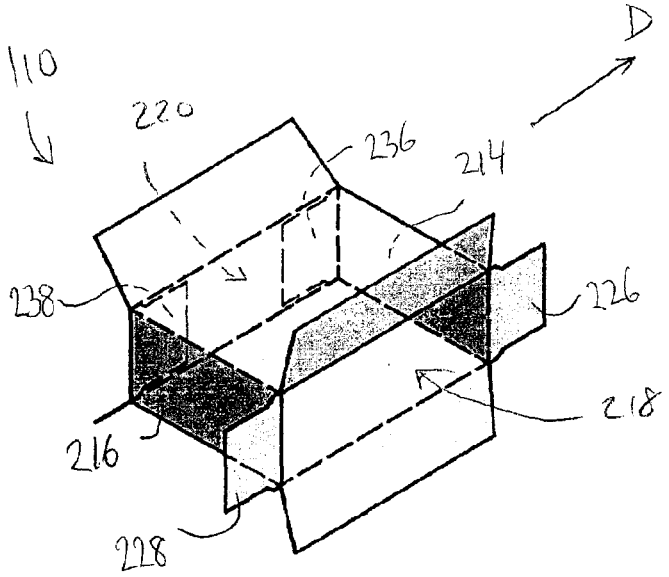

Referring to FIGS. 6 and 38, further downstream conveyance of the carton 110A causes an interior surface of the trailing minor flap 228 on the loading end of carton 110A to contact the end of stationary guide rail 248. As the carton 110A is conveyed further, this contact causes the trailing minor flap 228 to fold open in the upstream direction (see FIG. 7) until it reaches the fully open position shown in FIGS. 8 and 64. The rail 248 keeps the flap 228 open as the flap 228 slides along the rail 248. On the non-loading end 220 of the carton 110A, kicker 244, driven by an actuator 245 such as a servo motor or other suitable actuator, rotates counter-clockwise, with its leading flat edge rotating towards the exterior side of the trailing minor flap 238 of the carton 110A (see FIGS. 5 and 37). When the kicker 244 strikes the exterior side of trailing minor flap 238 (see FIGS. 6 and 38), the flap 238 swings towards the downstream direction to a closed position, in which the flap 238 points towards the (already closed) opposing leading minor flap 236, and in which the flap 238 is at substantially a right angle to the adjacent trailing minor panel 216, as shown in FIG. 64. The kicker may be any kind of kicker (rotary, disk, or otherwise). It will be appreciated that the timing of the kicker strike upon the flap 228 relative to the conveyor speed and the degree of resiliency of the carton material may necessitate precise control of these elements to avoid, e.g., a premature "snap-back" of the minor flap 228 to a transverse orientation and a resultant inadvertent opening of the trailing minor flap 228.

Figure 39:
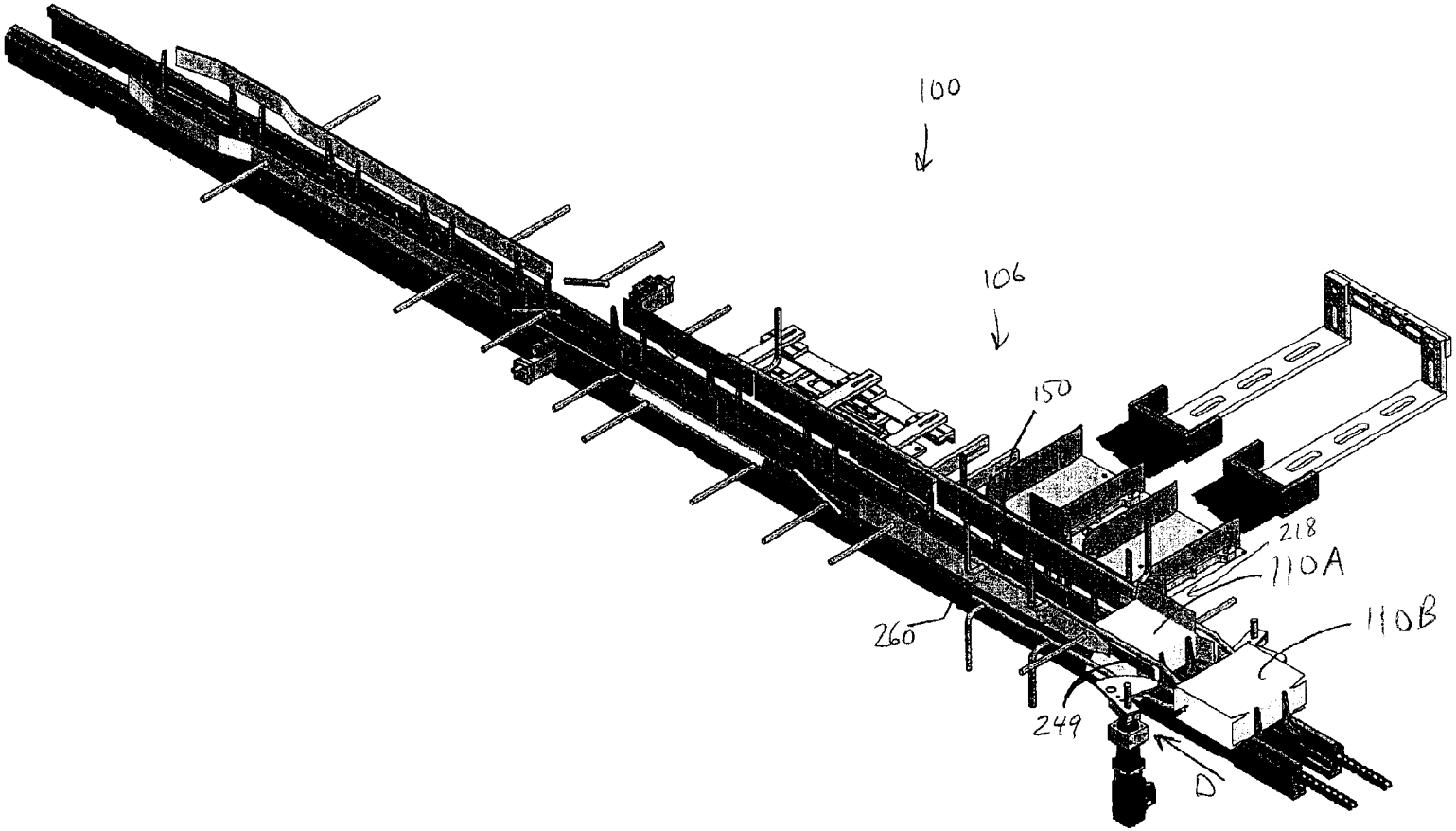
Figure 63:
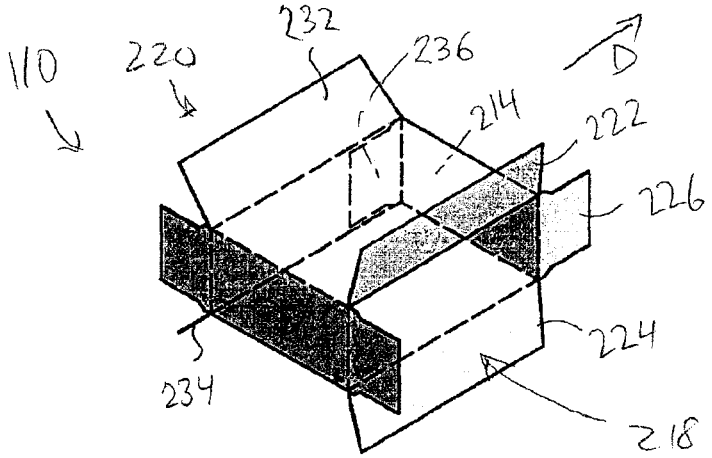

Moreover, due to the continued downstream conveyance of the carton 110A, before the trailing minor flap 238 has an opportunity to return to its original position as shown in FIG. 63 (again, due to material memory for example), the trailing minor flap 238 is caught and held closed, by the same stationary guide rail 249 (FIG. 4) that closed the leading minor flap 236, as the carton 110A continues to be conveyed downstream (see FIG. 39).

The resulting configuration of the carton 110A at this stage is as shown in FIG. 64. This is referred to as the "loading configuration" of the carton.

Figure 40:
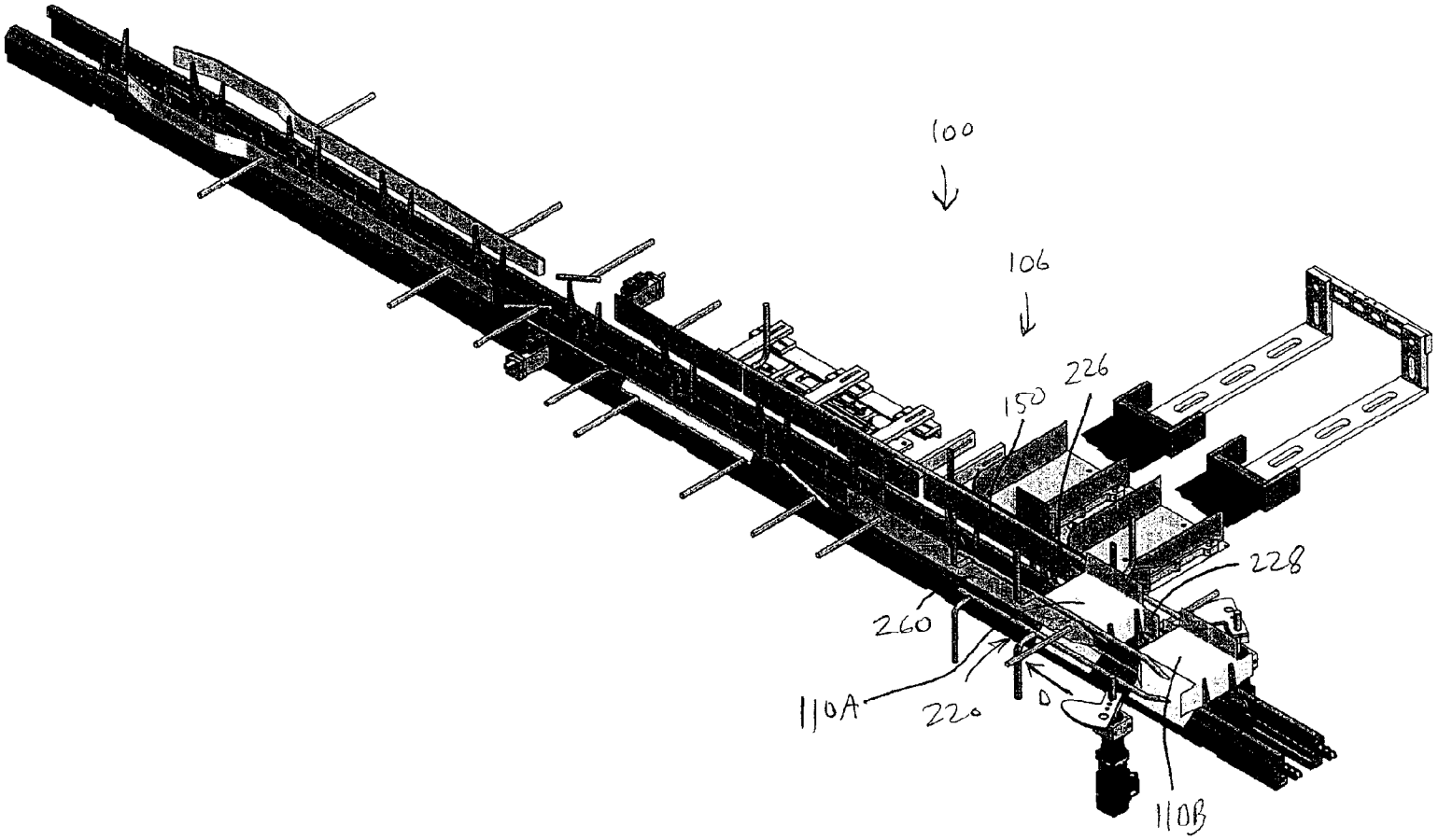
Figure 41:
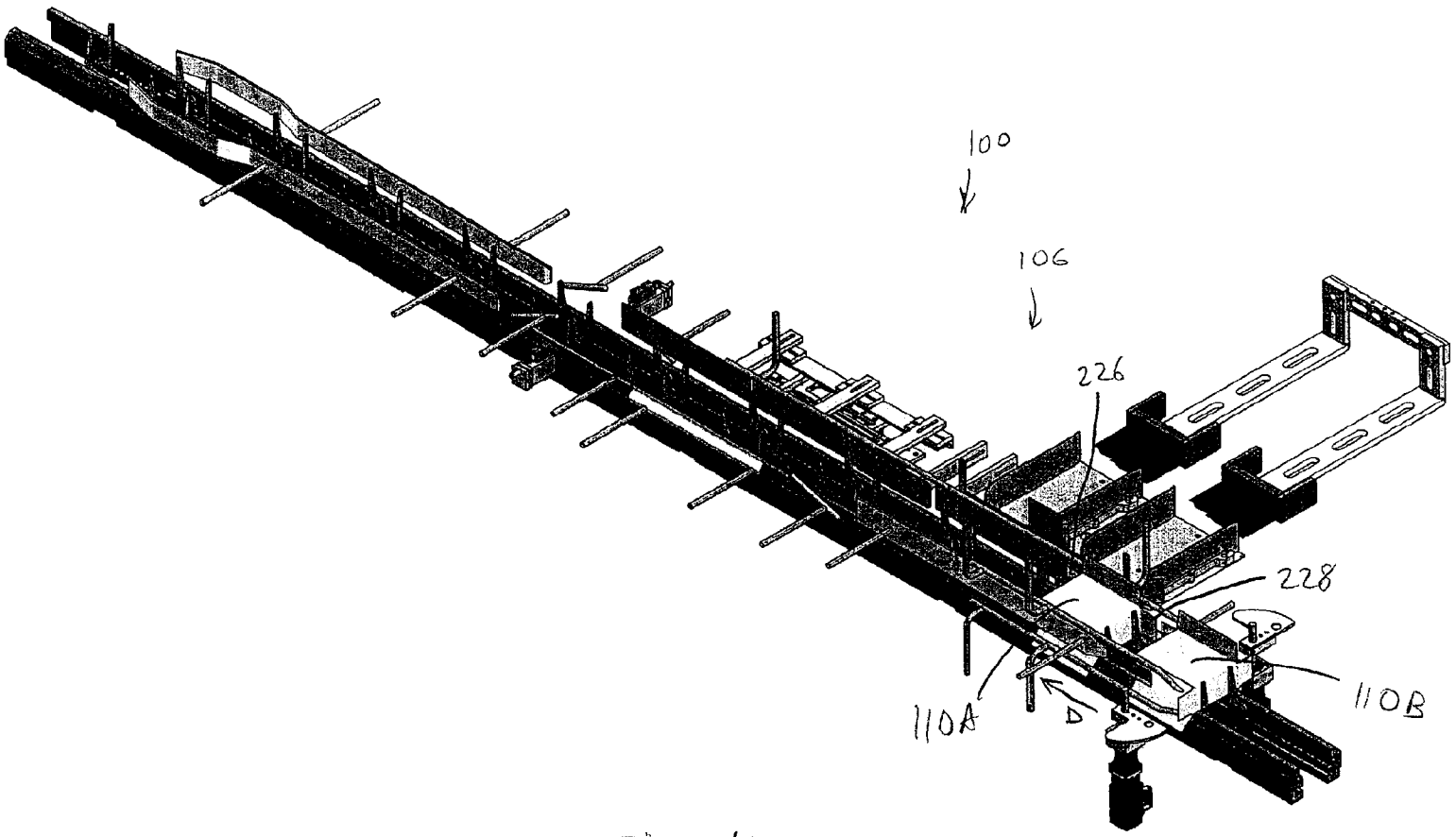
Figure 42:
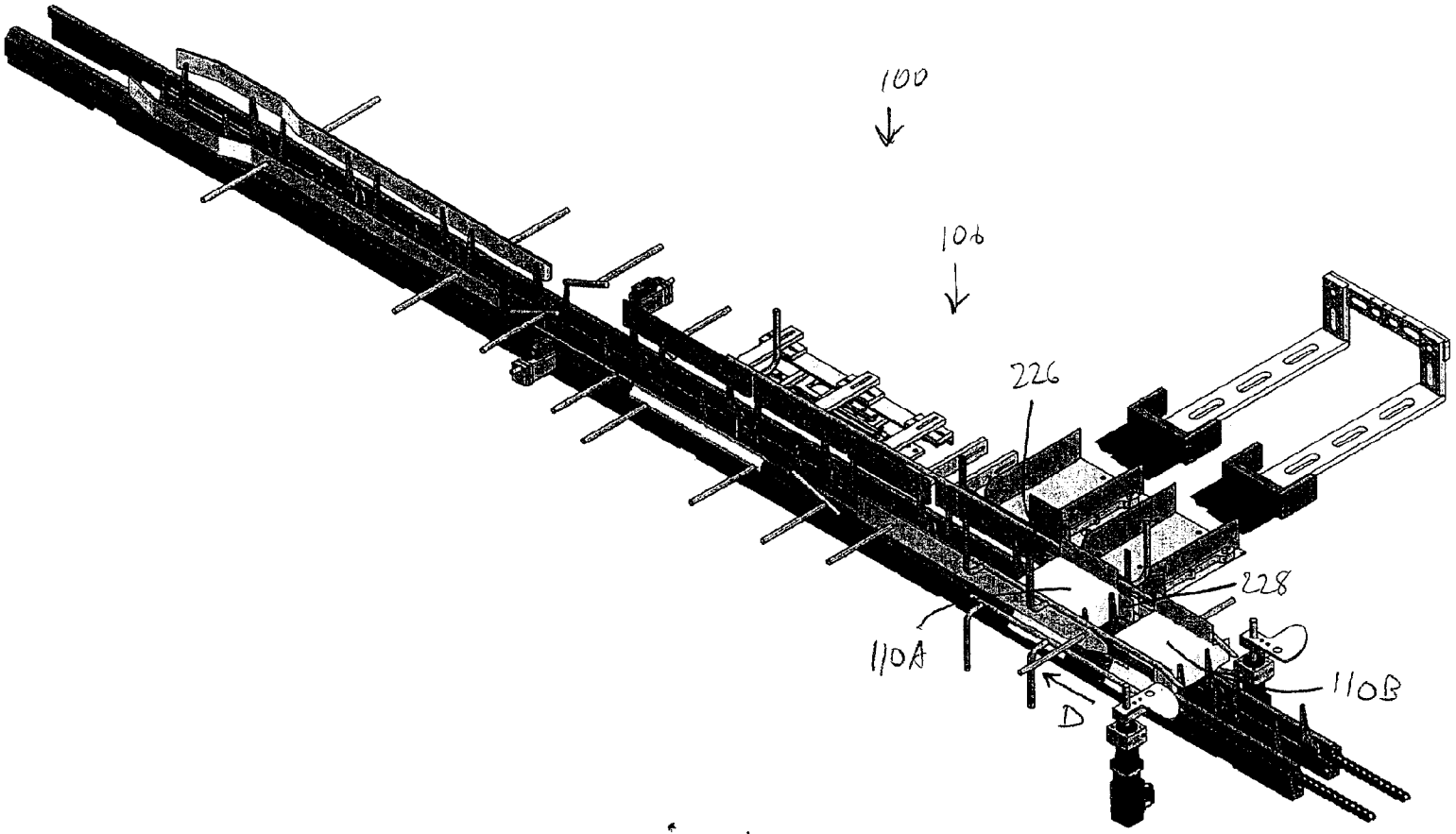
Figure 43:
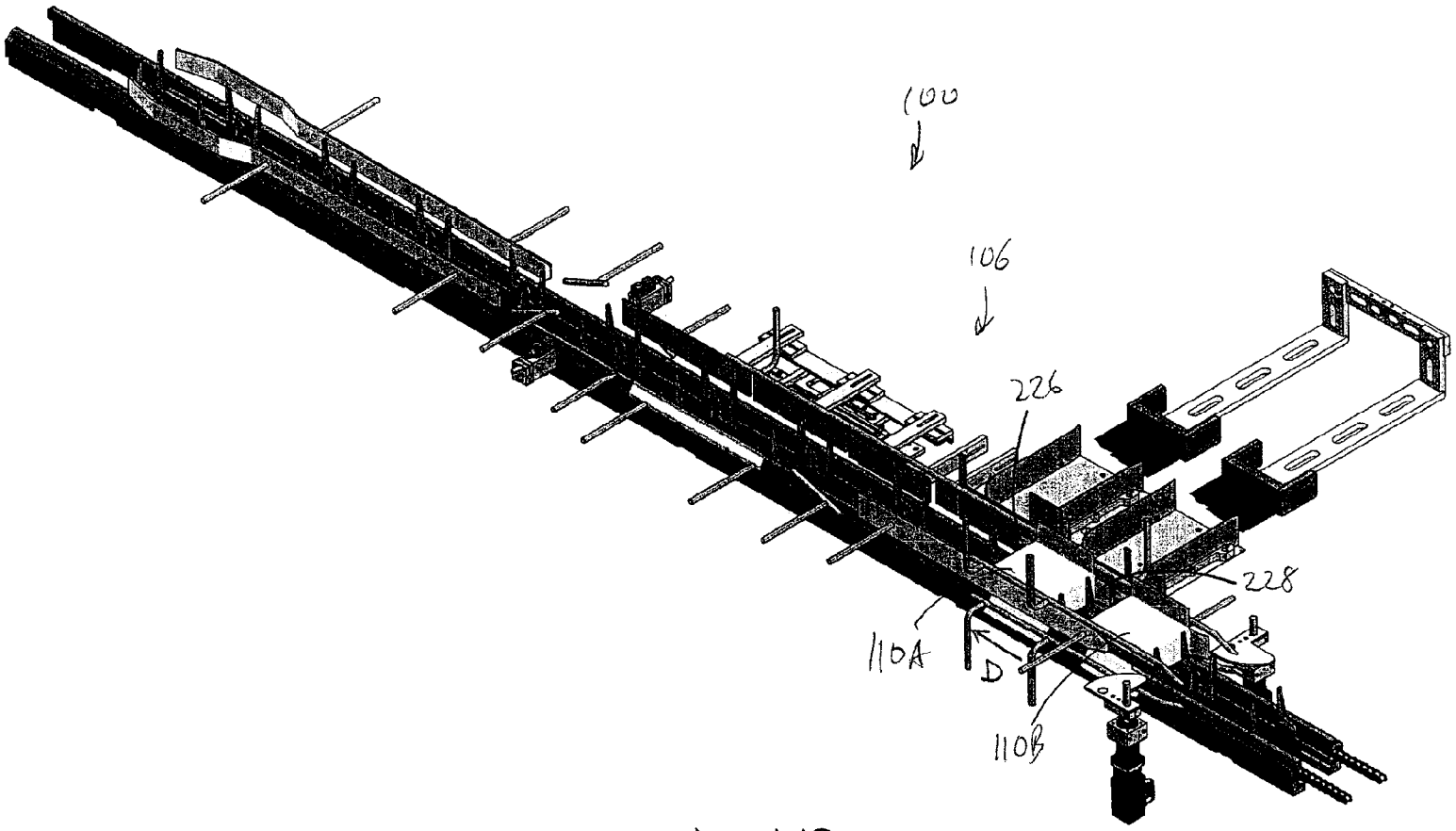

Referring to FIG. 40, as the carton 110A is conveyed further downstream, the non-loading end 220 of the carton 110A reaches, and is conveyed alongside, a back-up rail 260. The back-up rail 260 holds the leading and trailing minor flaps 236 and 238, on the non-loading end 220 of the carton 110A, in their closed positions, through sliding abutment of the flaps 236 and 238 against the rail 260, as the carton 110A is conveyed towards the product loading station 120 (see FIGS. 39-44). The back-up rail 260 also provides a backing to prevent inadvertent product egress out of the non-loading end 220 of the carton 110A during product loading at the product loading station 120.

Referring again to FIGS. 39-44 as well as to FIGS. 7-12, the loading end 218 of the carton 110B reaches and is conveyed alongside the inwardly-facing side of the reciprocating gate 150, which is in the raised position. Specifically, the carton 110B is conveyed alongside the lower portion 154 of the reciprocating gate 150 (see FIG. 70A). The reciprocating gate 150 holds the leading and trailing minor flaps 226 and 228 on the loading end 218 of the carton 110A in their open positions as the carton 110A is conveyed into the product loading station 120. This is perhaps best seen in FIGS. 39-44.

Figure 44:
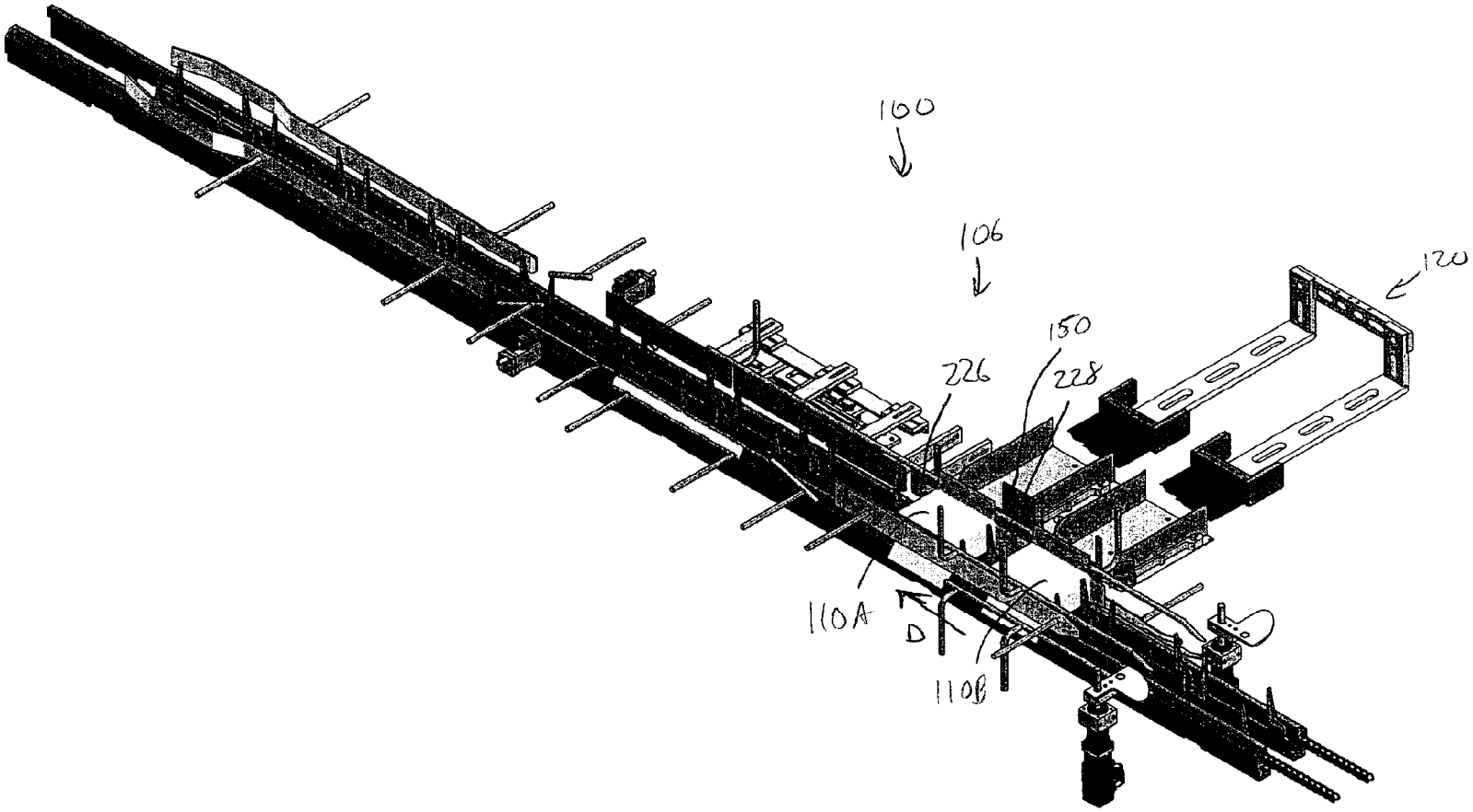

When the carton 110A has been conveyed into the product loading station 120 to the position shown in FIG. 44, the carton conveyor 114 suspends its downstream movement, i.e. downstream conveyance pauses. This pause may be referred to as a dwell period or a stationary index. In the present embodiment, the dwell period permits the product 144 to be loaded into the cartons 110 using reciprocating arms 140 that are not configured for synchronized indexing alongside to-be-loaded cartons on conveyor 114 (i.e. the dwell period facilitates loading using arms 140 whose position on the longitudinal axis of the conveyor 114 is stationary). It will be appreciated that alternative embodiments may permit indexed product loading, i.e. loading while cartons are being conveyed. Such systems may not require a dwell period but may involve additional equipment for achieving synchronized motion between the product loading equipment and the carton conveyor.

Referring back to FIGS. 3-14 and 38-44, it can be seen that a second carton 110B is placed on the carton conveyor 114, in the adjacent slot 112 immediately upstream of the slot 112 in which the first carton 110A was placed. Carton 110B is indexed just behind carton 110A on the conveyor 114, and is manipulated in the same fashion as carton 110A, described above. In the result, the carton 110B achieves the same loading configuration as carton 110A (see FIG. 64). Thus, at the commencement of the dwell period, two cartons 110A and 110B are situated in the product loading station 120, with an open loading end 218 of each carton 110A and 110B being vertically aligned with a respective open area 152A and 152B in the gate 150 (see FIGS. 12 and 44).

Figure 13:
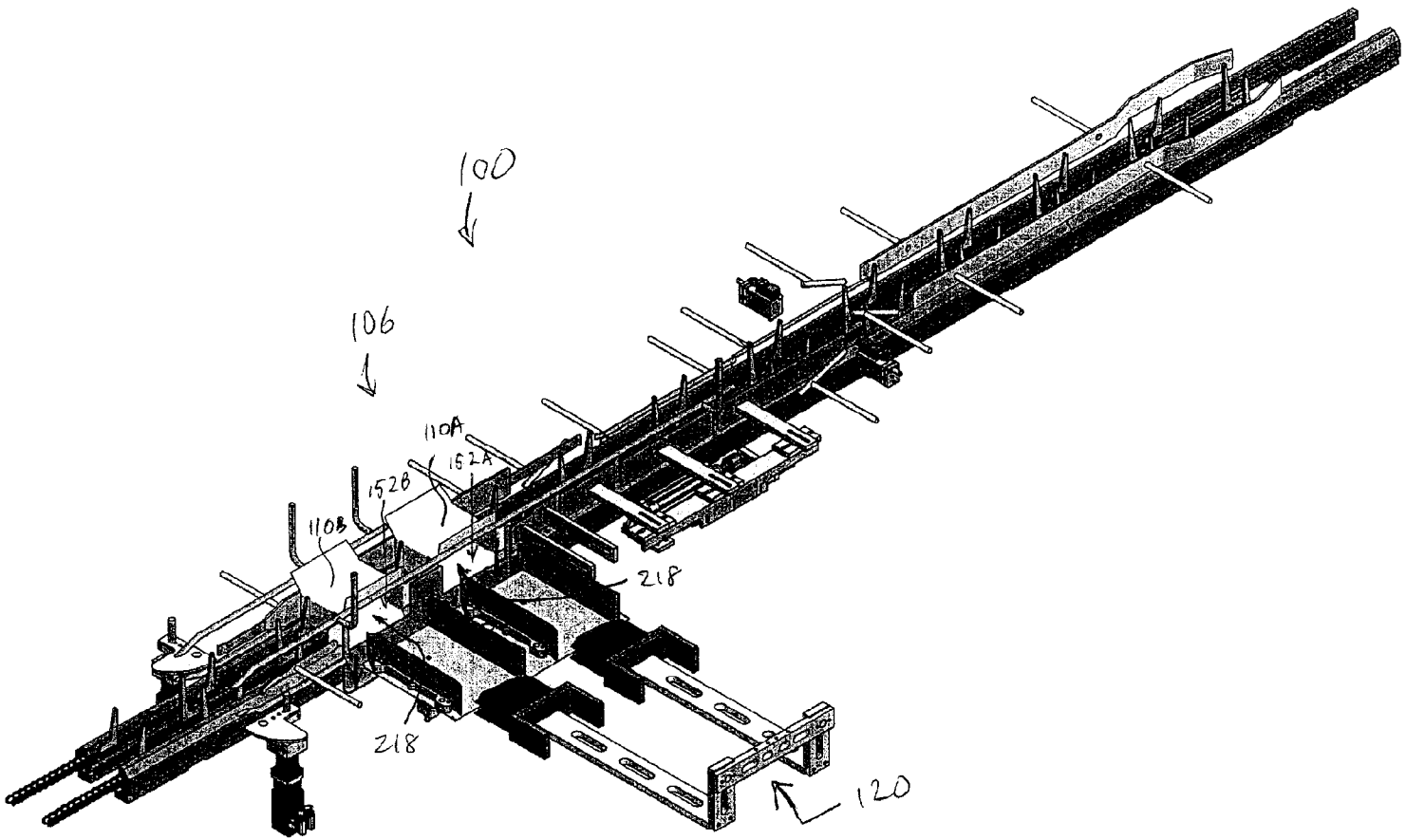
Figure 45:
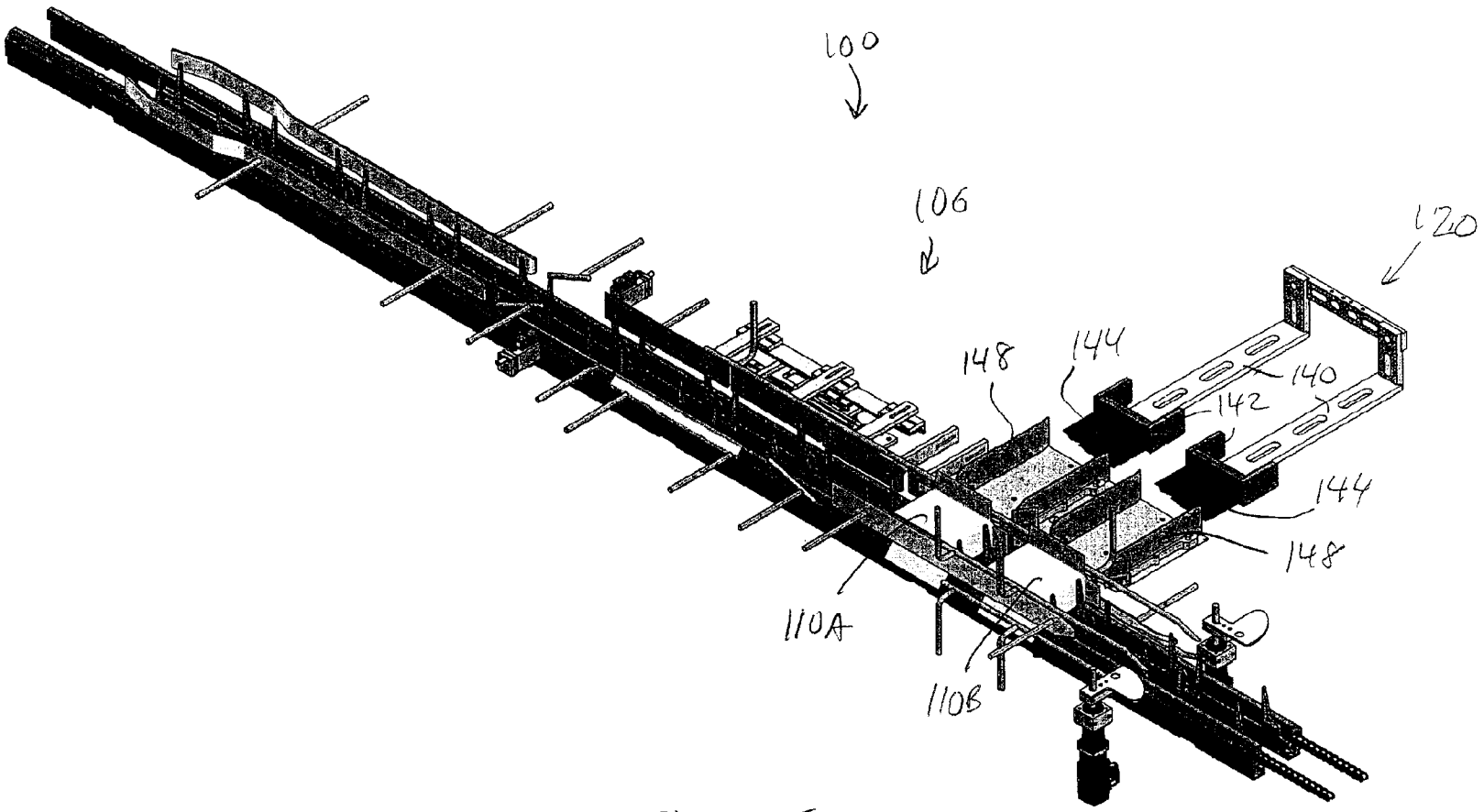
Figure 46:
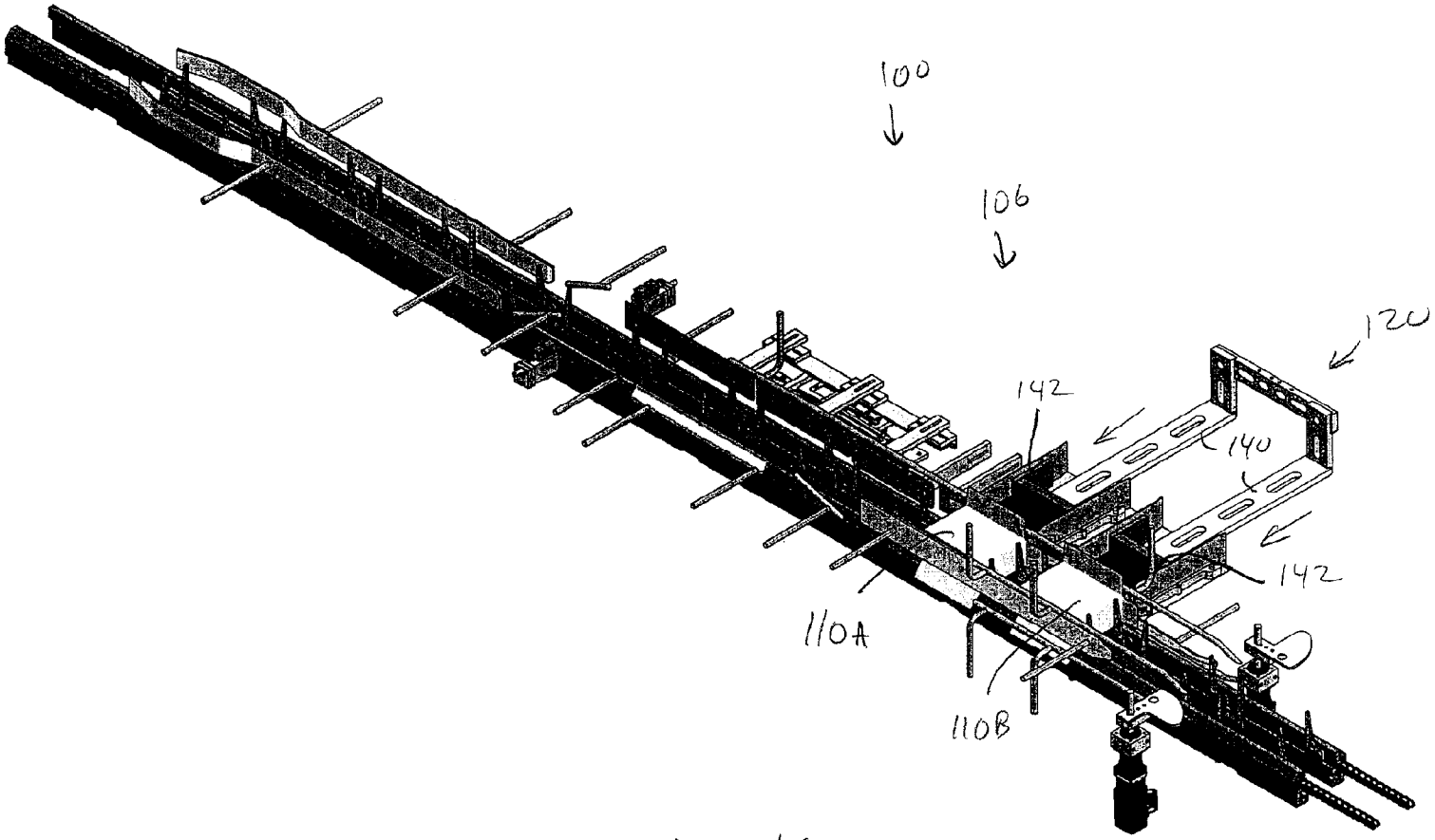
Figure 47:
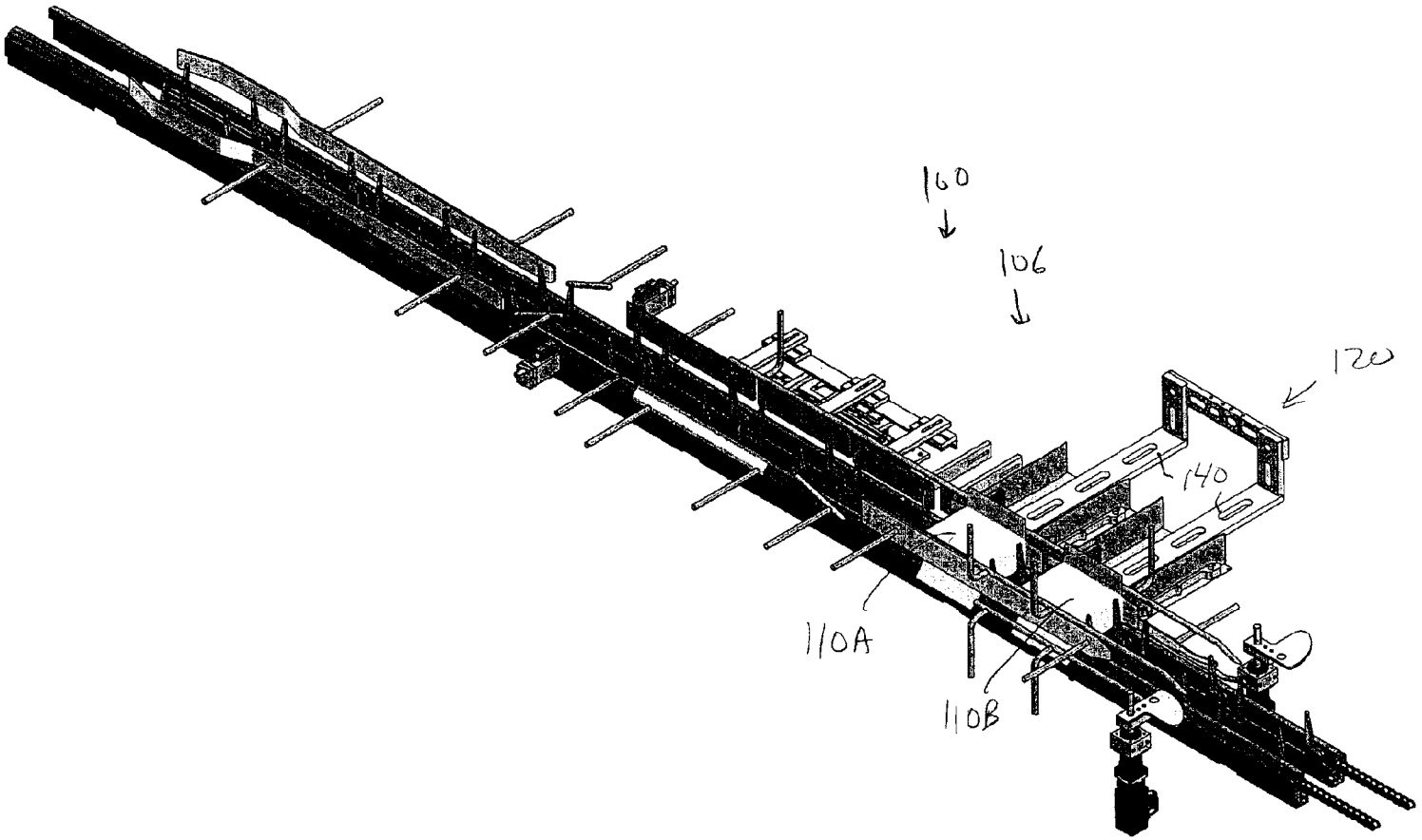

At this stage, the reciprocating gate 150 is lowered (see FIGS. 13 and 45). In particular, the lower portion 154 of the gate 150 is retracted below a level of the carton conveyor 114, with the upper portion 156 of the gate 150 being correspondingly lowered until the open areas 152A and 152B in the gate 150 align with the open loading ends 218 of the respective cartons 110A and 110B (e.g. in the position shown in FIG. 70B). In this position, the upper portion 156 of the gate 150 continues to hold open the minor flaps 111 of the cartons 110 in their open positions, but the open loading ends 218 of the cartons are exposed for product loading by virtue of alignment with open areas 152A and 152B.

The mechanism for moving the reciprocating gate 150 may for example be a pneumatic actuator supplied with pressurized air communicated through electronic solenoid valves for causing a piston arm, to which the reciprocating gate 150 may be attached, to retract and extend. The pneumatic actuator may be supported on part of the support frame.

Figure 16:
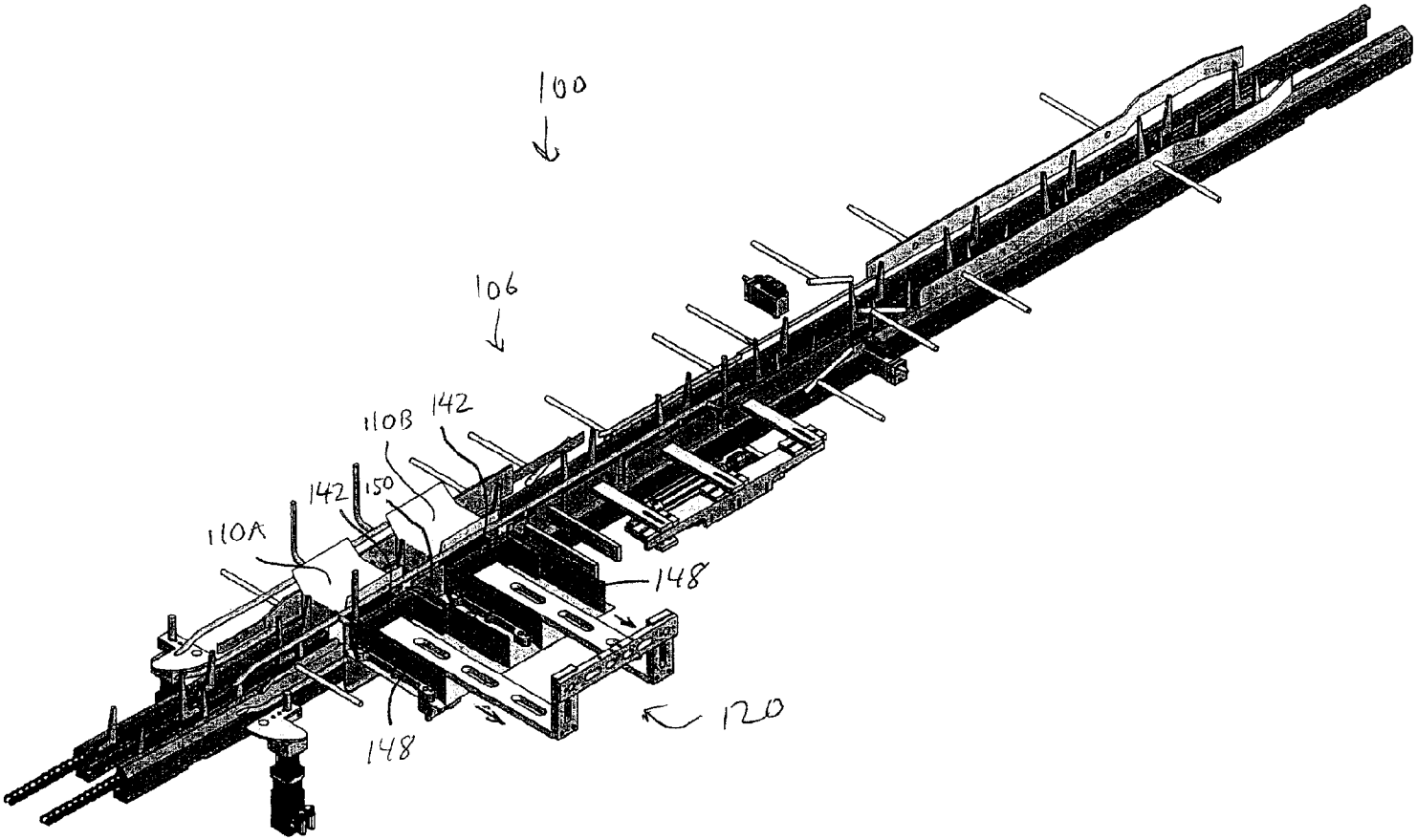
Figure 17:
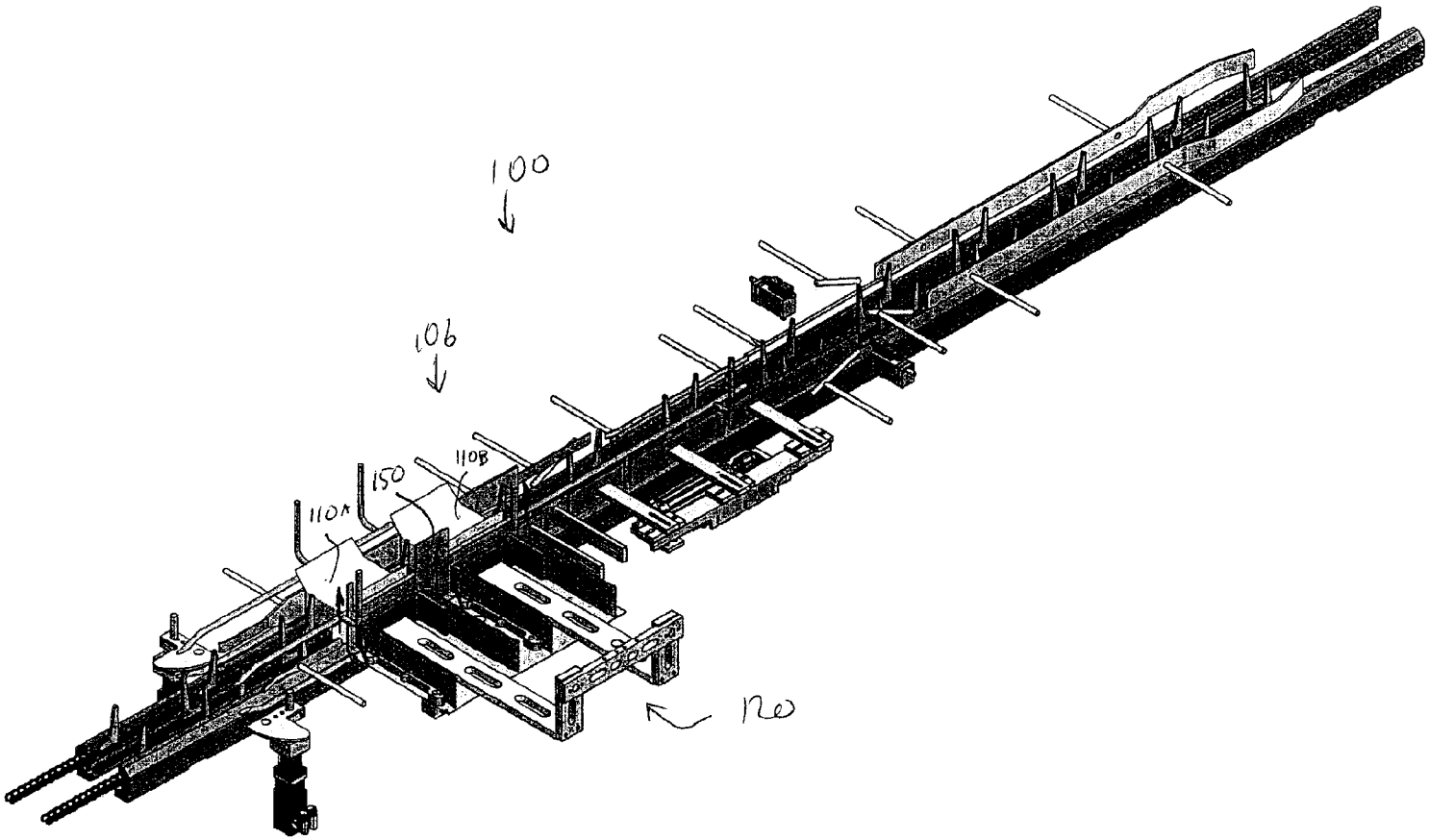
Figure 48:
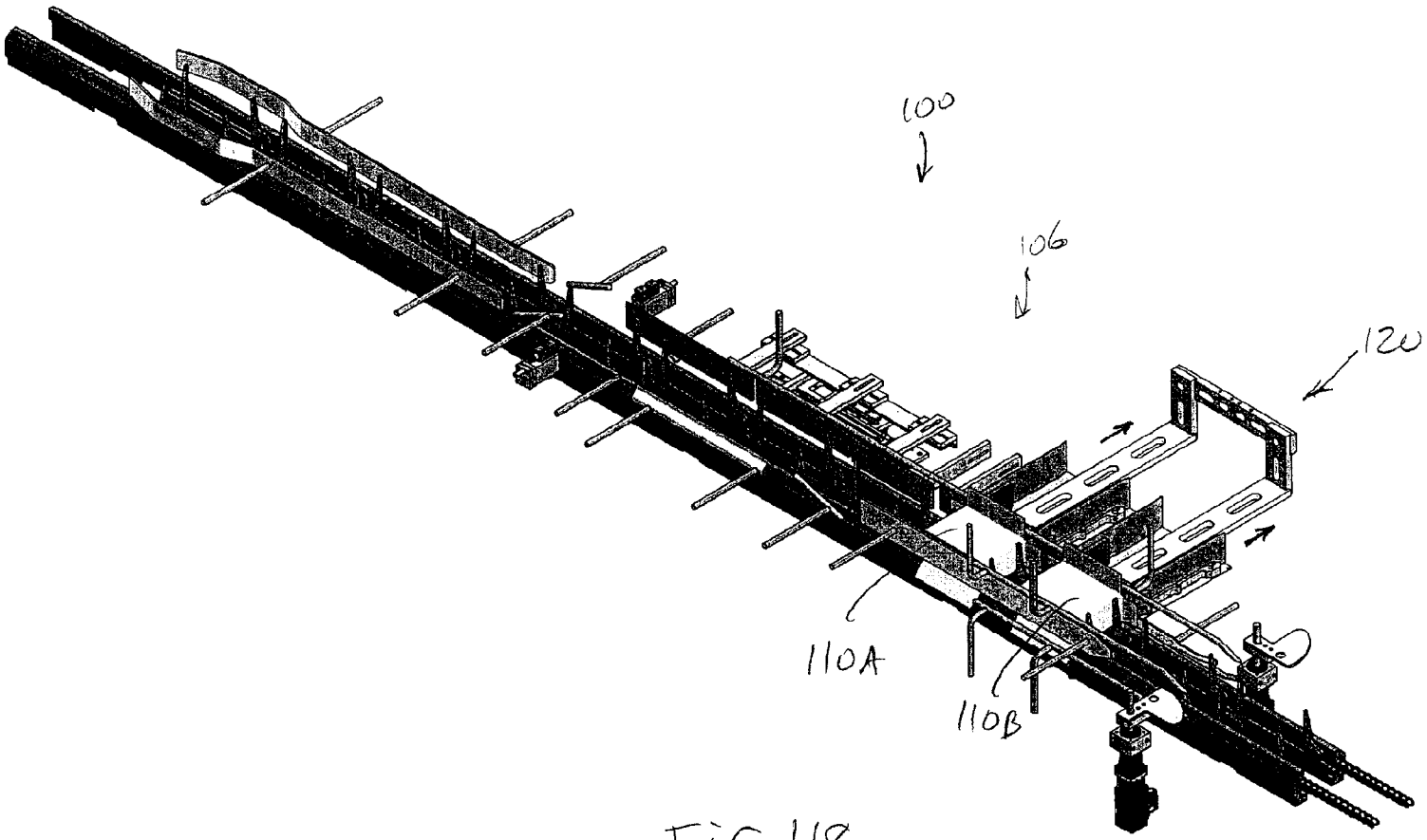
Figure 49:
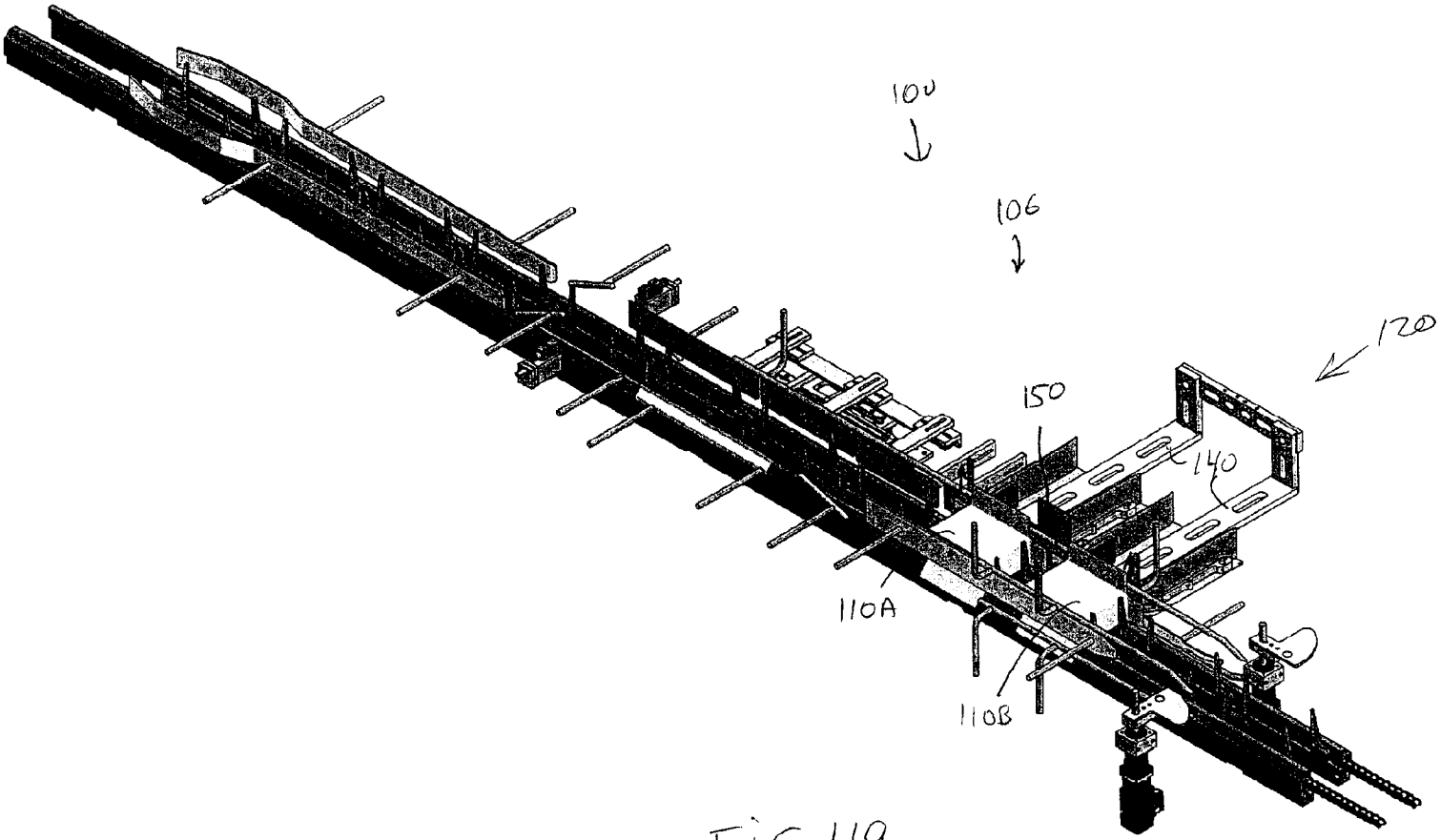

Product loading is illustrated in FIGS. 14-17 and 45-49. With both cartons 110A and 110B being stationary (i.e. with the conveyor 114 in a dwell period) and in their loading configurations (as in FIG. 64), the reciprocating arms 140 begin to move horizontally towards the carton conveyor 114 substantially transversely to the longitudinal axis of carton conveyor 114. The pusher ends 142 push product 144 along product guides and into the open ends 218 of the cartons 110A and 110B, until the product 144 is fully contained within the cartons 110A and 110B (see FIGS. 14, 15 46 and 47). Thereafter, the reciprocating arms 140 are retracted so that the pusher ends 142 are clear of the reciprocating gate 150 (FIGS. 16 and 48). Then the reciprocating gate 150 is raised back to the closed position (FIGS. 17 and 49). The dwell period thus concludes.

Figure 18:
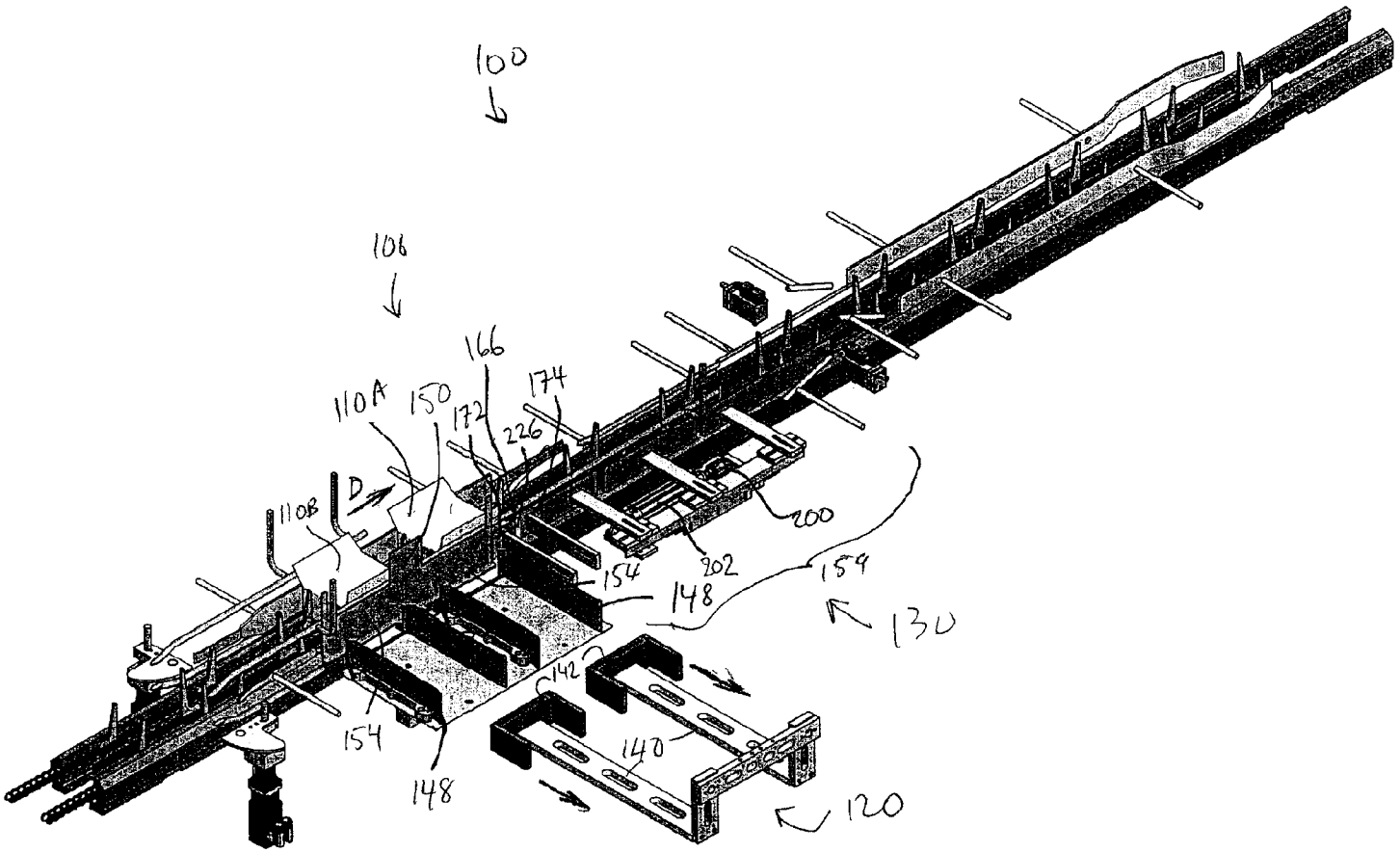
Figure 50:
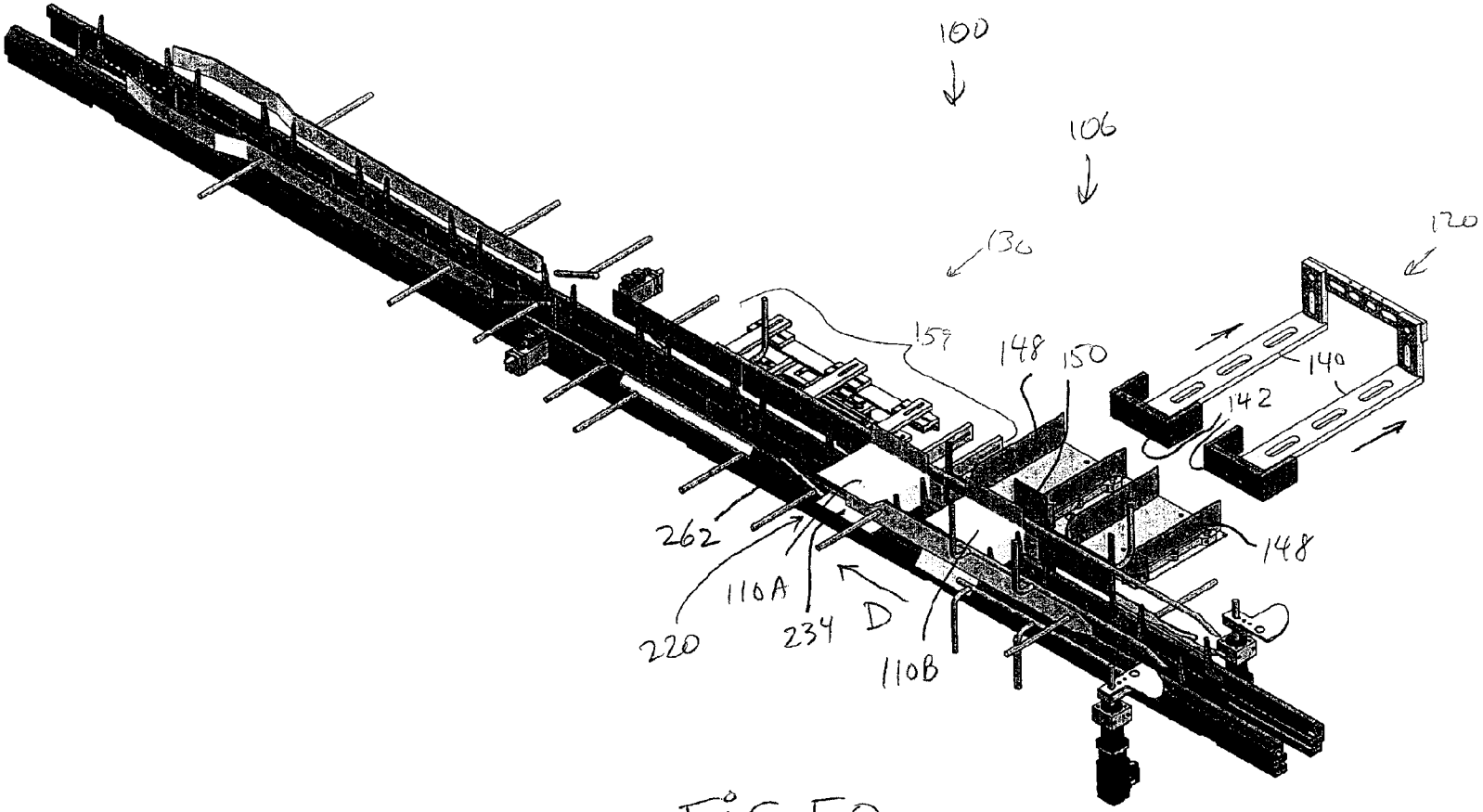
Figure 51:
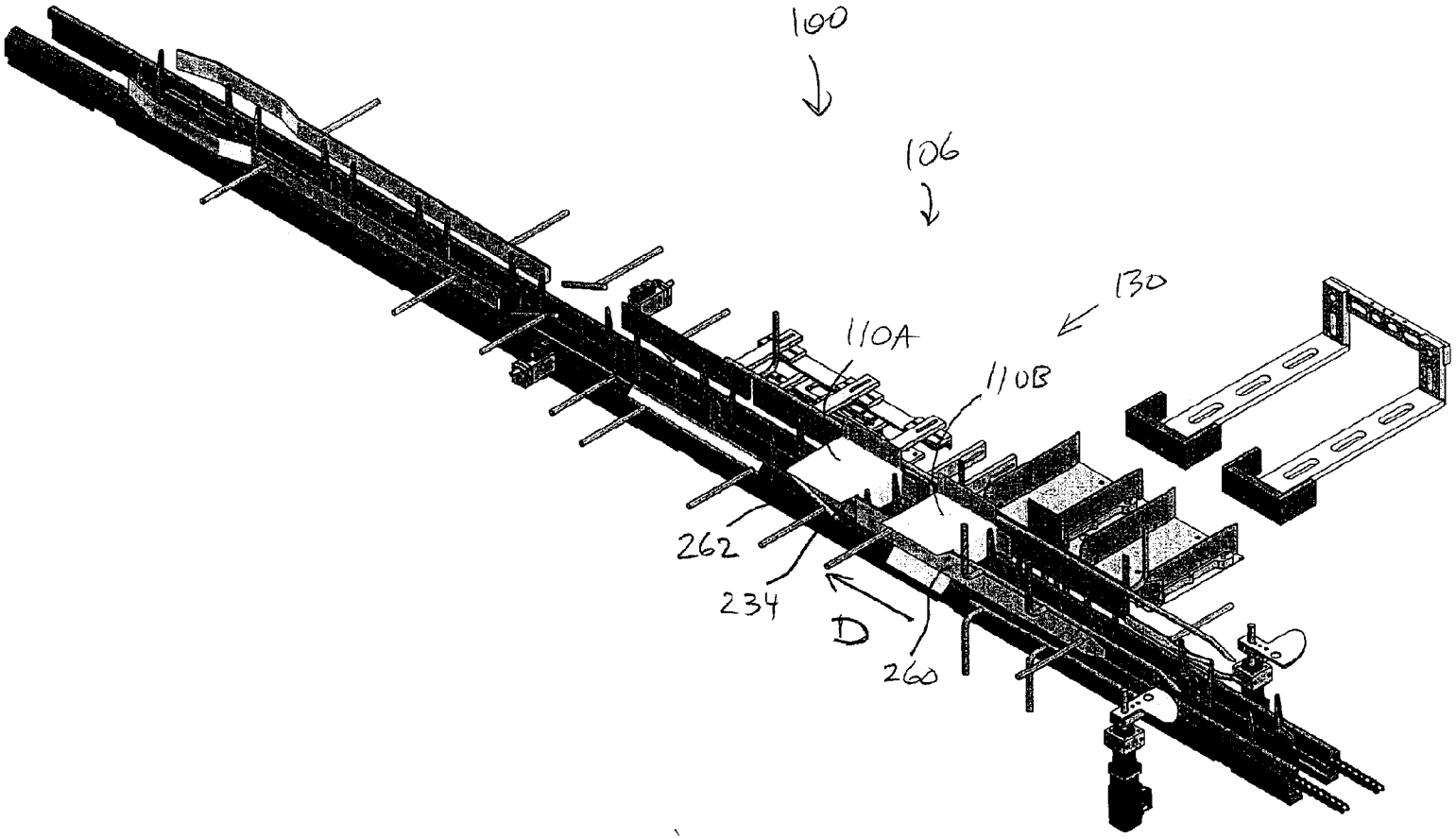

Referring to FIGS. 18 and 50, the carton conveyor 114 resumes downstream indexing (movement) of both cartons 110A and 110B. As the cartons exit the product loading station 120 and enter the minor flap closing station 130, product egress is prevented by the lower portion 154 of the reciprocating gate 150, which acts as a barrier or rail along which the open loading ends 218 of the cartons 110 are conveyed with their minor flaps still in the open position. At this time, reciprocating arms 140 are more fully retracted, out from within the product guides 148, to make room for subsequent reloading of the product guides 148 with additional product 144 for the next cycle.

Figure 19:
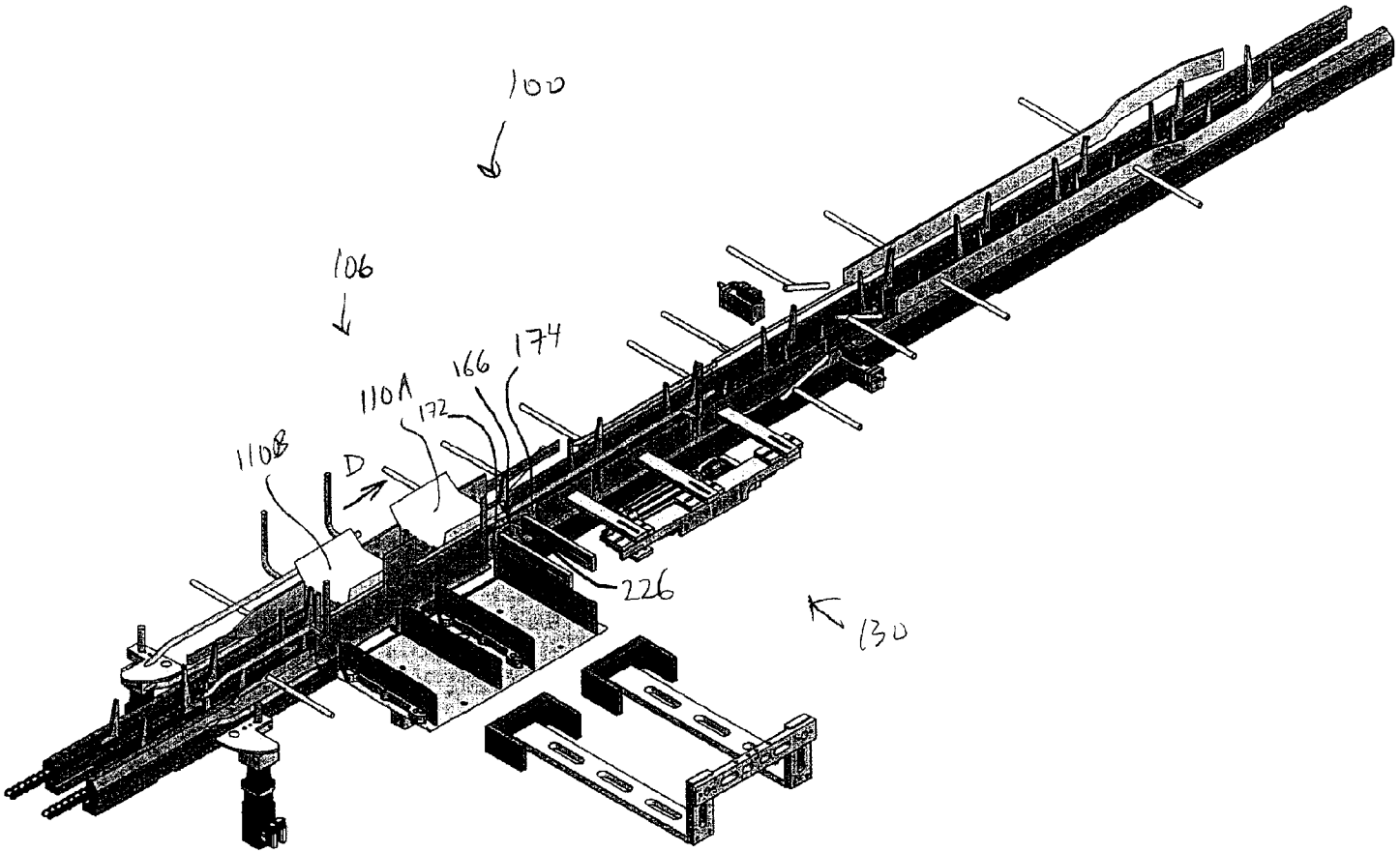
Figure 20:
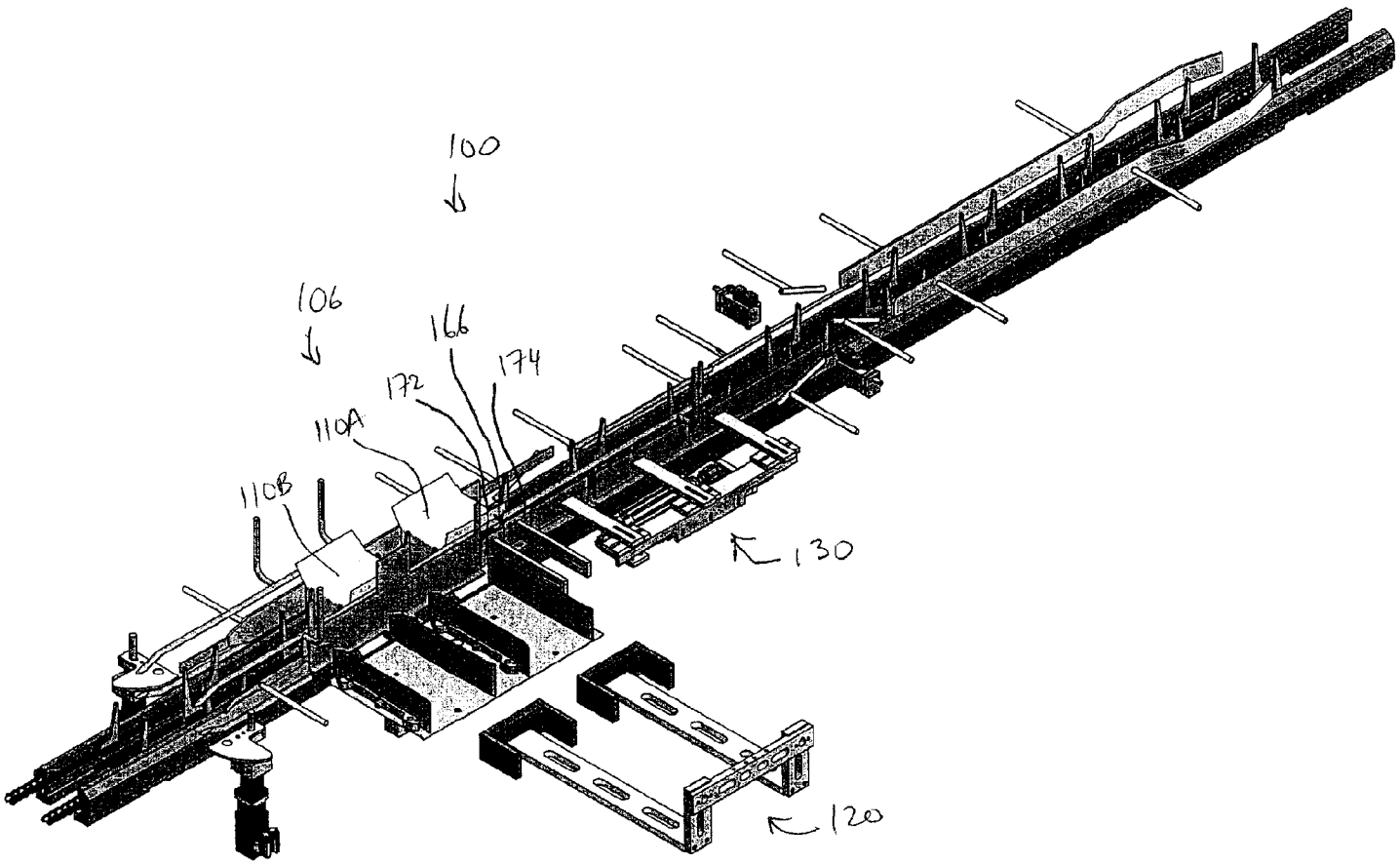
Figure 21:
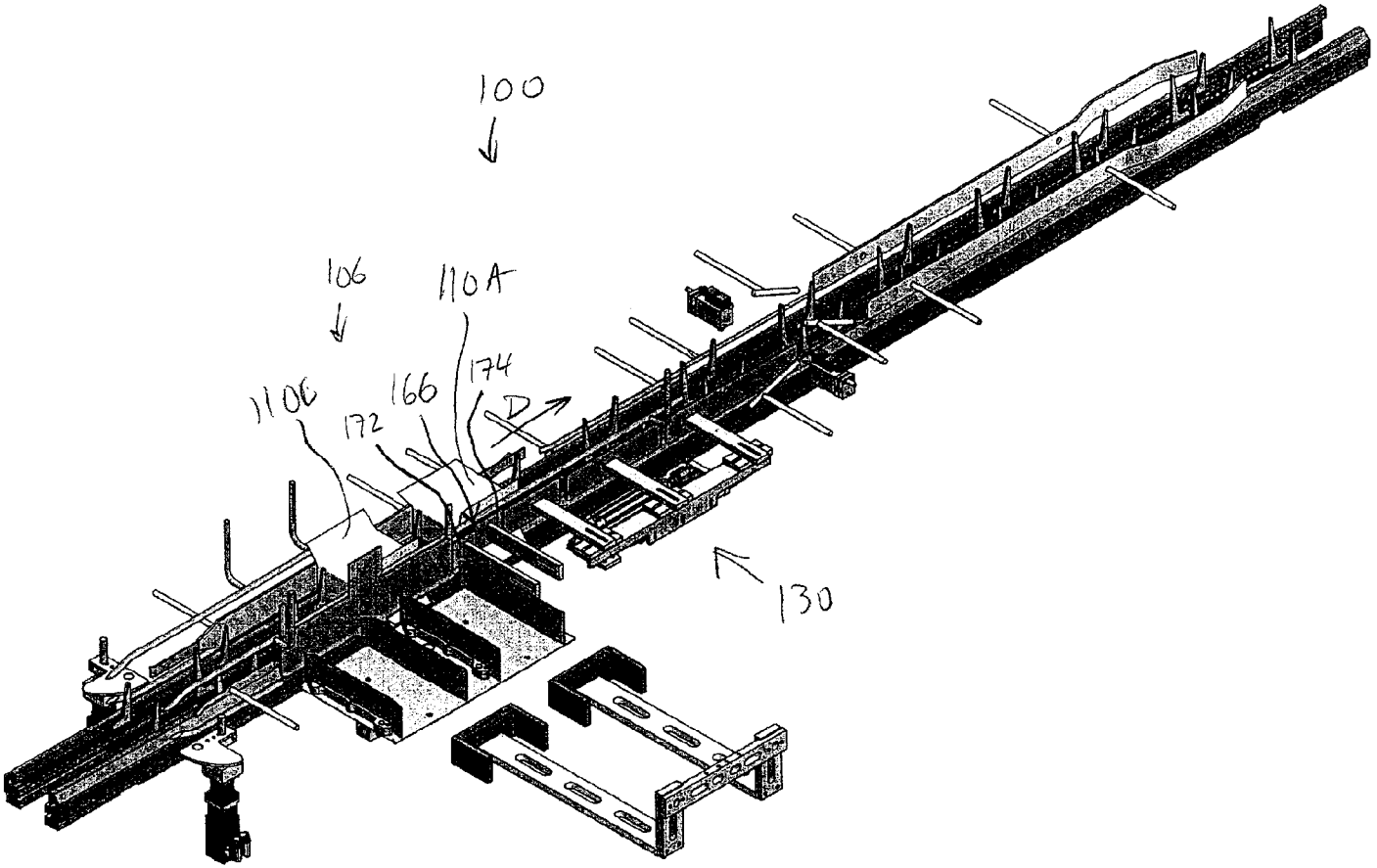
Figure 22:
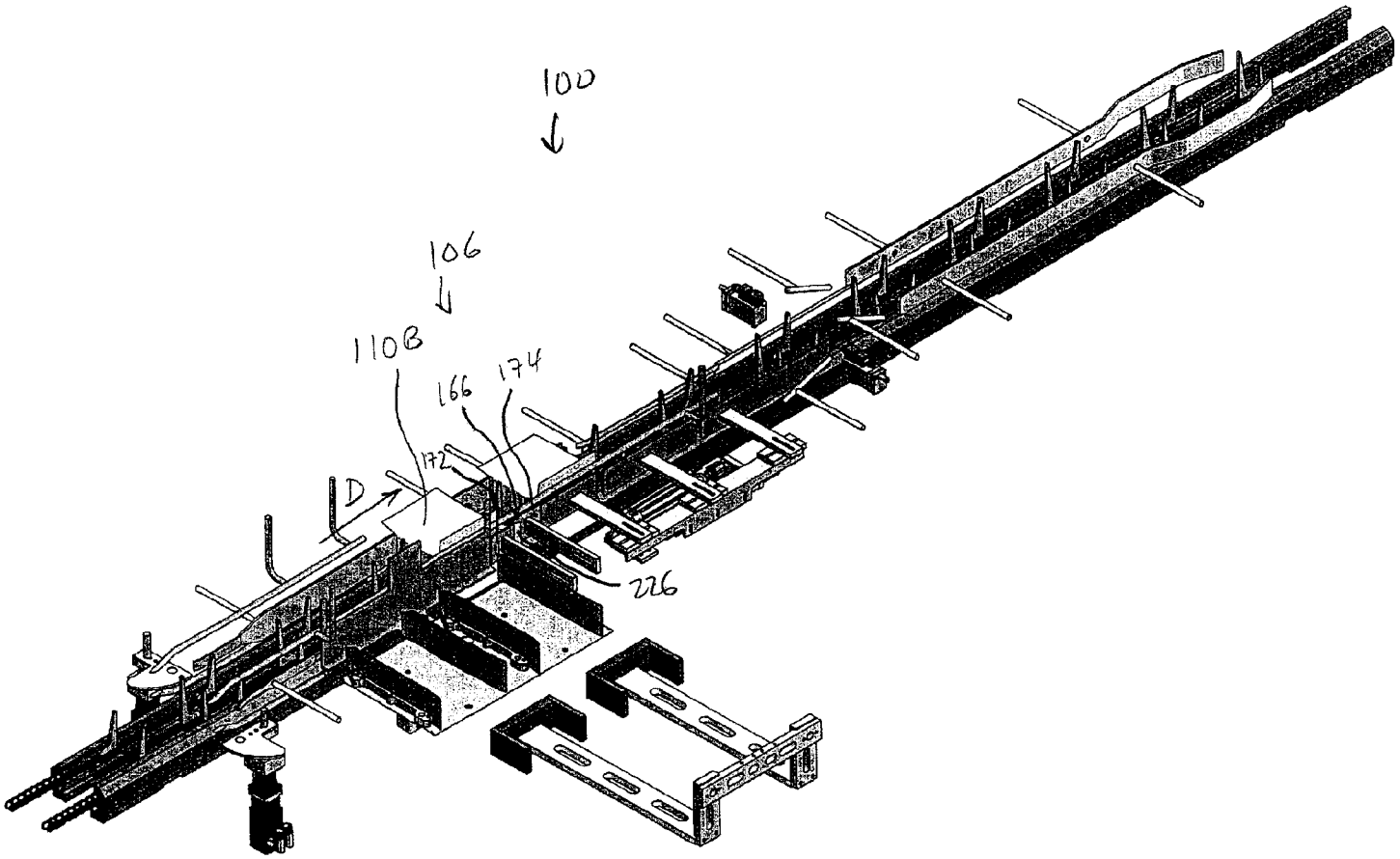
Figure 23:
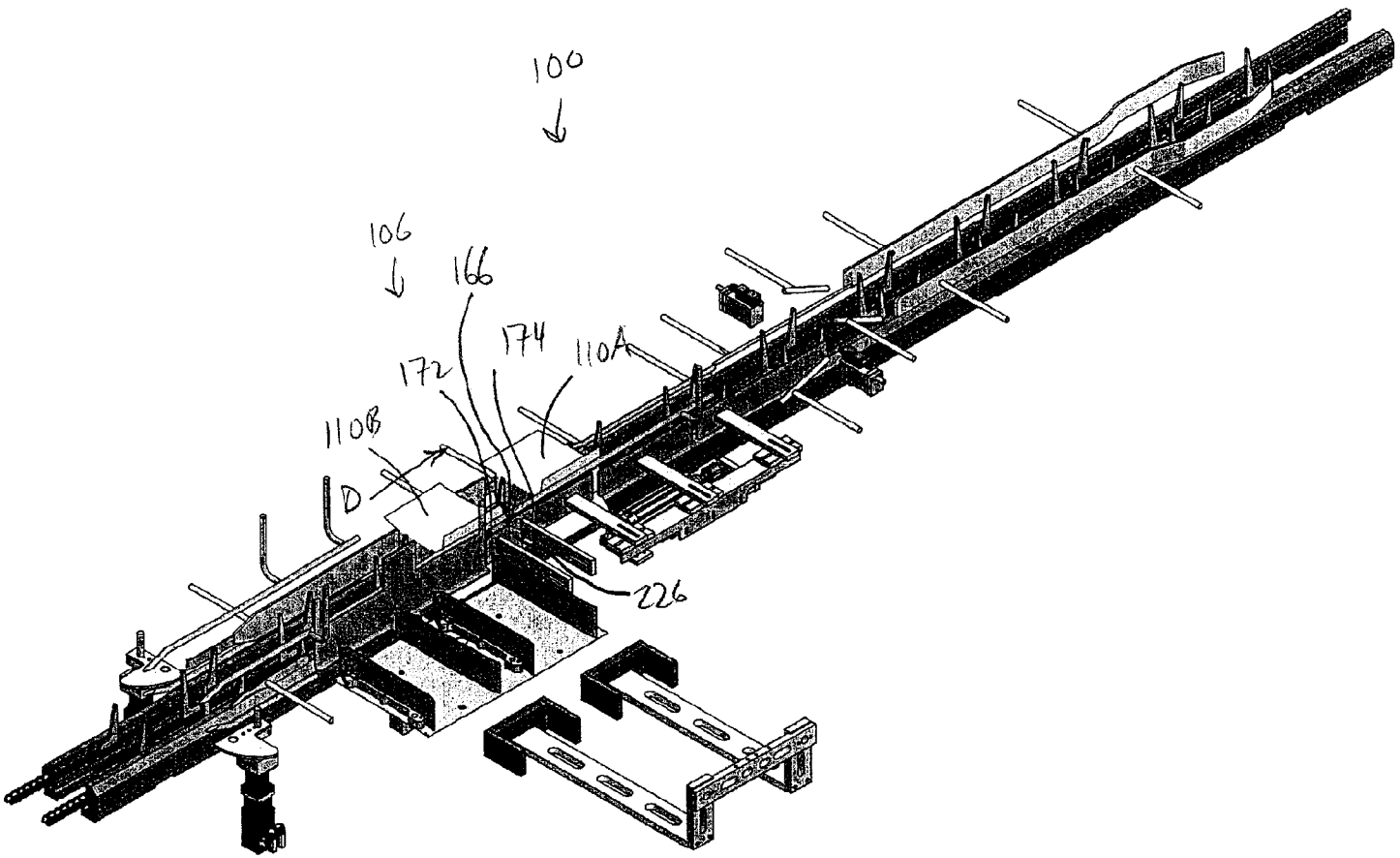
Figure 24:
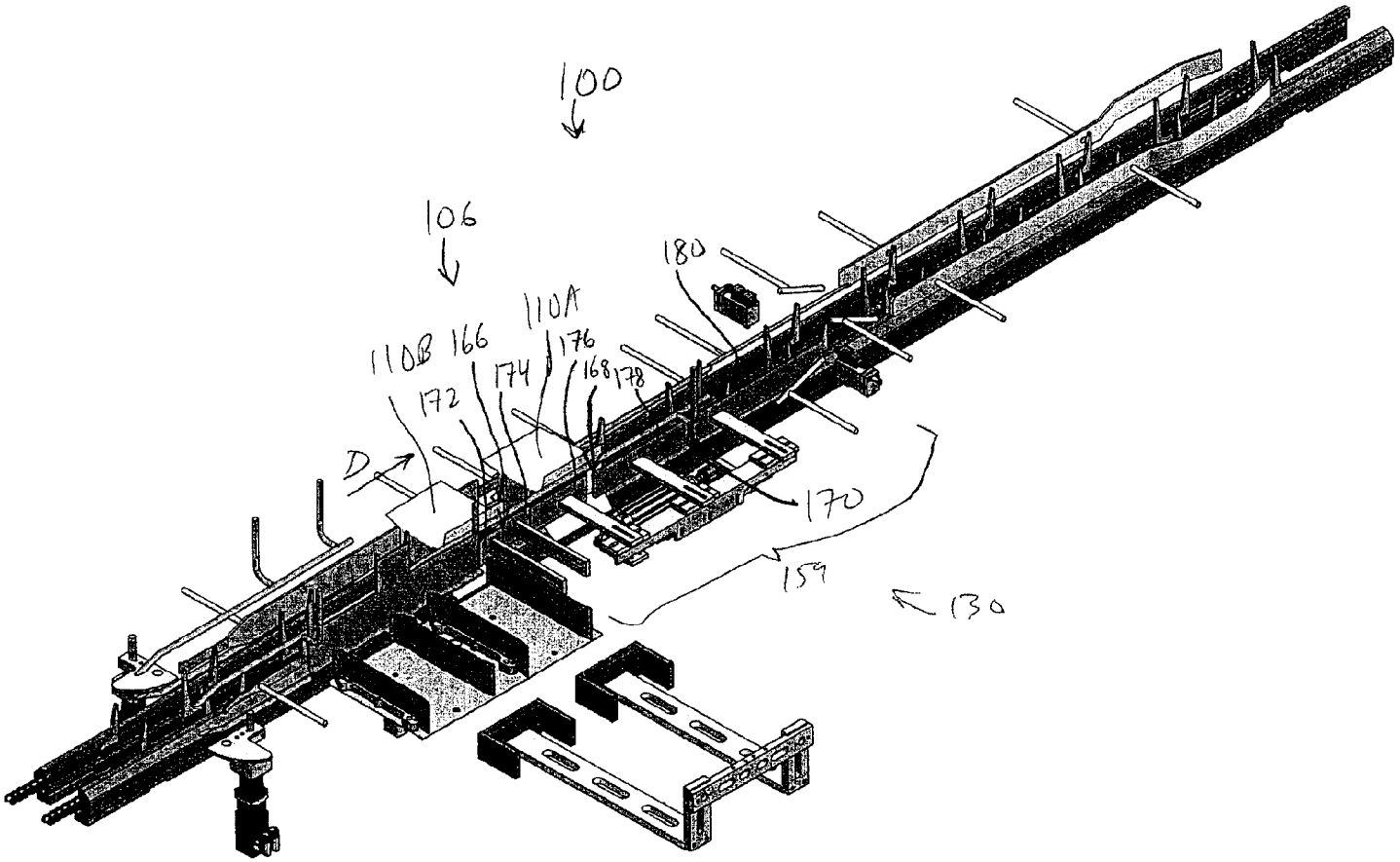

Closure of the leading minor flap 226 of the first carton 110A by the minor flap closing device 159 in the upstream-most portion of the minor flap closing station 130 is illustrated in FIGS. 18-20, with additional reference to FIG. 60. It will be appreciated that, in FIG. 18-20, the reciprocating rail 164 is positioned at or near a limit of its upstream extent of travel, i.e. not with piston arm 200 extended in the downstream direction as shown in FIG. 60, but rather with piston arm 200 largely or completely retracted within cylinder 202.

Figure 71:
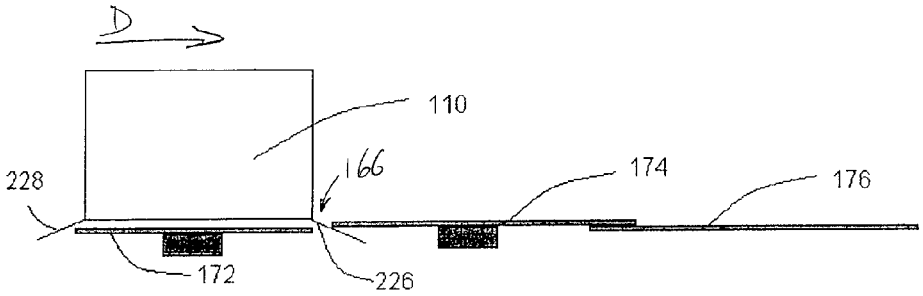
FIGS. 71 to 74 are top plan views of the closure of a leading minor flap of a carton using a portion of the box closing apparatus of FIG. 60.
Figure 72:
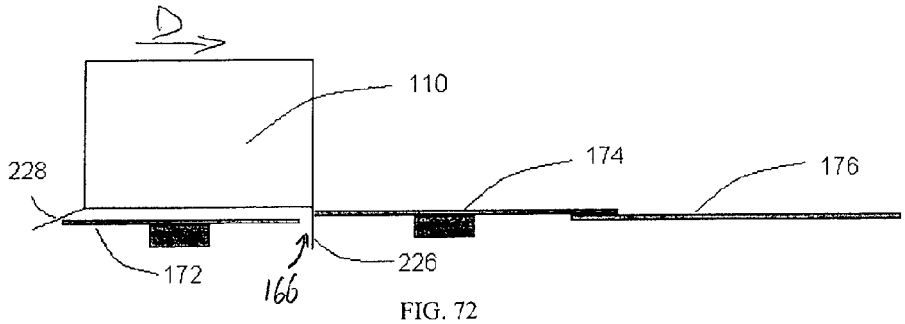

Referring to FIG. 18, as the leading carton 110A approaches the leading minor flap closing slot 166, a distal tip of the downstream-pointing leading minor flap 226 of carton 110A, which is sliding along an interior surface of rail portion 172 in the open position, is thrust through slot 166. Put another way, the distal tip of the leading minor flap 226 is received or "caught" by the slot 166 and protrudes partially through the slot 166. This is illustrated in top plan view in FIG. 71 (it is noted that FIG. 71 is not necessarily to scale, nor are FIGS. 72-78, described below, necessarily to scale). As earlier noted, the ability of slot 166 to catch the leading minor flap 226 in this way may be facilitated, at least in part, by the fact that the slot 166 is slightly upstream-facing in the present embodiment (i.e. there is an offset A1 between rail portions 172 and 174, as shown in FIG. 60). This offset is not necessarily present in all embodiments. Additionally the natural resiliency (memory) of the material may also cause the minor flap 226 to be pushed into and through slots 166. It should be noted that in some embodiments an external force may be applied to the interior surface of the minor flap 226 when it is proximate slot 166. This could be done for example by directing a flow of gas (e.g. air) from a nozzle against the surface of the minor flap, to push the minor flaps 228 against the rail sections 178 and 180 respectively. A flow of pressurized air emitted from the nozzle may be controlled by suitable valves that are in communication with controller 108.

Figure 73:
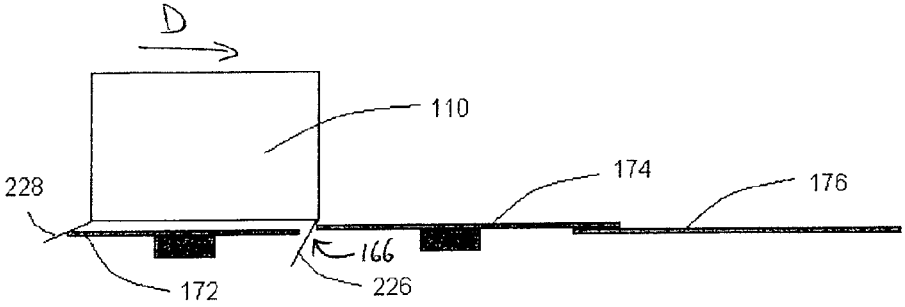

Referring to FIG. 19, as the carton 110A is conveyed further downstream, contact between the downstream edge of the slot 166 (i.e. the upstream end of rail portion 174) and the exterior surface of the leading minor flap 226 causes the flap 226 to be swung (i.e. to pivot or be folded about its fold line with the leading minor panel 214), from its former open position, to an orientation in which it protrudes transversely from the carton conveyor 114 through slot 166. This is illustrated in top plan view in FIG. 72. Further downstream indexing of the carton 110A causes the leading minor flap 226 to point partially upstream, as shown in FIG. 73.

Figure 65:
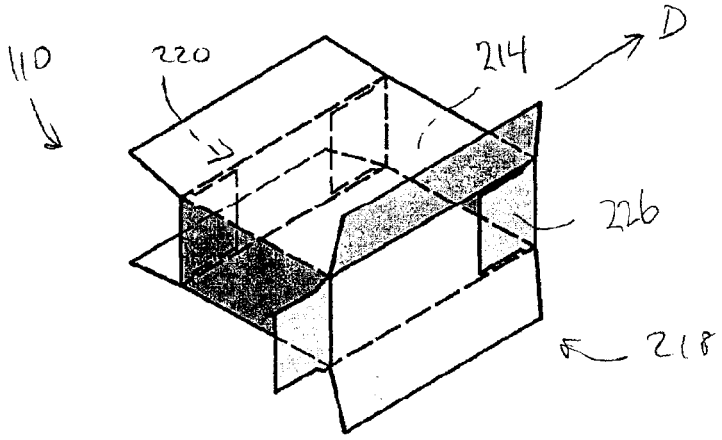
Figure 66:
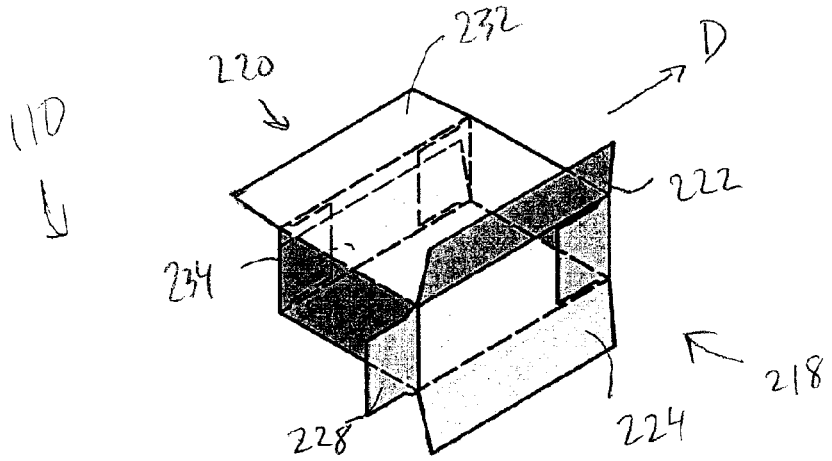
Figure 74:
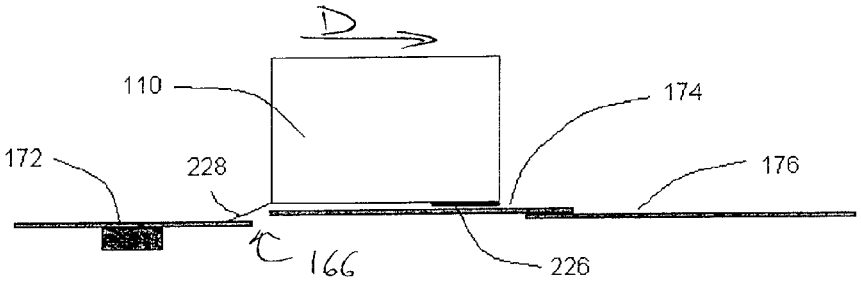
Figure 75:
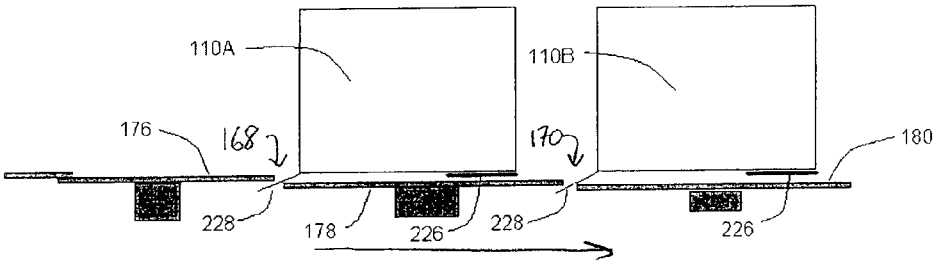
FIGS. 75 to 78 are top plan views of the closure of the trailing minor flaps of a pair of cartons using a portion of the box closing apparatus of FIG. 60.
Figure 76:
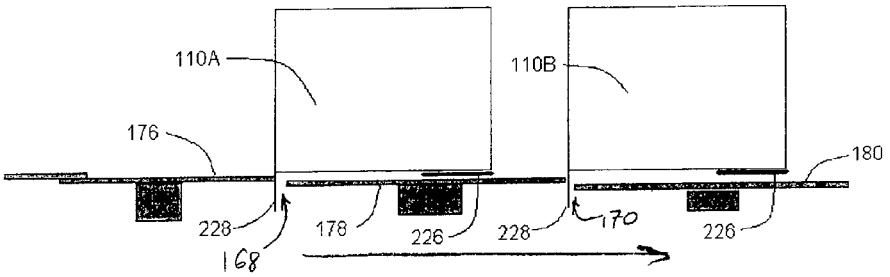
Figure 77:
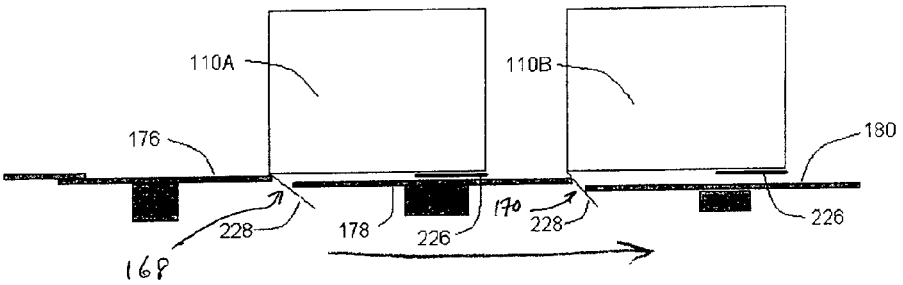
Figure 78:
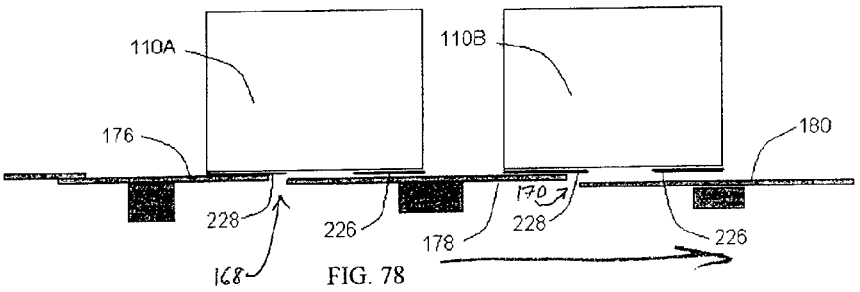
Figure 79:
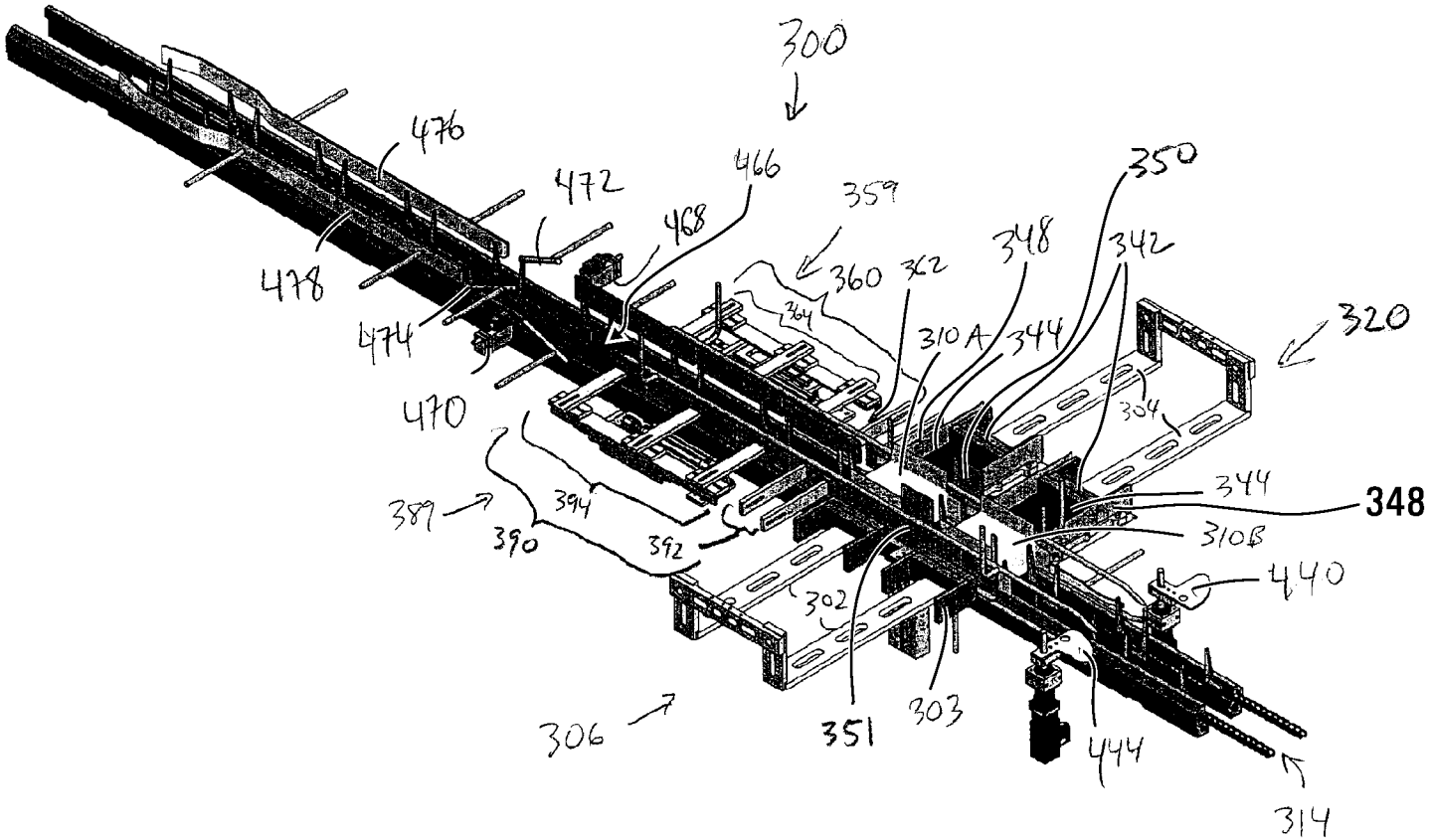

Turning to FIG. 20, upon still further downstream indexing of the carton 110A, the upstream limit of rail portion 174 closes the leading minor flap 226 more fully, i.e. folds the flap 226 to its closed position, as illustrated in FIG. 65. By virtue of the continued conveyor movement, the carton 110A essentially pulls the leading minor flap 226 downstream by its fold-line proximal edge, withdrawing it from slot 166 with the flap 226 now pointing in the upstream direction and being in the closed position, as shown in FIG. 74. At this stage, the rail portion 174 holds the flap 226 closed (as in FIG. 21), with the exterior surface of flap 226 sliding along interior surface of the rail portion 174.

It will be appreciated that, when the trailing minor flap 228 is conveyed past slot 166, the slot 166 does not close the flap 228 as it did flap 226. The reason is that the trailing minor flap 228 points upstream rather than downstream as it is conveyed past slot 166. As a result, the distal tip of the trailing minor flap 228 will effectively be dragged across the slot 166 rather than being thrust through it.

It will also be appreciated that, throughout the above-described closure of the leading minor flap 226, the rail portions 172 and/or 174 substantially abut, cover or block the open loading end 218 of the carton 110A, as the flap 226 is conveyed past the slot 166 (albeit there may be a small transverse gap between the open end 218 of the carton 110A and the interior side of the rail portion 172, so that the conveyor does not cause the portion of the leading minor panel 214 of carton 110A immediately adjacent to the fold line with the leading minor flap 226 to strike the upstream edge of the rail portion 174). This abutment, coverage or blocking may advantageously inhibit or preclude egress of product or other carton contents during closure of the leading minor flap 226. This advantage is not necessarily present in conventional minor flap closure techniques. For example, in systems where a leading minor flap is closed by a guide rail or other fixed structure in the manner shown for leading minor flap 236 in FIG. 36 for example, the arc through which the minor flap is to swing about its fold line during closure is typically intentionally kept open, precisely so that closure of the minor flap is unimpeded. To the extent that any product contained in a carton whose leading minor flap is being so closed is jostled (e.g. due to normal conveyor movement), the jostled product may undesirably fall out of the carton through the intentionally open area. The presently described approach may be less prone to such difficulties. Moreover, use of the slot 166 may be less complex and less expensive than other approaches used in the industry to address the "product egress during minor flap closure" problem, such as the use of top-loading systems wherein gravity tends to keep top-loaded product inside a carton prior to carton closure.

Referring again to FIG. 50, as the leading carton 110A is being conveyed downstream, the lower major flap 234 on the non-loading end 220 starts to ride up the stationary lower major flap plough 262. Upon further downstream conveying of the carton 110A, the contact with the plough 262 causes the lower major flap 234 to close (see FIG. 51), resulting in the carton configuration shown in FIG. 66. The lower major flap 234 of the second carton 110B is closed in the same way (see FIG. 52). The lower major flaps 234 of both cartons 110A and 110B are thereafter held closed, when in the minor flap closing station 130, by the stationary lower major flap retainer rail 264 (see FIG. 52).

In FIGS. 22-24 and FIG. 51, the leading minor flap 226 of the second carton 110B is closed in the same way that the leading minor flap 226 of the first carton 110A was closed (see FIGS. 18-20, described above).

Figure 25:
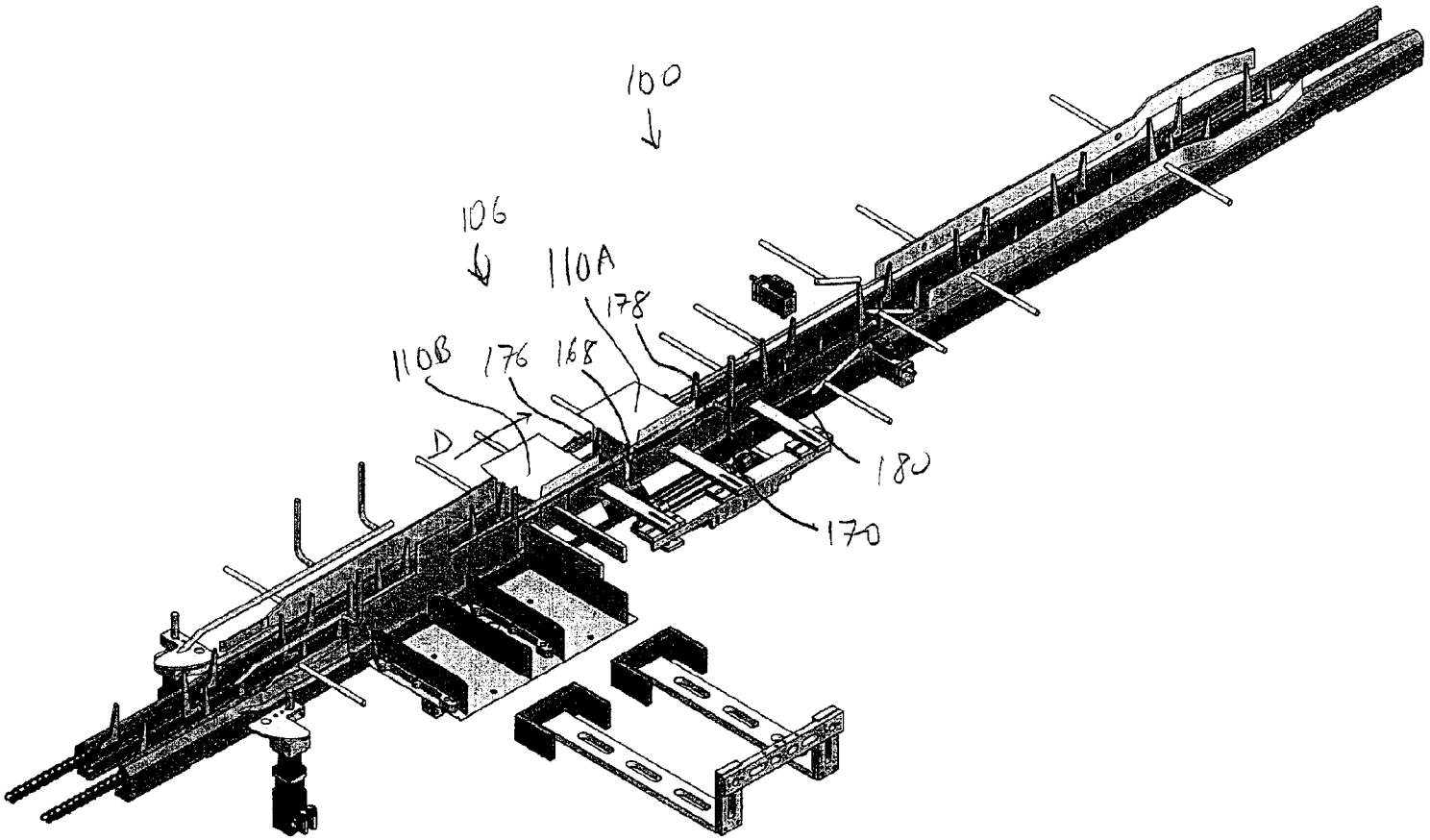
Figure 52:
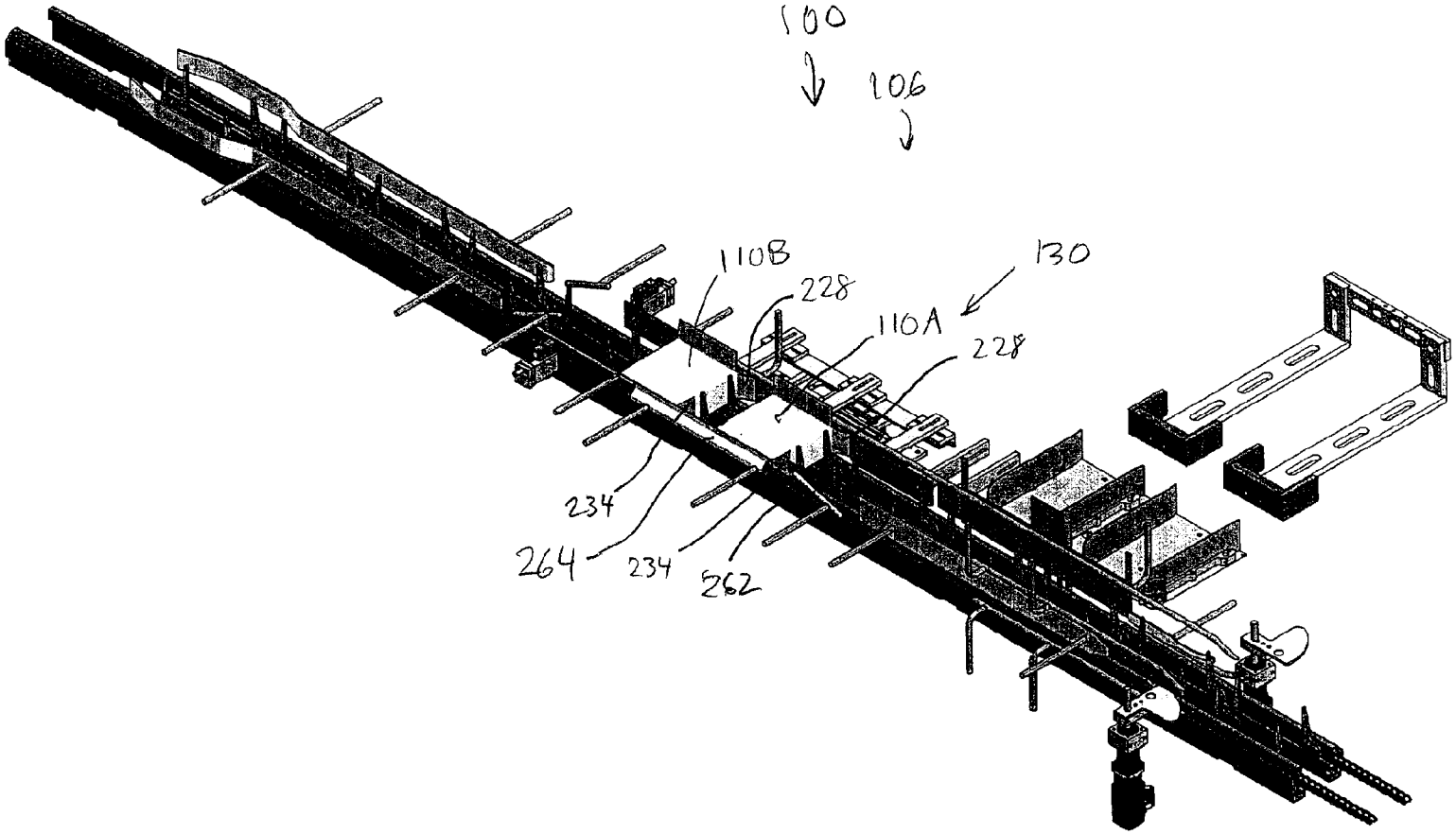
Figure 53:
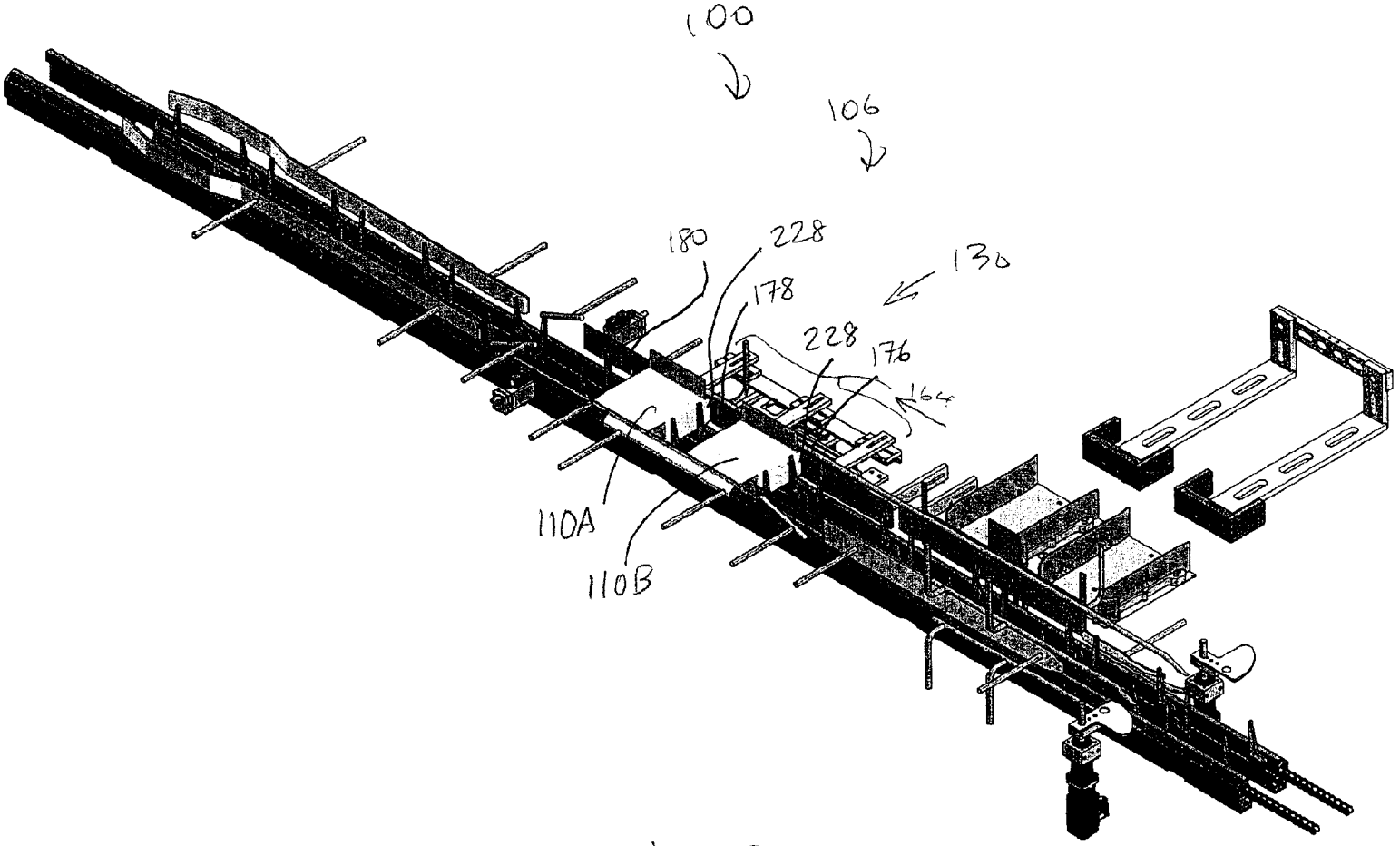
Figure 54:
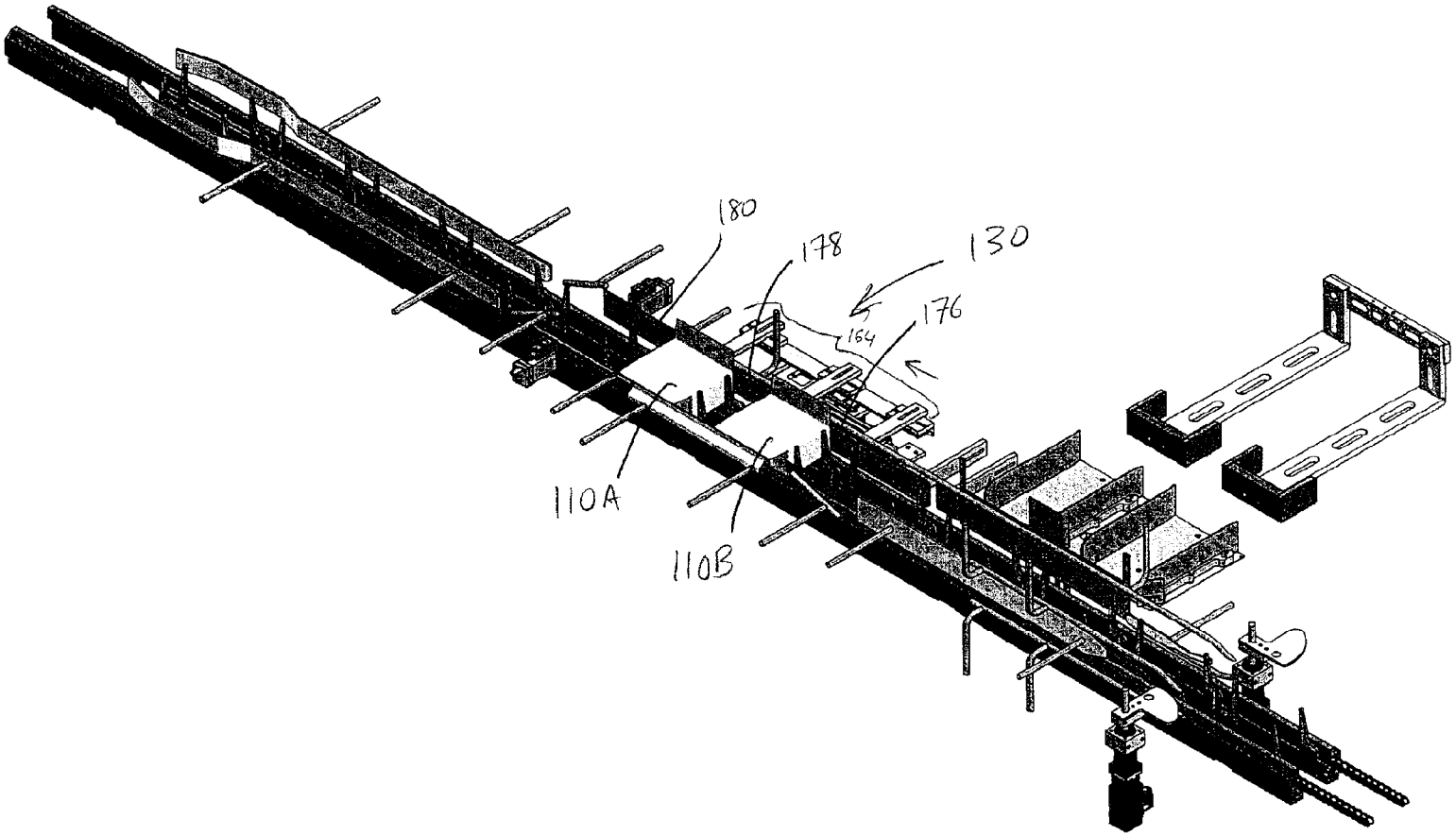
Figure 55:
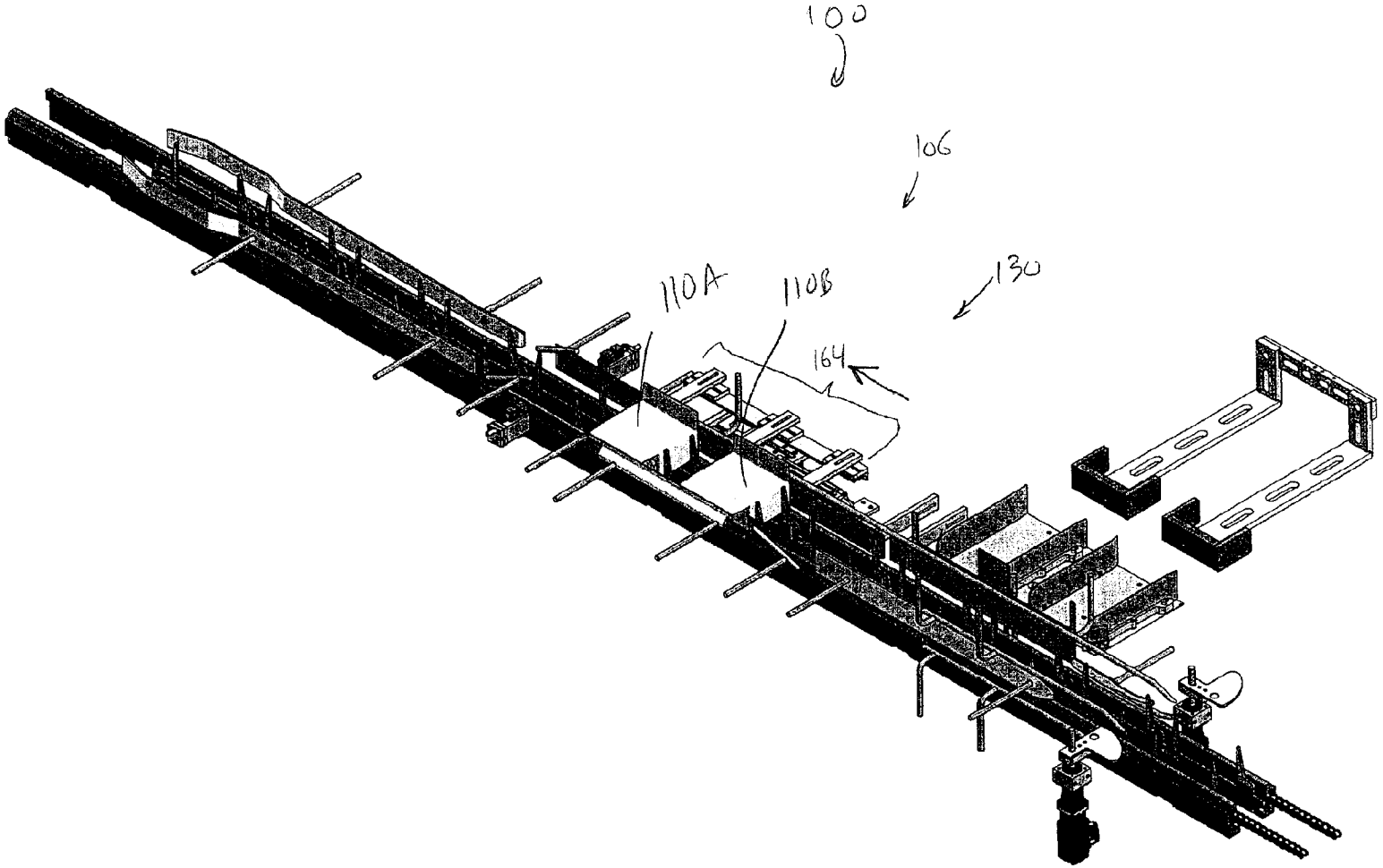

Referring to FIG. 25, downstream conveying of the cartons 110A and 110B continues, until the trailing minor flaps 228 of each of the cartons 110A and 110B just pass slots 168 and 170 of the reciprocating rail 164. At that point, the carton conveyor 114 again suspends its downstream movement, i.e. reaches another dwell period. This is shown in FIGS. 26 and 52.

It will be appreciated that, in the present embodiment, the commencement of the dwell period during which the trailing minor flaps 228 of cartons 110A and 110B are closed matches the commencement of the dwell period during which an upstream pair of cartons 110 are loaded with product 144. This design leverages the dwell period for use not only for product loading, but also for loading-side trailing minor flap closure. That is, because the reciprocating rail 164 is designed to pass the cartons 110A and 110B in the downstream direction in order to close the trailing minor flap 228 in any event, the box closing apparatus 106 has been designed to do this when the (now-loaded) cartons are in a dwell period. Although reciprocating rail 164 could feasibly be designed to close trailing minor flaps 228 of moving cartons with the carton conveyor 114 in motion, in that case the reciprocating rail 164 would need to move in the downstream direction at a speed that is faster than the speed of carton conveyor 114, and possibly to have a longer extent of travel than in the present embodiment, to be able to overtake the moving cartons 110A and 110B.

Closure of the trailing minor flaps 228 of the cartons 110A and 110B by the reciprocating rail 164 portion of the minor flap closing device 159 is shown in FIGS. 26-29 and FIGS. 75-78.

Figure 26:
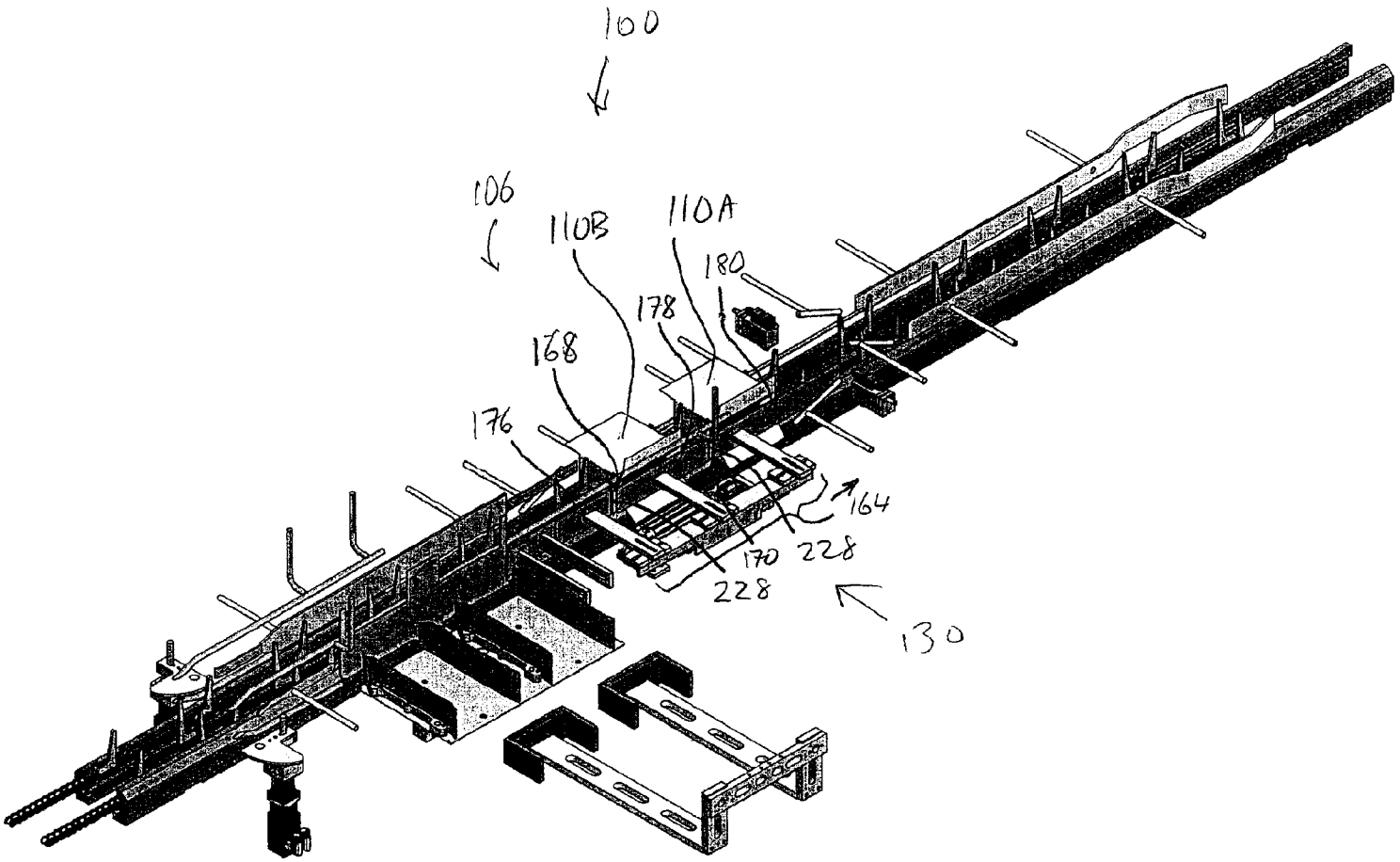

Referring to FIG. 26, with the cartons 110A and 110B stationary on the conveyor 114, the reciprocating rail 164 commences longitudinal downstream movement alongside carton conveyor 114. This is caused by the commencement of extension of piston arm 200 from cylinder 202 (see FIG. 60). As the slots 168 and 170 in the reciprocating rail 164 pass the upstream-pointing trailing minor flaps 228 of cartons 110B and 110A respectively, the distal tips of the trailing minor flaps 228 are thrust through the respective slots 168 and 170. Put another way, the distal tips of the trailing minor flaps 228 of cartons 110B and 110A are received or "caught" by the slots 168 and 170 respectively and protrude partially therethrough. This is illustrated in top plan view in FIG. 75. As earlier noted, the ability of slots 168 and 170 to catch the trailing minor flaps 228 in this way may be facilitated, at least in part, by the fact that the slots 168 and 170 are slightly downstream-facing in the present embodiment (i.e. there is an offset A2 between rail portions 176 and 178 and an offset A3 between rail portions 178 and 180, as shown in FIG. 60). These offsets may be diminished or possibly absent in some embodiments. Additionally the natural resiliency (memory) of the material may also cause the minor flap 228 to be pushed into and through slots 168 and 170. It should be noted that in some embodiments an external force may be applied to the interior surface of the minor flaps 228 when they are proximate slots 168 and 170. This could be done for example by directing a flow of gas (e.g. air) from a nozzle against the surface of the minor flap, to push the minor flaps 228 against the rail sections 178 and 180 respectively. A flow of pressurized air emitted from the nozzle may be controlled by suitable valves that are in communication with controller 108.

Figure 27:
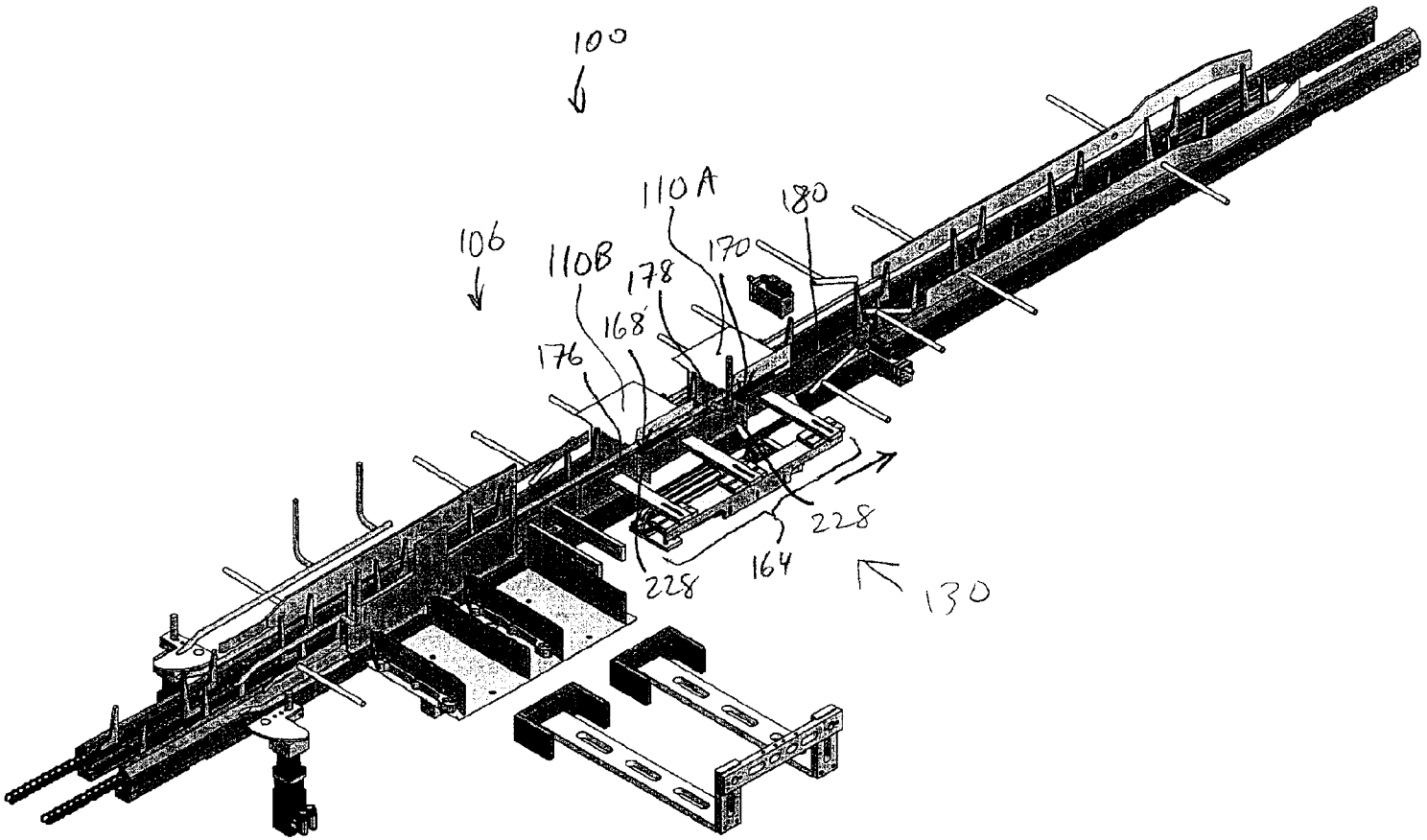

Referring to FIG. 27, as the reciprocating rail 164 moves further downstream, contact between the upstream edges of the slots 168 and 170 (i.e. the downstream limits of rail portions 176 and 178 respectively) and the exterior surfaces of the trailing minor flaps 228 of cartons 110B and 110A respectively causes the flaps 228 to be swung (i.e. to pivot or be folded about their fold lines with their trailing minor panels 216), from their former open position, to an orientation in which they protrudes transversely from the carton conveyor 114 through slots 168 and 170. This is illustrated in the top plan view of FIG. 76. Further downstream movement of reciprocating rail 164 causes the trailing minor flaps 228 to point partially downstream, as shown in the top plan view of FIG. 77.

Figure 28:
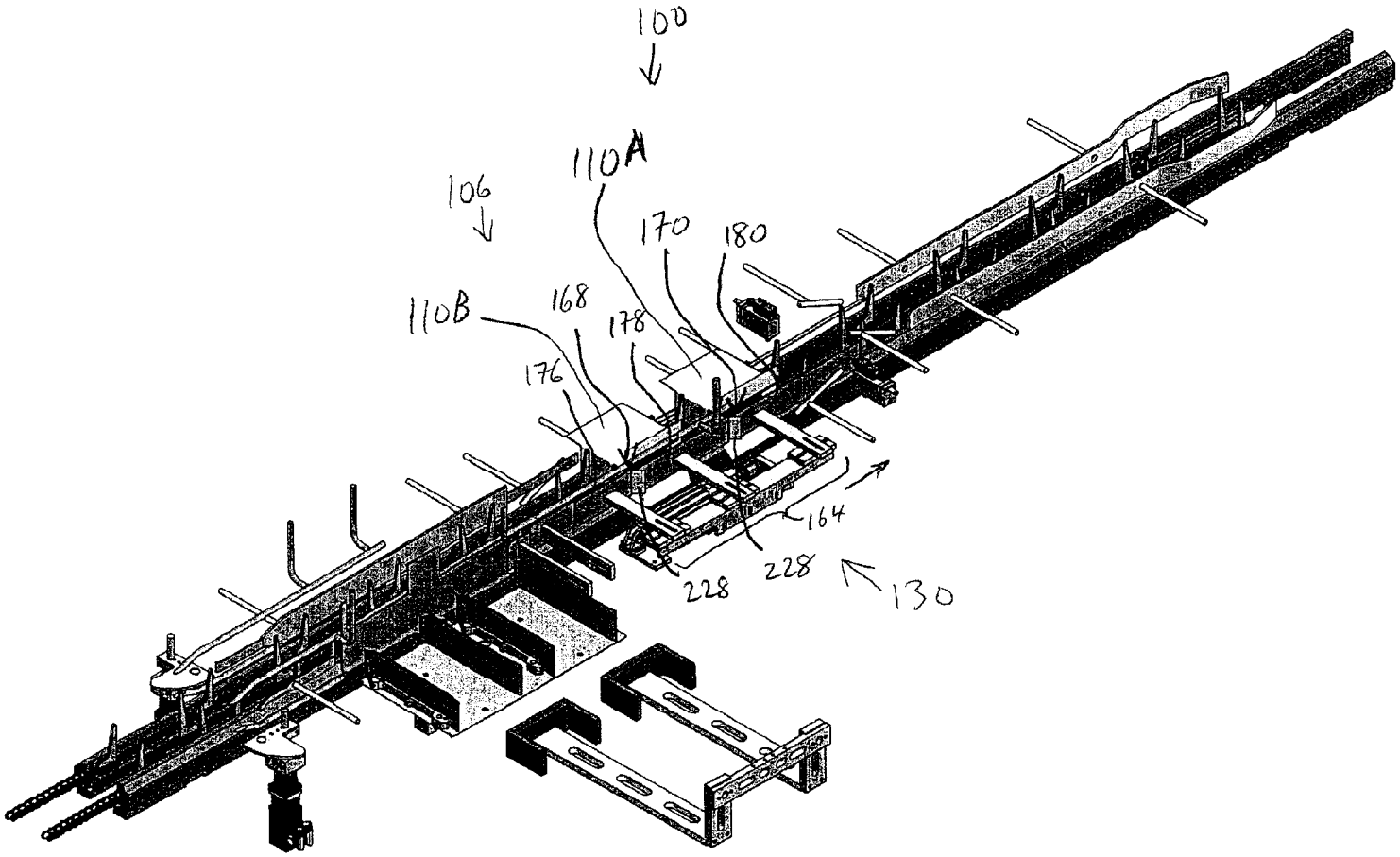
Figure 29:
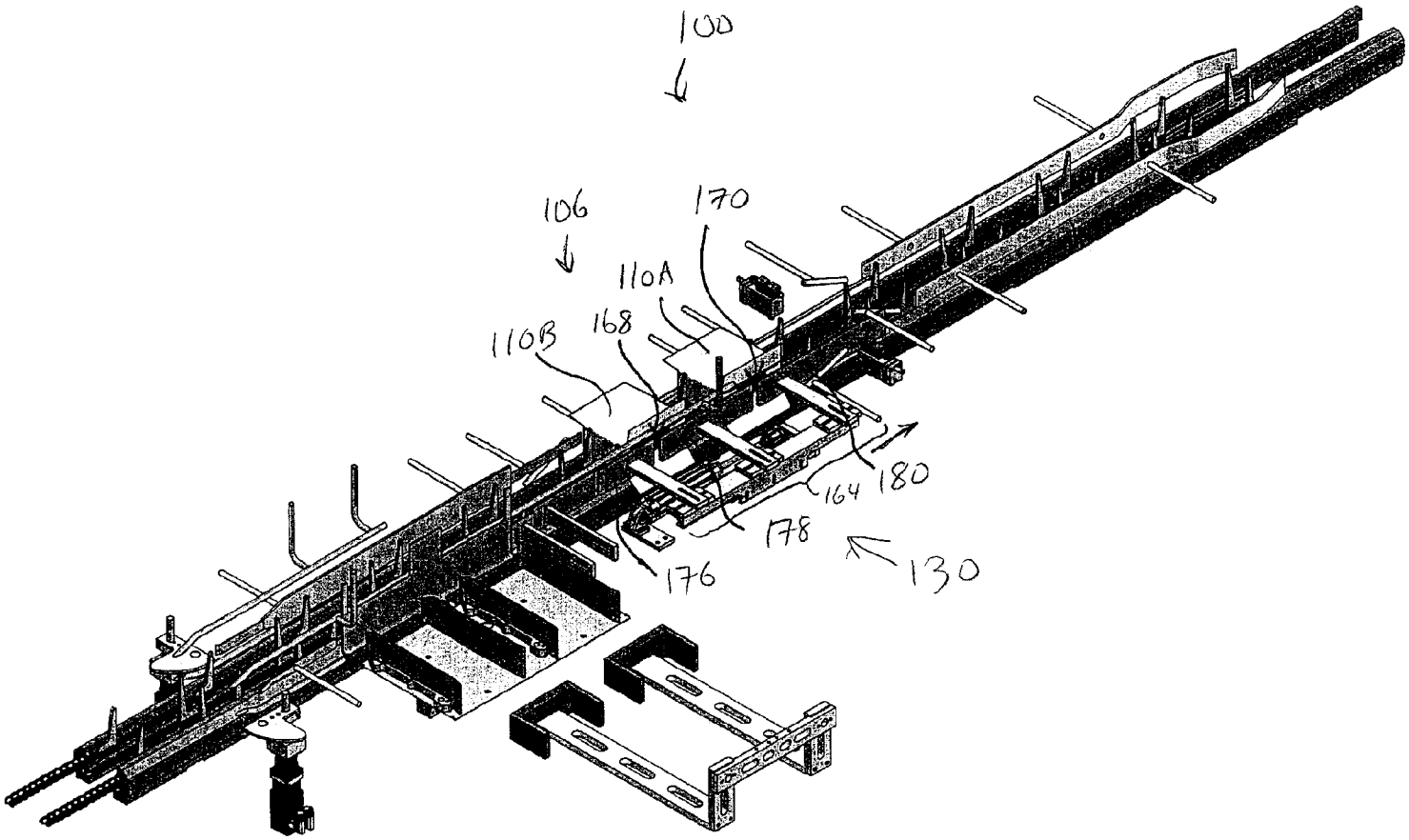
Figure 67:
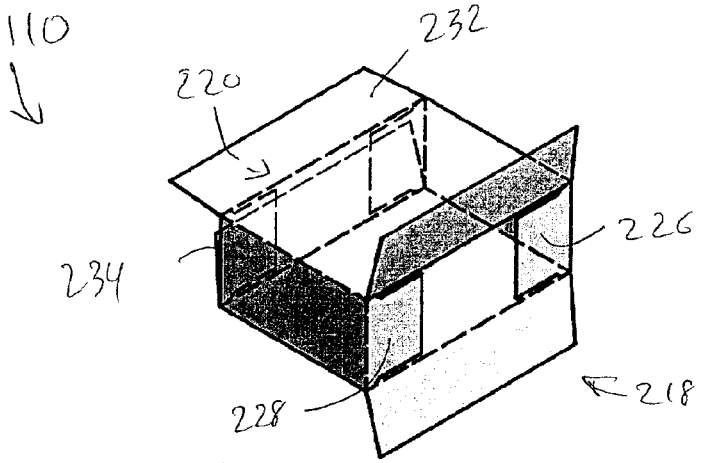
Figure 68:
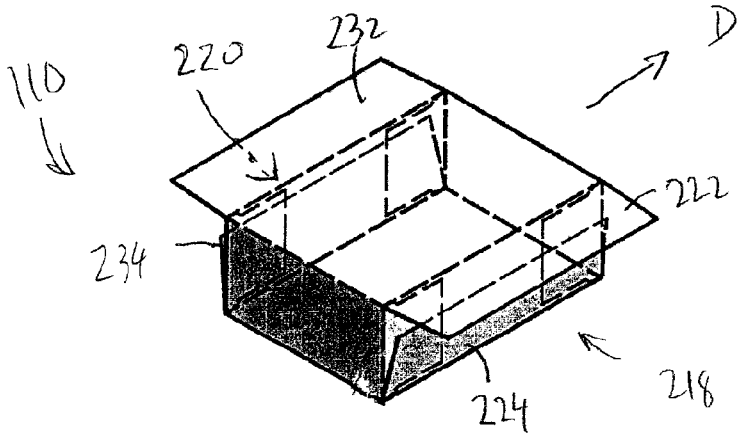

Turning to FIG. 28, upon further downstream longitudinal movement of the reciprocating rail 164, the downstream ends of rail portion 176 and 178 close the trailing minor flaps 228 of cartons 110B and 110A more fully, i.e. fold the trailing minor flap 228 to their closed positions, as illustrated in FIGS. 29 and 67 for example. At this stage, the reciprocating rail 164 ceases its longitudinal movement, with interior surfaces of the rail portions 176 and 178 holding closed the flaps 228 of cartons 110B and 110A, respectively, e.g. as shown in the top plan view of FIG. 78. The downstream limit of movement of the reciprocating rail 164 is such that the slots 168 and 170 do not reach the leading minor flaps 226 of respective cartons 110B and 110A. This is to avoid inadvertent reopening of the leading minor flaps 226 by slots 168 and 170.

It will be appreciated that, throughout the above-described closure of the trailing minor flap 228 of carton 110B, the rail portions 178 and/or 176 substantially abut, cover or block the open loading end 218 of the carton 110A. Similarly, throughout the above-described closure of the trailing minor flap 228 of carton 110A, the rail portions 180 and/or 178 substantially abut, cover or block the open loading end 218 of the carton 110A (although there may be a small transverse gap between the open ends 218 of the cartons 110A and 110B and their respective adjacent rail portion(s)). This abutment, coverage or blocking may advantageously inhibit or preclude egress of product or other carton contents from cartons 110B and 110A during closure of the trailing minor flaps 228. This advantage is not necessarily present in conventional minor flap closure techniques. For example, in systems where a trailing minor flap is closed by a kicker in the manner shown for trailing minor flap 238 in FIGS. 37 and 38 for example, the arc through which the minor flap is to swing about its fold line during closure is typically intentionally kept open, precisely so that closure of the minor flap is unimpeded. To the extent that any product contained in a carton whose trailing minor flap is being so closed is jostled (e.g. due to normal conveyor movement), the jostled product may undesirably fall out of the carton through the intentionally open area. The presently described approach may be less prone to such difficulties and may be less complex or less costly than alternative approaches for addressing the same problem, such as top-loading systems.

It will also be appreciated that the above-described closure of the leading and trailing minor flaps on the loading end 218 of a carton 110 is achieved without the use of a kicker. The above-described minor-flap closure technique may accordingly be referred to as a kickerless minor flap closure technique. The omission of kickers for minor flap closure may advantageously avoid the aforementioned precision control requirements that may be required to account for factors such as conveyor speed and carton material resiliency for example and may thus reduce the sensitivity of the box closing apparatus 106 to variations in such parameters.

Figure 30:
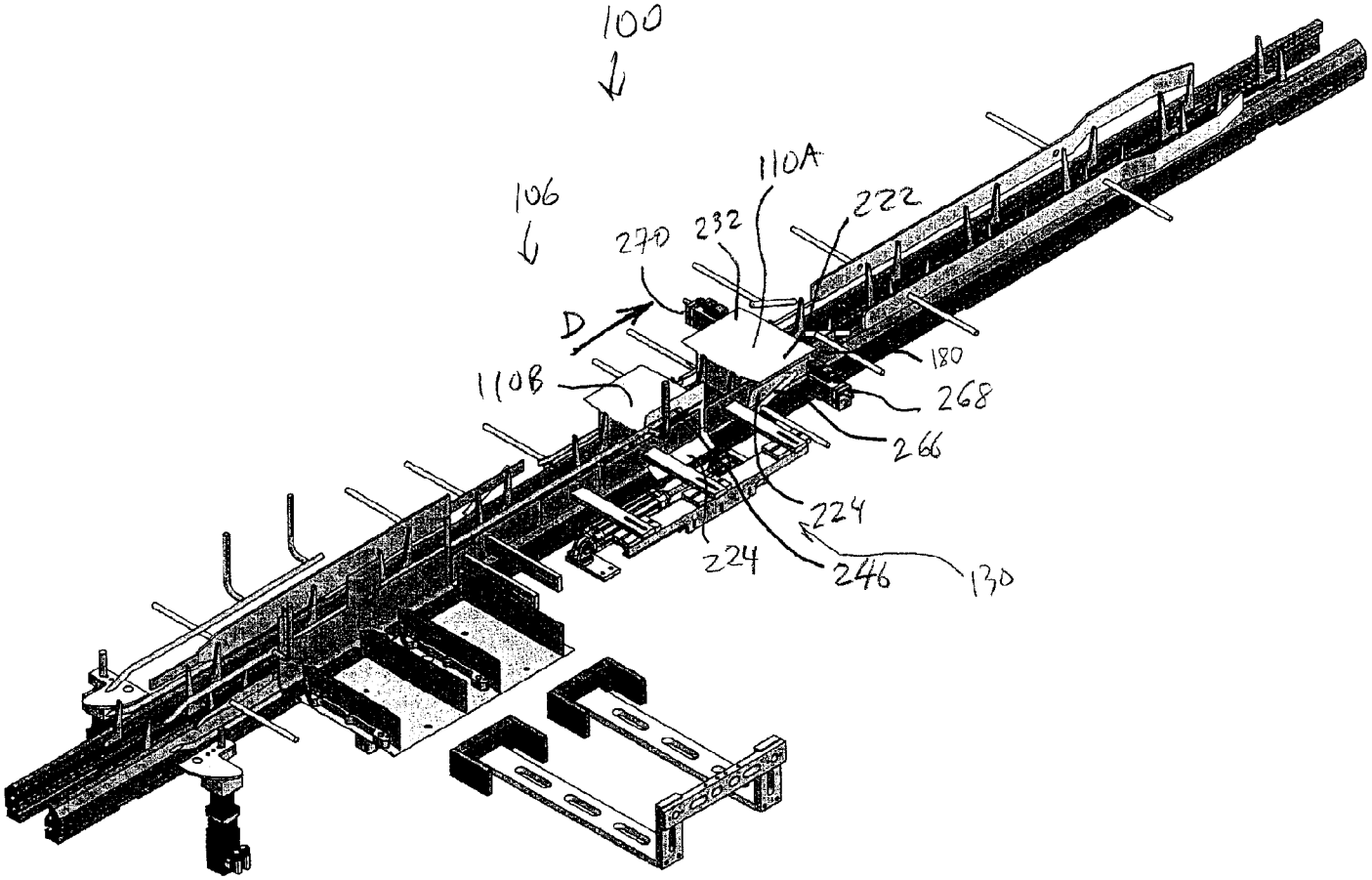

Referring to FIG. 30, the carton conveyor 114 resumes downstream indexing (movement) of both cartons 110A and 110B. As the cartons exit the minor flap closing station 130, product egress from between the now-closed minor flaps 226 and 228 is prevented by the rail portion 180 of the reciprocating rail 164 along which the cartons are conveyed.

It will be appreciated that, when the trailing minor flaps 228 are conveyed past the slots 168 and 170 that were used to close those flaps, the slots 168 and 170 do not catch and reopen the flaps 228. In some embodiments, this may be facilitated by the fact that the slots 168 and 170 are partially downstream facing. That is, in some embodiments, the distal tips of the closed, downstream-pointing trailing minor flaps 228 are not thrust through the slots, at least in part because the upstream side of each slot is inwardly offset relative to the downstream side of the slot. Also, when the closed leading minor flap 226 of the upstream carton 110B is conveyed downstream past slot 170, the flap 226 is simply dragged across the slot 1700 by virtue of the fact that it was earlier closed and thus points upstream. Although not expressly illustrated, as the upstream carton 110B exits the minor flap closing station 130, the reciprocating rail 164 may reciprocate longitudinally (i.e. move in the upstream direction) back to its original starting position. This upstream resetting movement of the reciprocating rail 164 may for example commence just as the trailing minor flap 228 of the carton 110B passes downstream slot 170. It is possible that the resetting could occur even earlier in alternative embodiments.

Still referring to FIG. 30, as the leading carton 110A is conveyed further downstream, the lower major flap 224 on the loading end 218 starts to ride up the stationary lower major flap plough 266. Upon further downstream conveying of the carton 110A, the contact with the plough 262 causes the lower major flap 224 to close, resulting in the carton configuration of FIG. 68. As this is being done, a sealing device 268 (FIG. 30) applies a sealing material, such as glue or tape, to an exterior surface of the lower major flap 224. A similar sealing device 270 similarly applies a sealing material to the exterior surface of the lower major flap 234 on the non-loading side of the carton 110A.

Figure 31:
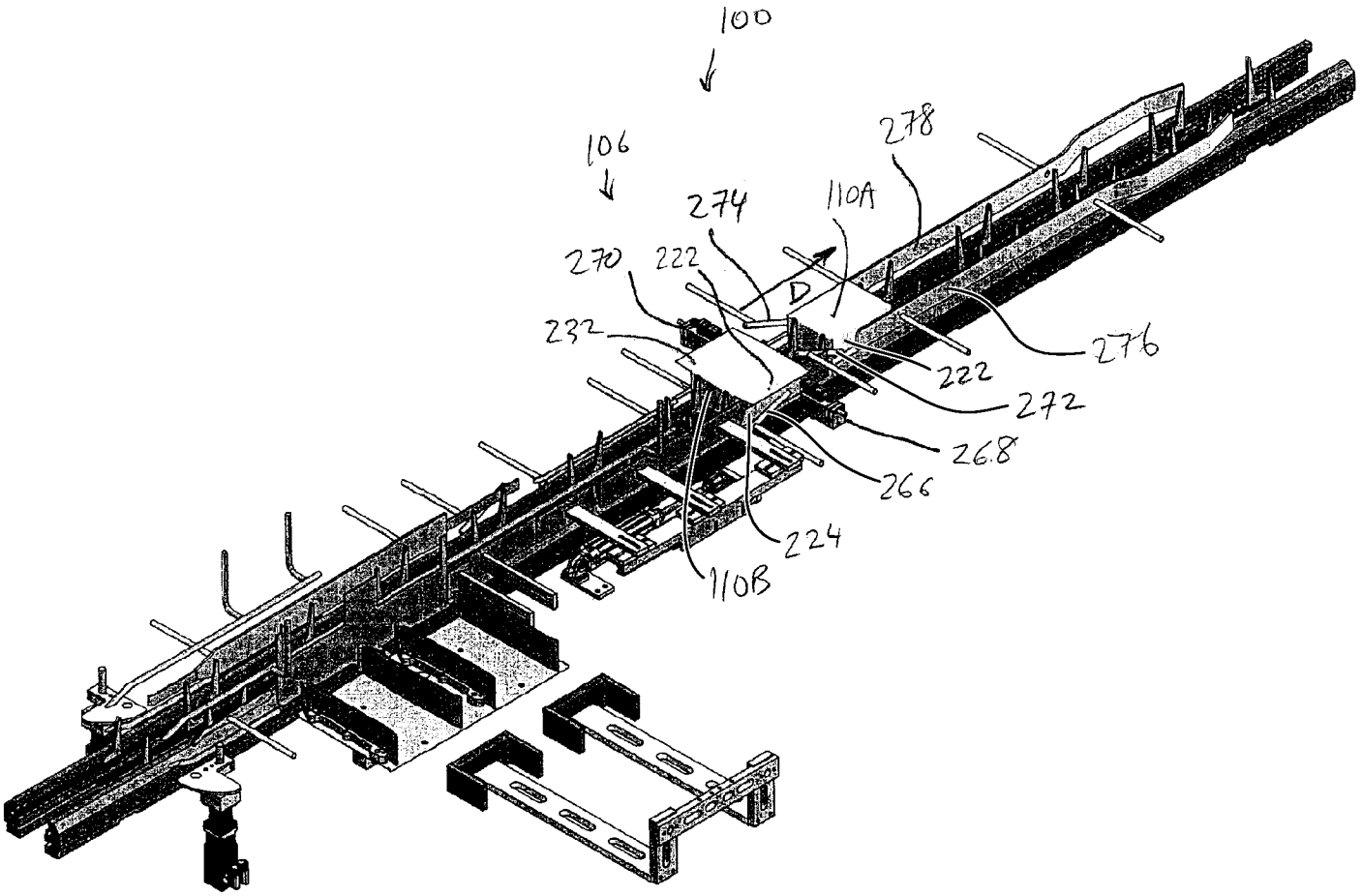
Figure 56:
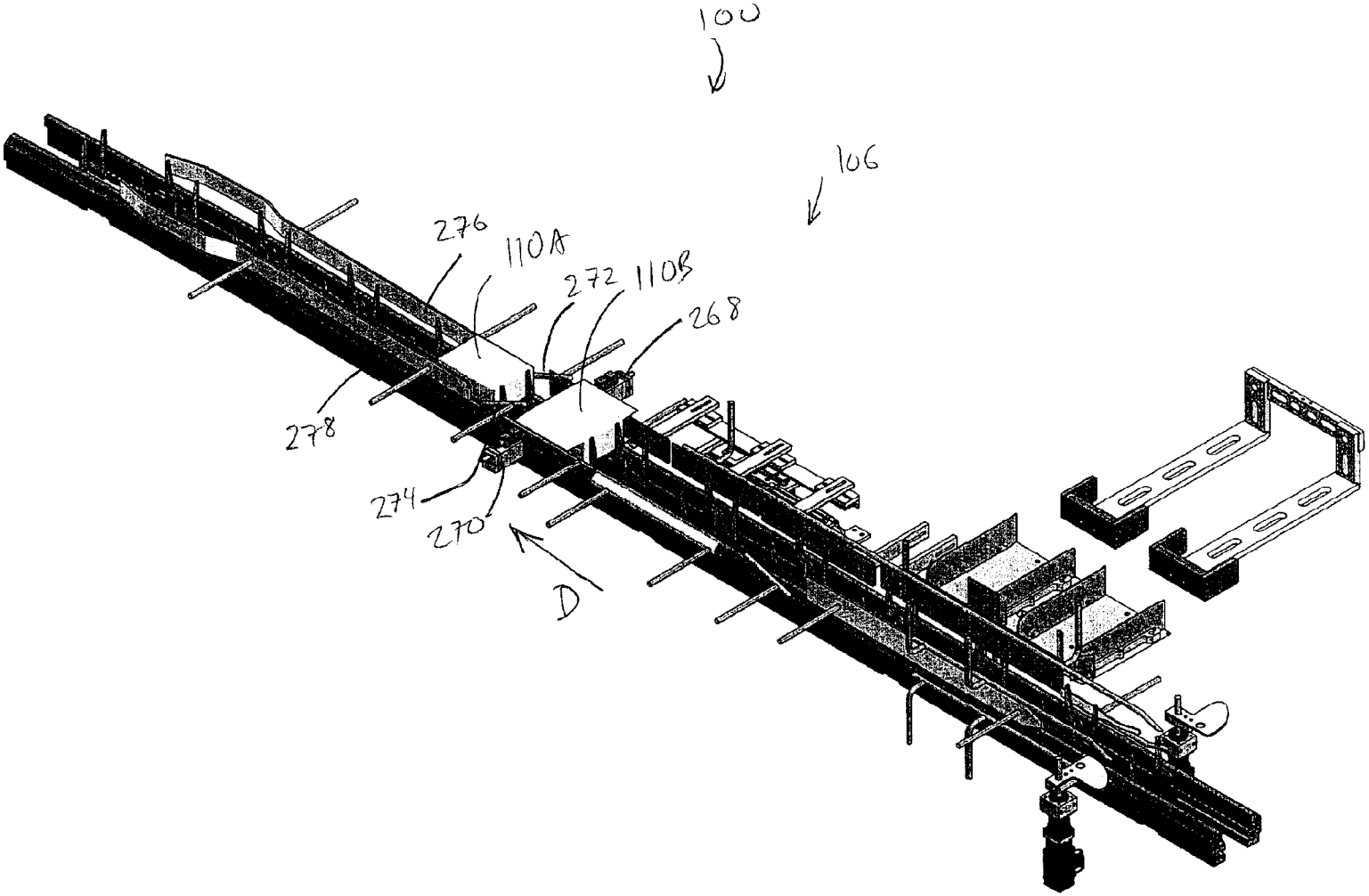
Figure 69:
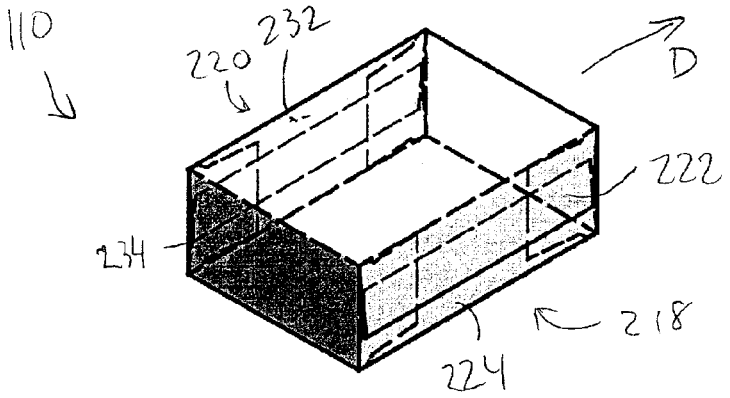

Referring to FIGS. 31 and 56, subsequent conveyance (indexing) of the carton 110A past opposing upper major flap closing ploughs 272 and 274 causes the upper major flaps 222 and 232, respectively, to close, resulting in the carton configuration of FIG. 69. Carton sealing is completed through conveyance of the carton 110A between opposing compression rails 276 and 278 flanking the conveyor 114 (see FIGS. 31 and 56), which apply pressure to the sides of the cartons.

Figure 32:
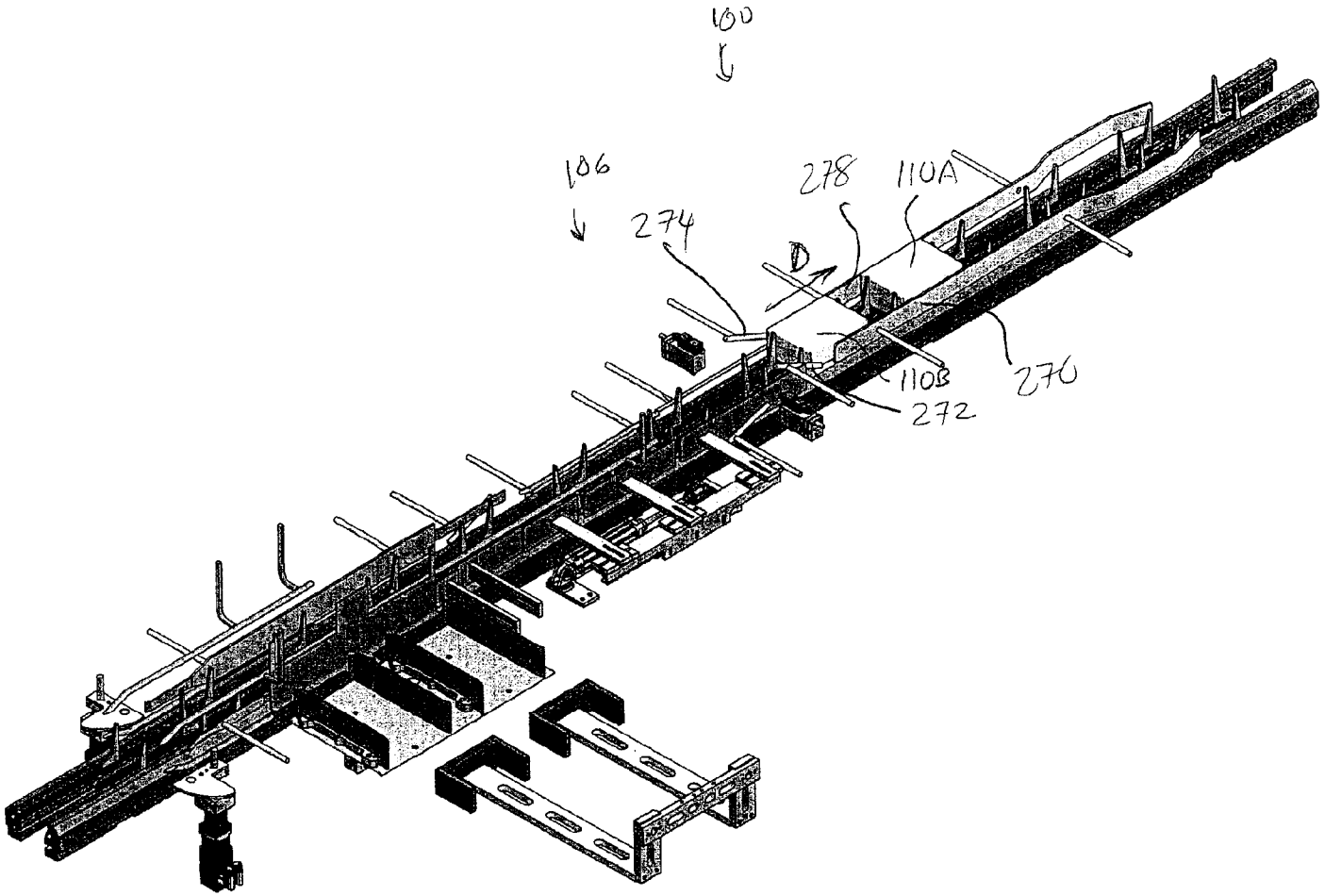
Figure 57:
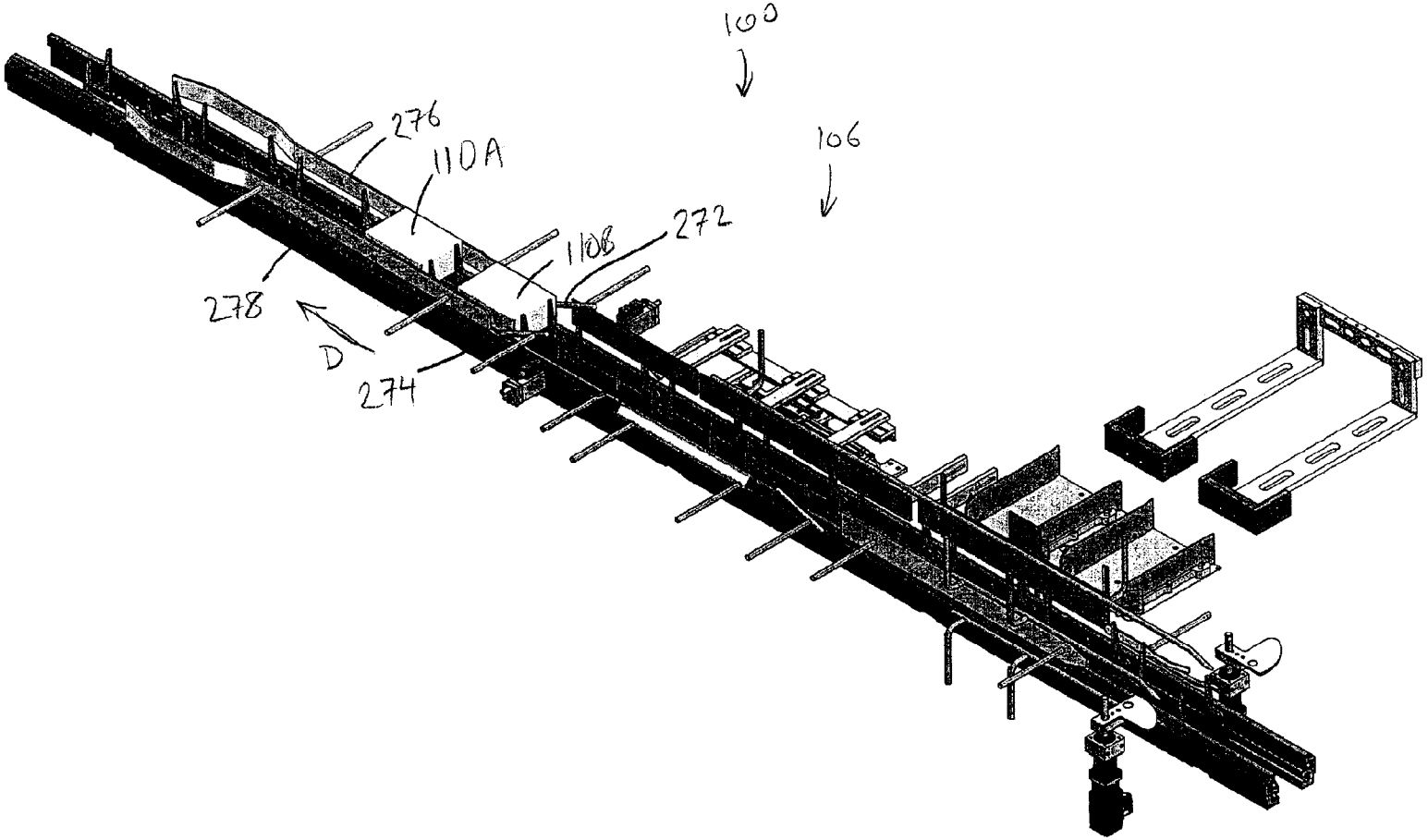

Referring to FIGS. 32 and 57, the second carton 110B is closed and sealed in the same manner as carton 110A.

Figure 33:
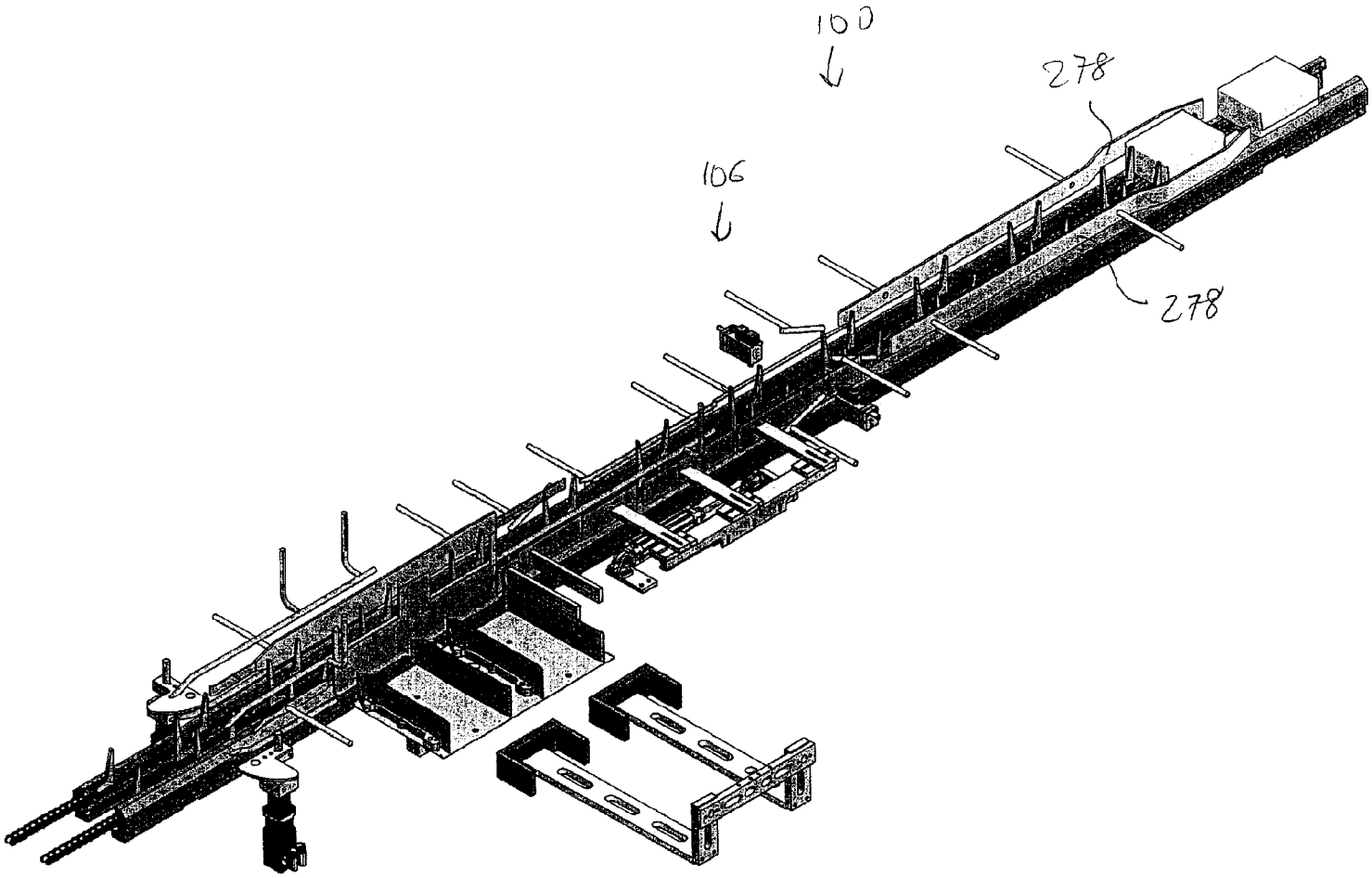
Figure 58:
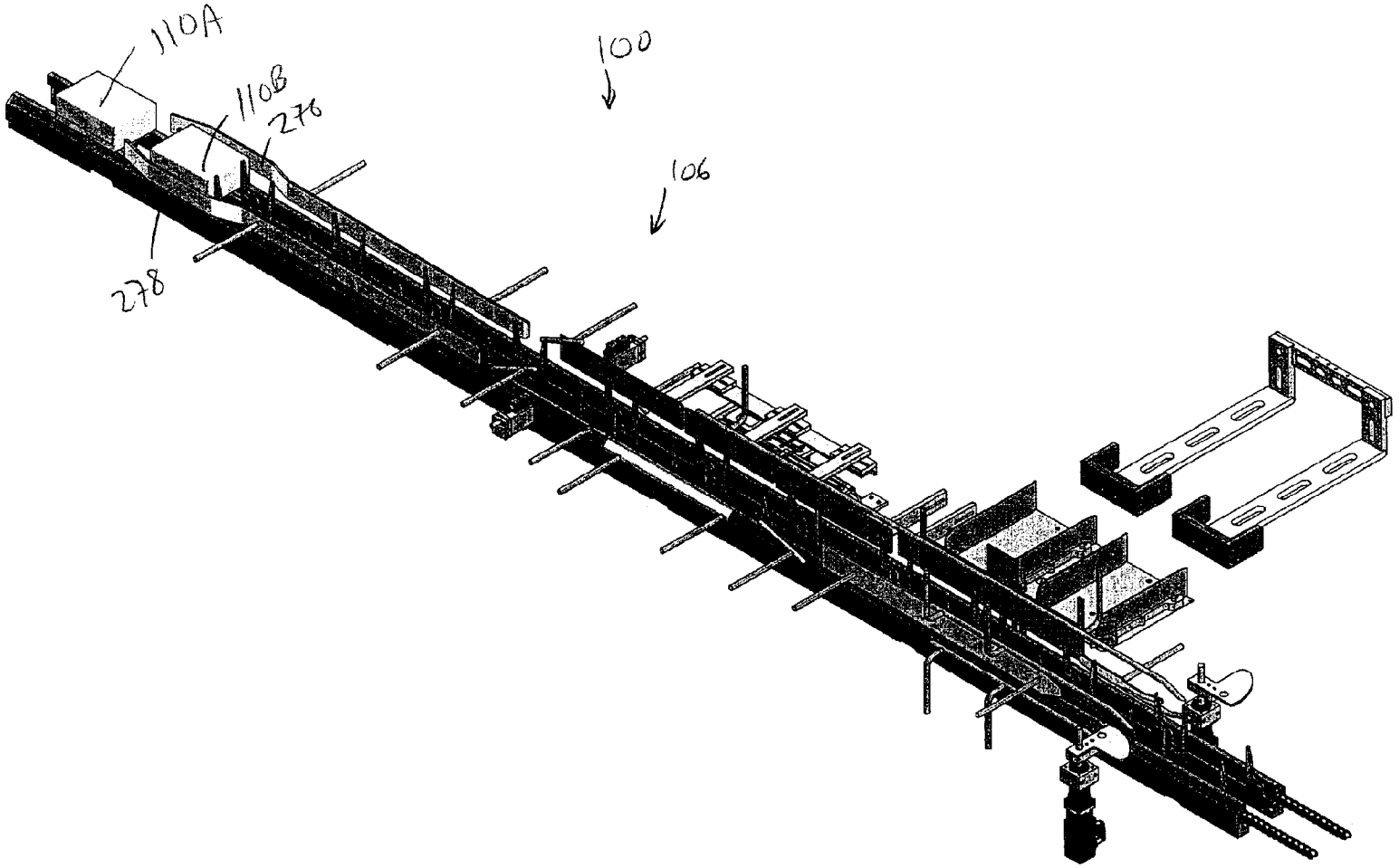
Figure 59:
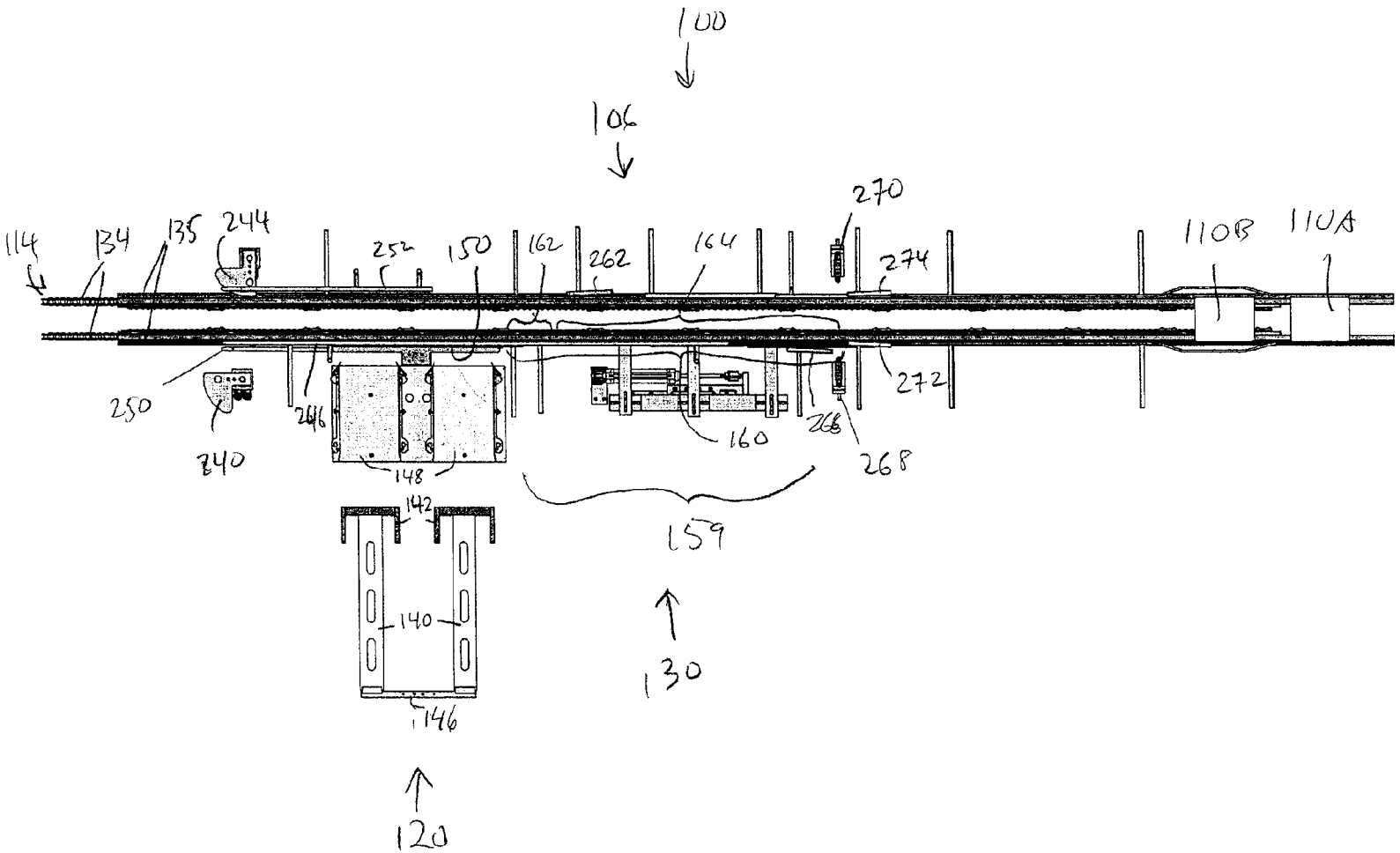
FIG. 59 is a top plan view of the example box closing apparatus of FIGS. 2 to 58.

Referring to FIGS. 33, 58 and 59, the sealed cartons emerge from between the compressing rails 276 and 278 for possible further processing downstream. The cartons illustrated in FIGS. 33, 58 and 59 may be in a further dwell period. In some embodiments, side belts that grip the cartons may be continuously running to discharge cartons 110 from the box closing apparatus 106. This may prevent lugs from marking the trailing minor panel 216 of the cartons 110 as they go around a chain pulley for example.

Various modifications to the above-described system are possible. For example, for example, it is not absolutely required for the carton conveyor 114 to use period dwell periods. Rather, a continuous motion conveyor could be used. In such an embodiment, product loading could be achieved while the cartons 110 are in motion on the conveyor through the use of a product loading station wherein a reciprocating arm transversely loads product into a carton while being indexed along with the carton for example. In such embodiments, the configuration of the fixed rail 162 used for closing leading minor flaps 226 could remain the same. The reciprocating rail 164 should be configured to move in a downstream direction at a speed that is faster than the conveyor speed, in order to be able to overtake and close the trailing minor flaps 228 of cartons as they are indexed downstream.

As described above, it is not absolute required for cartons to be loaded and to have their minor flaps closed in pairs, like carton pair 110A and 110B. For example, in a continuous motion conveyor system, it may be practical to load each carton individually as the carton is indexed. Alternatively, in some embodiments, it may be desired to handle more than two cartons (i.e. during product loading and during loading-side minor flap closure) at once.

As indicated above, in some embodiments, if material memory alone is insufficient to reliably urge the leading minor flap 226 to slide along the interior of rail portion 172 and to thus be readily received within the slot 166 for leading minor flap closure, or similarly if the material memory alone is insufficient to urge the trailing minor flap 228 to slide along the interior of rail portion 178 or 180 to thus be readily received within slot 168 or 170 respectively for trailing minor flap closure, then it may be possible to use another mechanism, such as an outward transverse air blast for example, to facilitate such urging and to thereby encourage proper reception and closure of the flaps by the relevant slot 166, 168 or 170.

In some embodiments, the slot 166 that is used to close leading minor flaps 226 could be a slot in a rail that is not fixed in relation to the conveyor 114. It may for example be possible for the slot 166 to be defined in a rail that moves upstream as a carton 110 whose leading minor flap 226 is to be closed is conveyed downstream past the slot 166. It is the downstream movement of the leading minor flap 226 relative to the slot 166 (or conversely upstream movement of the slot 166 relative to the flap 226) that is what causes the flap to close. Thus, while the slot 166 may be defined in a fixed rail due to simplicity (since cartons are being conveyed downstream in any event), it is not absolutely required for the rail in which the slot 166 is defined to be fixed in all embodiments. Furthermore, it will be appreciated that other variations are possible to provide for relative movement of the cartons and their minor flaps on the one hand, and the guide rails sections and their slots 116, 168 and 170 on the other hand, to achieve the closing of the minor flaps. For example, it may in some embodiments be possible to provide for a fully stationary rail 160 and move the cartons 110 in alternate upstream and downstream movements on the conveyor 114 to achieve closure of the minor flaps 226, 228.

The illustrated embodiments show conveyance of cartons with the open end facing horizontally sidewards. It is possible that, in an alternative embodiment, the cartons could, at least temporarily at some point during their conveyance, be conveyed with the open end facing in another direction that is transverse to the longitudinal conveyance direction of the conveyor, that is not necessarily sidewards. For example, it may be possible in some embodiments that the longitudinal movement of the boxes is in a vertical direction, and the open end of the box open in a horizontal direction.

Referring now to FIGS. 79-95, an alternative embodiment of a box closing apparatus 300, which may be referred to as a double-sided box closing apparatus 300, is illustrated. The apparatus 300 is designed to close cartons 310 that are similar in shape and structure to the cartons 110 described hereinabove. Many aspects the box closing apparatus 300, such as the conveyor 314 that conveys cartons in a downstream direction D, the kicker 440 that opens the leading minor flap, the reciprocating arms 304, product guides 348, and reciprocating gate 350 used in product loading, minor flap closing device 359 comprising a longitudinal rail 360 having fixed and reciprocating sections 362 and 364 respectively, stationary lower major flap plough 466, sealing devices 468 and 470, stationary opposing upper major flap closing ploughs 472 and 474, and compression rails 476 and 478 are analogous to their counterparts in the preceding description, namely conveyor 114, kicker 240, reciprocating arms 140, product guides 148, reciprocating gate 150, minor flap closing device 159, comprising a longitudinal rail 160 having fixed and reciprocating sections 162 and 164 respectively, stationary lower major flap plough 266, sealing devices 268 and 270, stationary opposing upper major flap closing ploughs 272 and 274, and compression rails 276 and 278, respectively. The alternative box closing apparatus 300 also has various operational similarities to the box closing apparatus 106, such as the simultaneous loading of two cartons during a dwell period and the closing of the minor flaps of the same pair of cartons using a longitudinally movable rail during a subsequent dwell period of the same duration.

However, the box closing apparatus 300 differs from the above-described box closing apparatus 106 primarily in four respects.

Firstly, the apparatus 300 is designed to open, not close, the minor flaps on the non-loading ends of cartons 310A and 310B, i.e. on the non-loading side 306 of the conveyor 314, upstream of the product loading station 320. In the illustrated embodiment, this is done using a mechanism similar to what was used for opening the minor flaps 226 and 228 on the loading end 218 of the cartons 110A and 110B on the loading side of the conveyor 114 described above. The reason for this opening of the flaps on the non-loading end of the cartons is to support the use of reverse reciprocating arms 302, described immediately following.

Secondly, the apparatus 300 has an additional set of reciprocating arms 302—referred to as reverse reciprocating arms 302—on the non-loading side of the carton conveyor 314. Arms 302 may be actuated and controlled like arms 140 as described above, using a double acting pneumatic cylinder having a supply of compressed air controlled by electronic valves that are themselves controlled by controller 108. The reverse reciprocating arms 302 are designed to cooperate with a set of reciprocating arms 304 that are similar to the reciprocating arms 140 described earlier, during product loading. More particularly, the reverse reciprocating arms 302 are designed to extend transversely, from the non-loading side 306 of the conveyor 314, fully through a pair of cartons 310A and 310B whose loading and non-loading ends have both been opened, towards the reciprocating arms 304 on the loading side of the conveyor 314, until a to-be-loaded product 344 becomes cradled between the ends 303 of the reverse reciprocating arms 302 and the pusher ends 342 of reciprocating arms 304. The reverse reciprocating arms 302 are further intended to be retracted transversely in synchronicity with the transverse extension of the reciprocating arms 304, so that the product 344 that is being pushed into the cartons 310A and 310B continues to be cradled between the ends 303 of the reverse reciprocating arms 302 and the pusher ends 342 of the reciprocating arms 304 during product loading, which ends 303 and 342 remain separated by substantially the same transverse extent as the product is being transversely loaded. The cradling of the product may inhibit product scattering or dispersal, which could possibly otherwise be caused by jostling or by friction with the bottom or upstanding sides of the product guides 348 for example, as the product is pushed into the carton 310. Such scattering or dispersal could risk product damage (e.g. due to impact with an edge of a carton wall or sandwiching of the product between a carton wall and a pusher end 342) during loading or, alternatively or additionally, could result in undesirable disarray of the loaded product. Such operation of the reverse reciprocating arms 302 and reciprocating arms 304 is illustrated in FIGS. 80-83.

Figure 80:
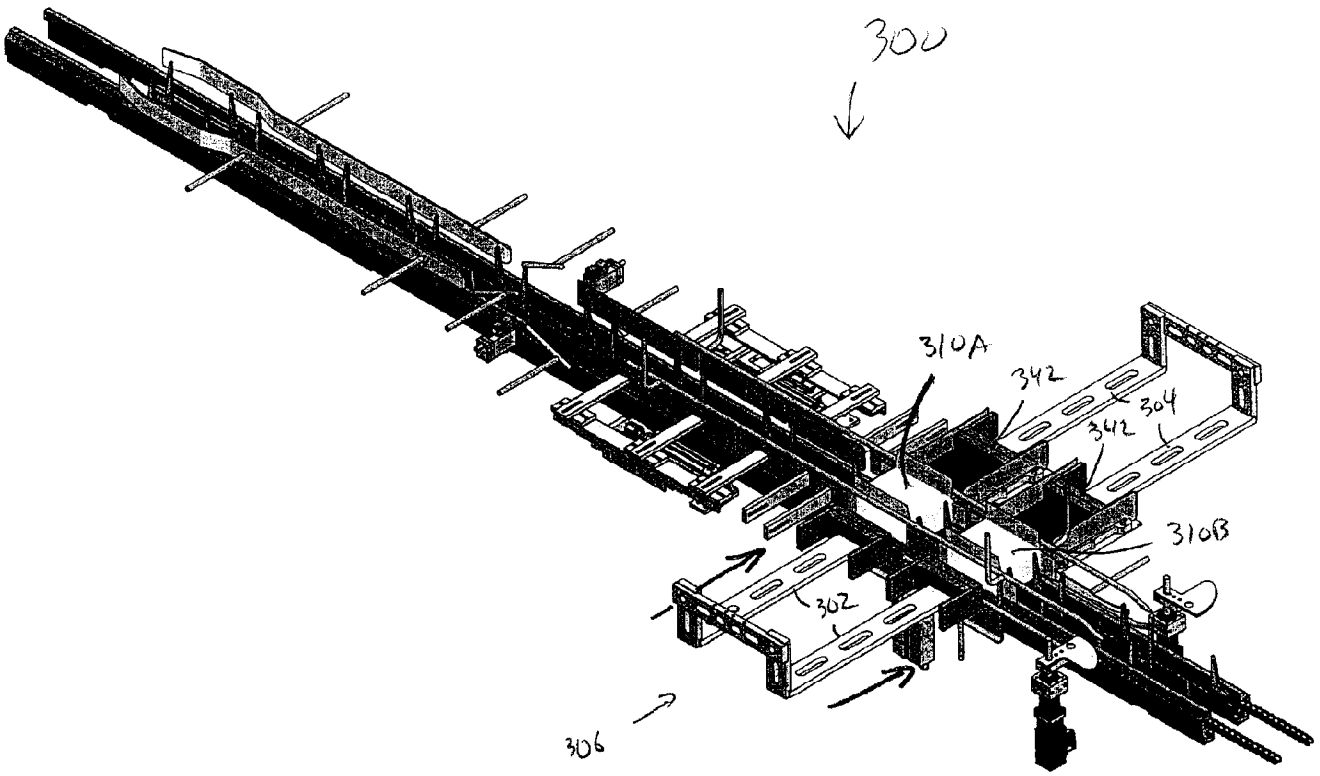
Figure 81:
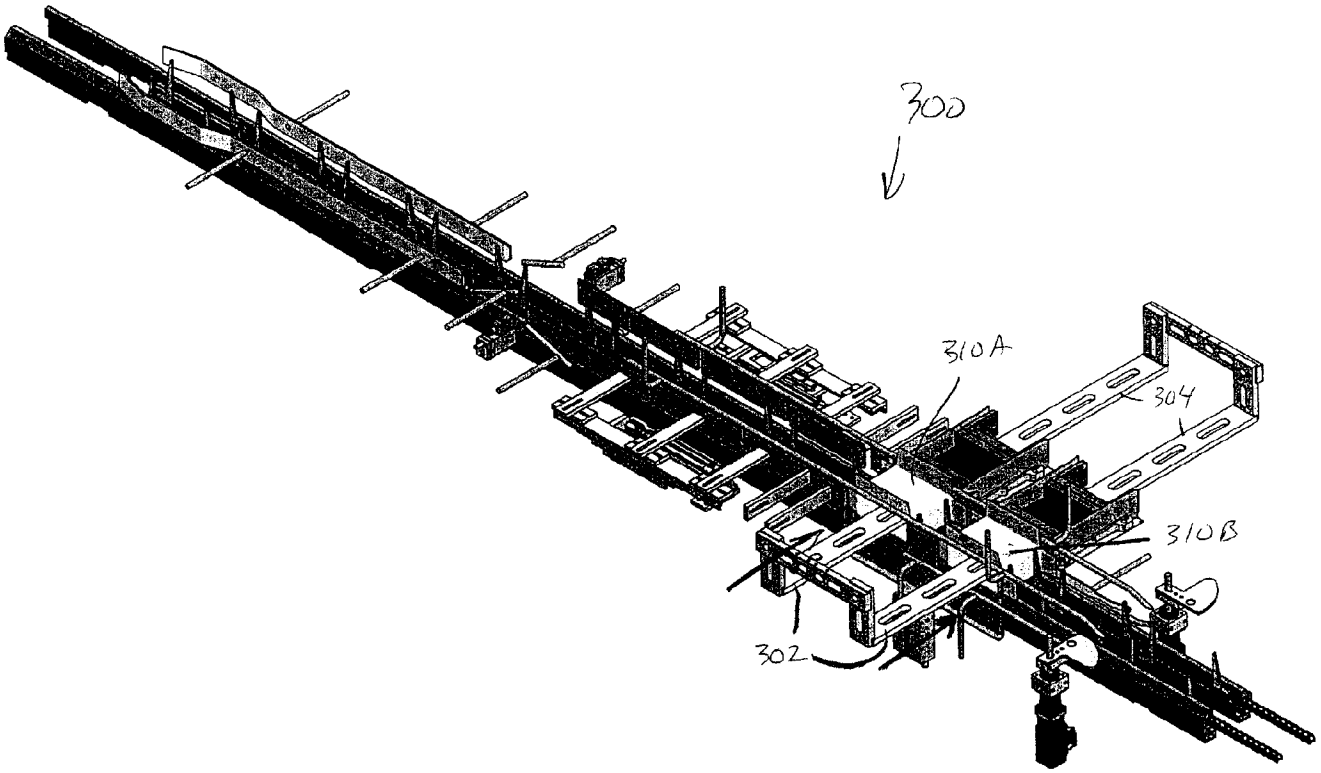
Figure 82:
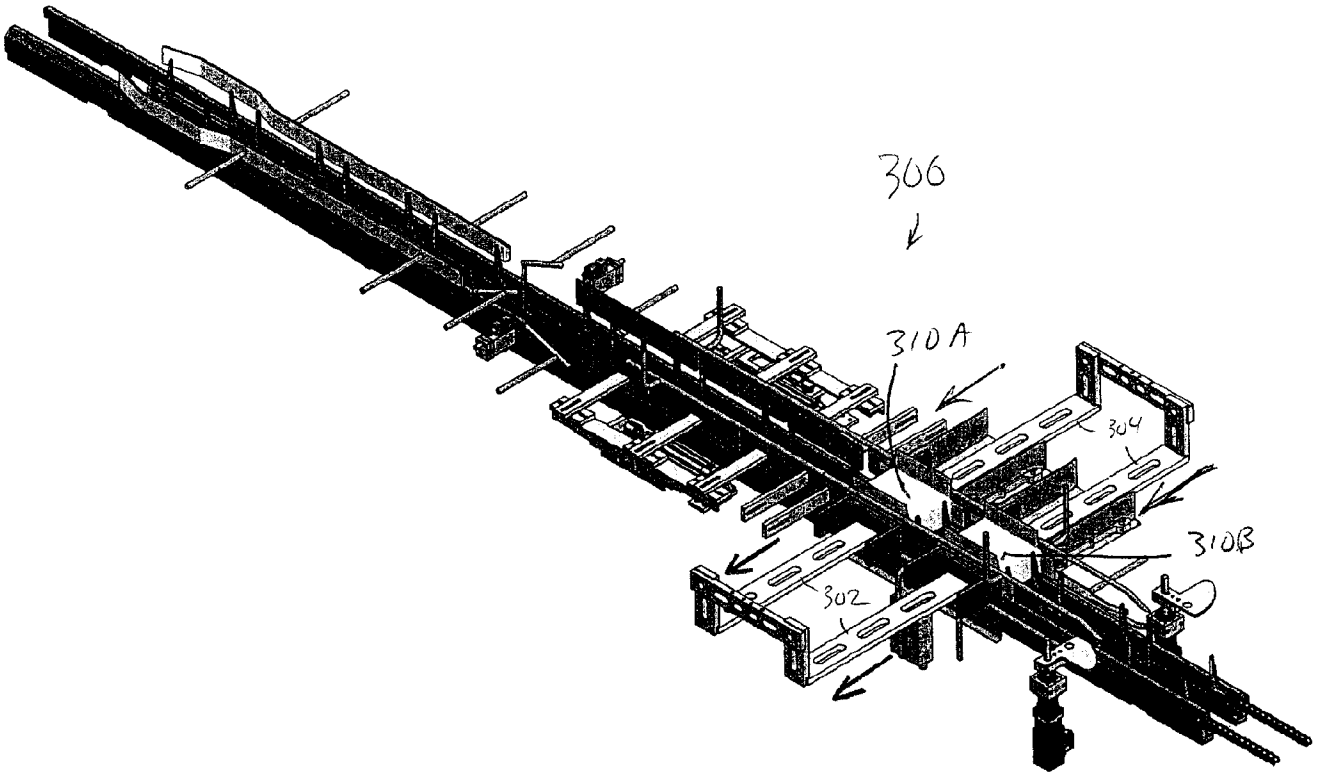
Figure 83:
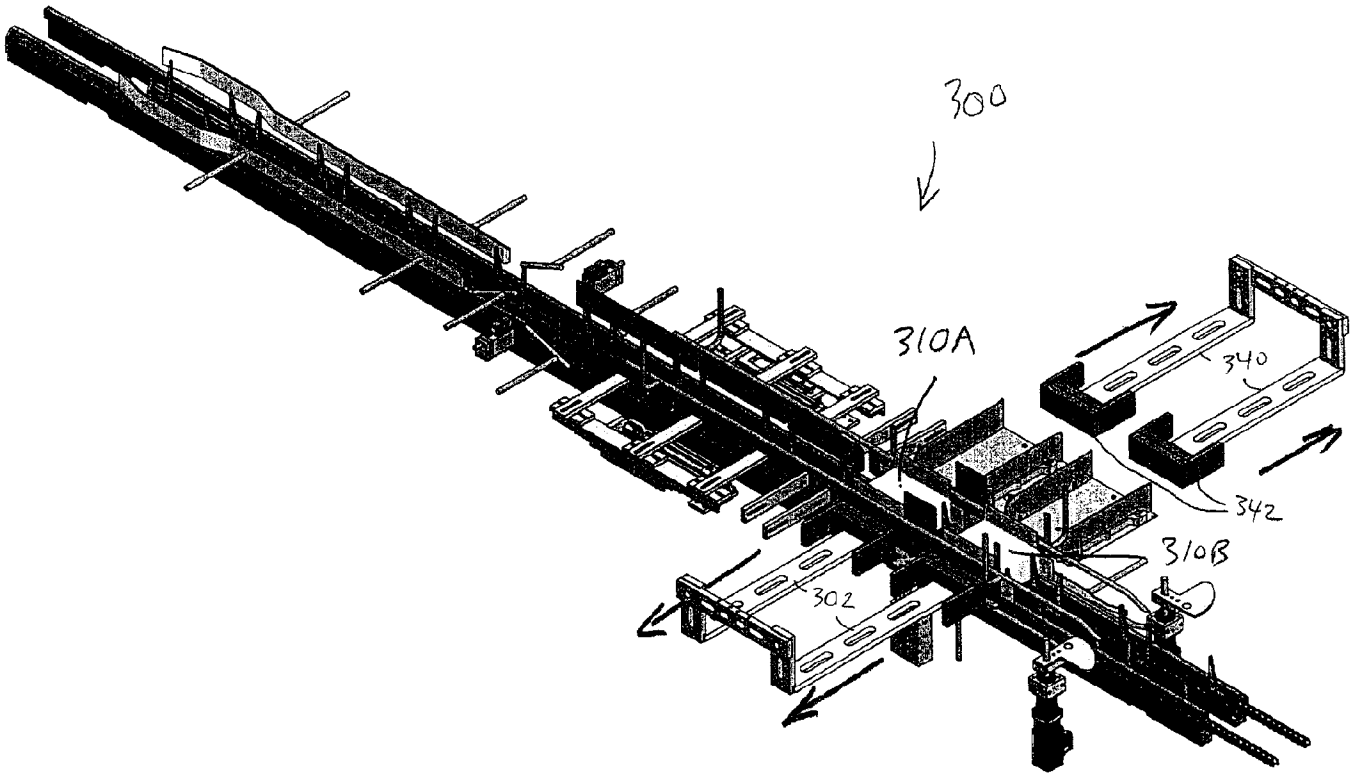

Thirdly, the apparatus 300 has another reciprocating gate 351, analogous to reciprocating gate 350, on the non-loading side of the carton conveyor 314, opposite reciprocating gate 350. The second gate 351 may operate substantially in synchronicity with the reciprocating gate 350, whose operation is analogous to the operation of reciprocating gate 150, described above. A reciprocating gate 351 is used on the non-loading side in this embodiment in order to hold the minor flaps on the non-loading side open during loading (to allow the reverse reciprocating arms 302 to "reach through" the cartons 310 unimpeded) and to keep the flaps open upon conveying of the carton, with opened minor flaps, into and out of the product loading station. The lowering and raising of the reciprocating gate 351 is shown in FIGS. 80 and 83, respectively.

Fourthly, the apparatus 300 has a second minor flap closing device 389 on the non-loading side of the conveyor 314 that is essentially a mirror image of the minor flap closing device 359 on the loading side of the conveyor 314. The device 389 comprises a longitudinal rail 390, with similar fixed and reciprocating sections 392 and 394 respectively as longitudinal rail 360. The second minor flap closing device 389 is used to close the leading and trailing minor flaps on the non-loading ends of the cartons 310A and 310B during the same dwell period in which the leading and trailing minor flaps of the same cartons are closed on the loading ends of the cartons.

Select aspects of the operation of box closing apparatus 300 that is further shown in FIGS. 84-95 will now be described.

Figure 84:
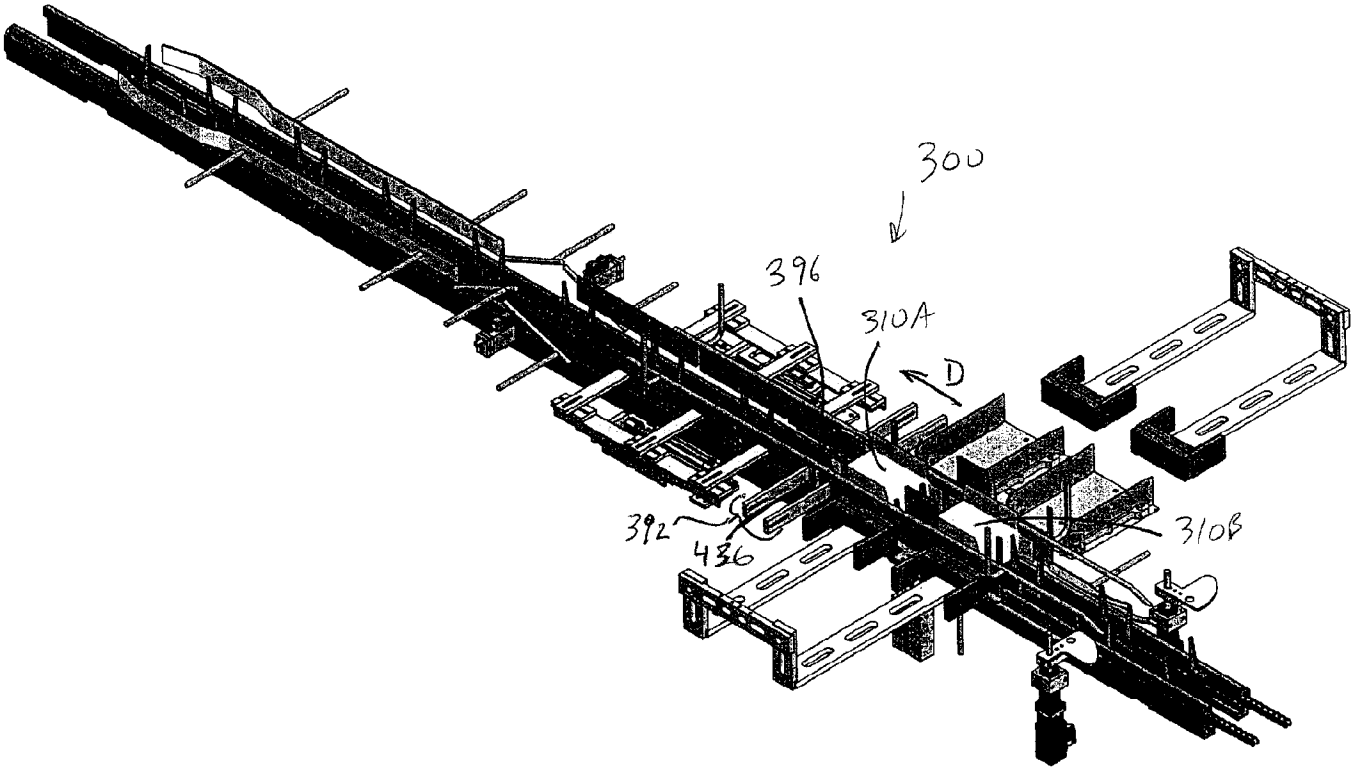
Figure 85:
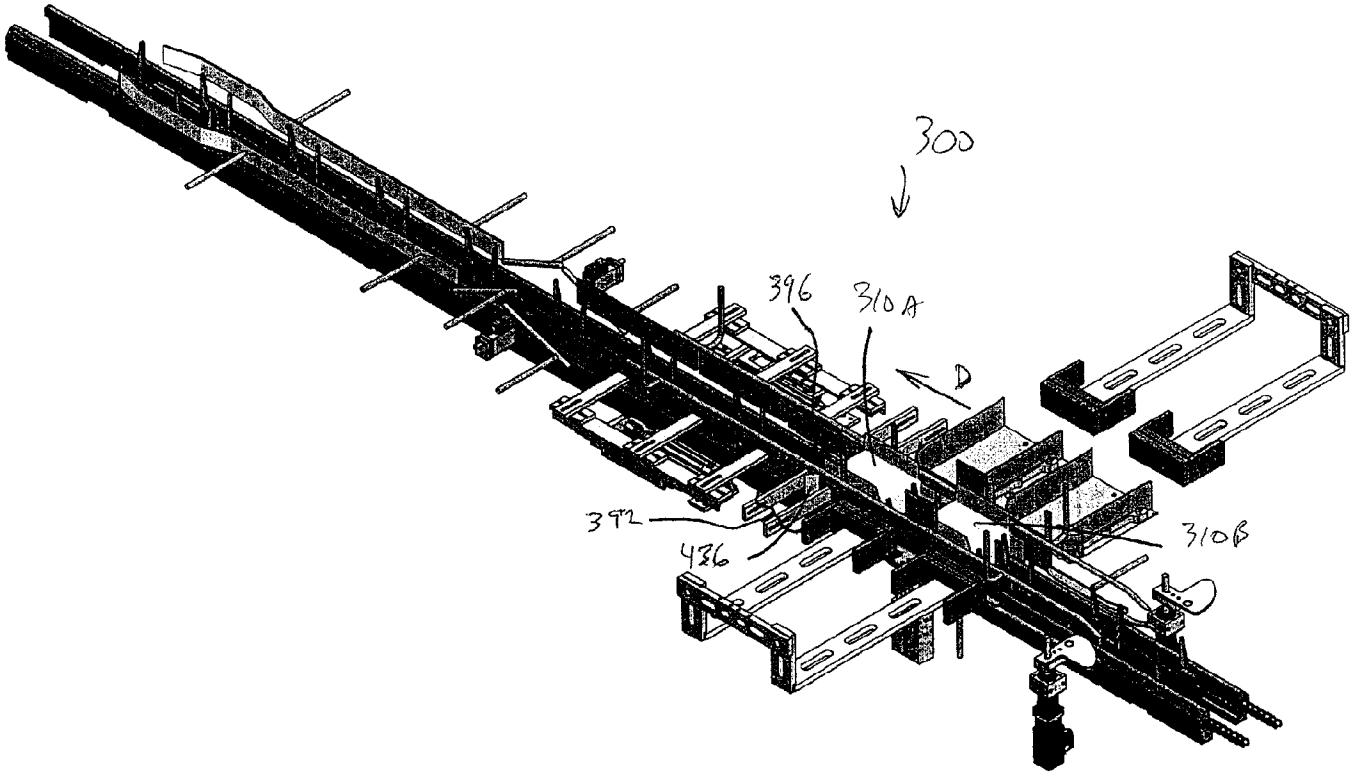

In FIGS. 84 and 85, closure of a leading minor flap 436 by the minor flap closing device 389 on the non-loading side of the carton 310A is shown. As the carton 310A is conveyed past slot 396 in fixed rail section 392, the leading minor flap 436 is closed by the slot 396, in the same manner (except in mirror image) as leading minor flap 226 was closed by slot 166 in fixed rail section 162 of the above-described embodiment. The closing of the leading minor flap 436 on the non-loading end may be done simultaneously with the closing of the leading minor flap of the carton 310A on the opposite, loading end of the carton by the minor flap closing device 360 (not expressly shown).

Figure 86:
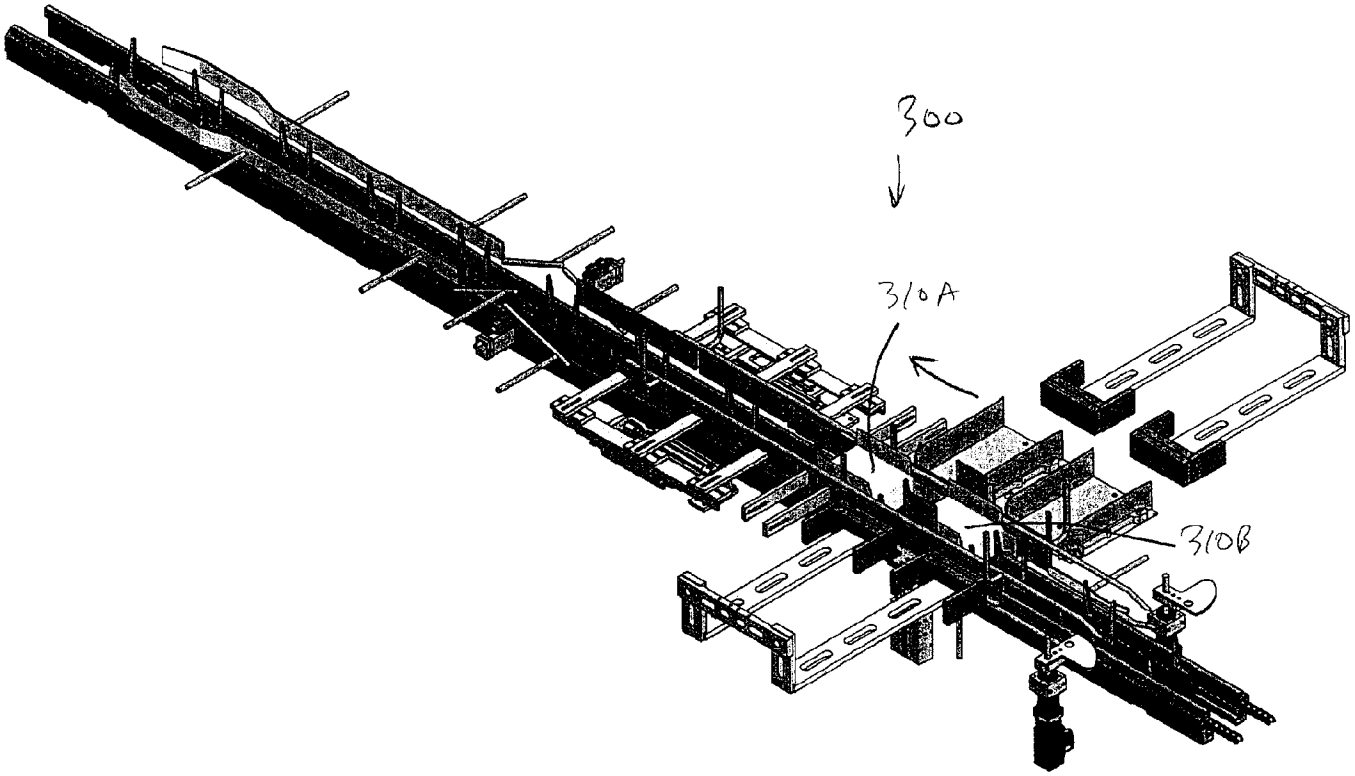
Figure 87:
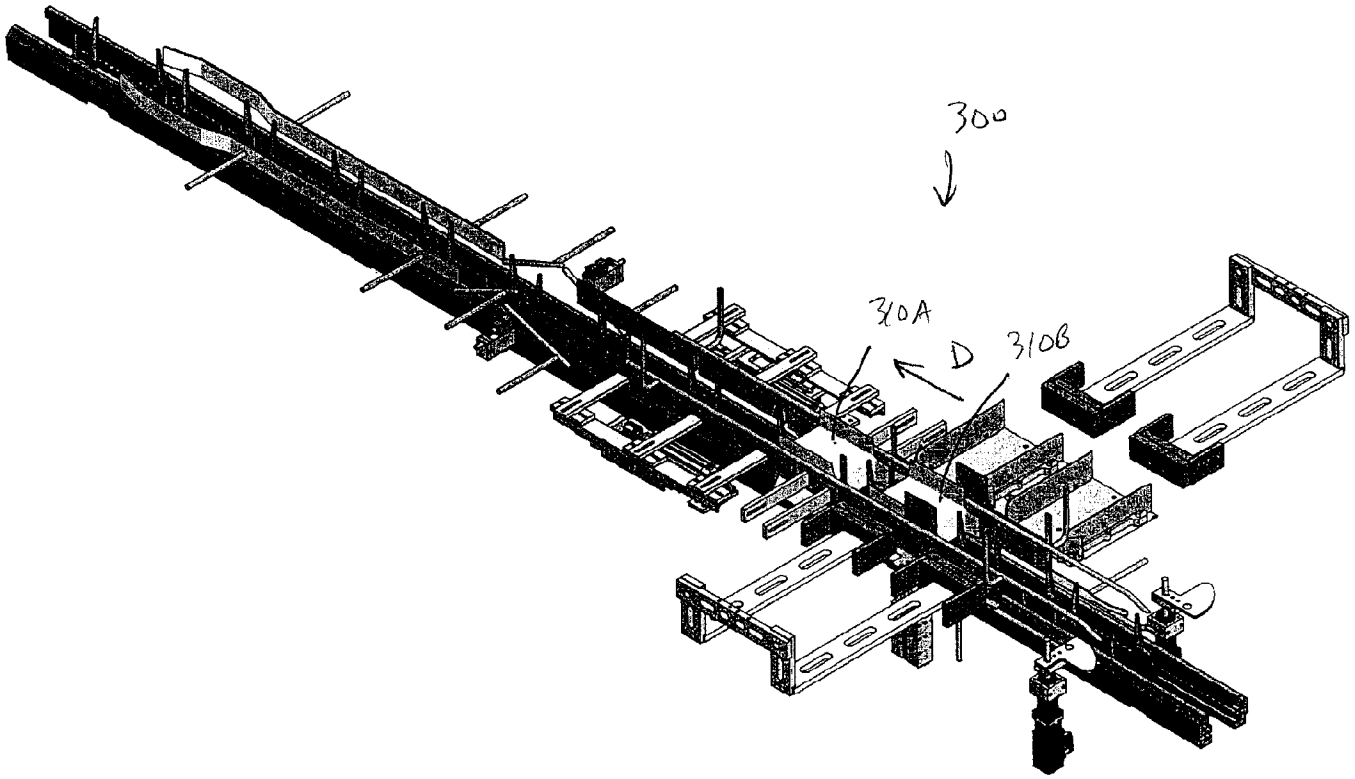

In FIGS. 86 and 87, the downstream carton 310A is conveyed further downstream towards the reciprocating rail portions 364 and 394 of the minor flap closing devices 359 and 389 respectively.

Figure 88:
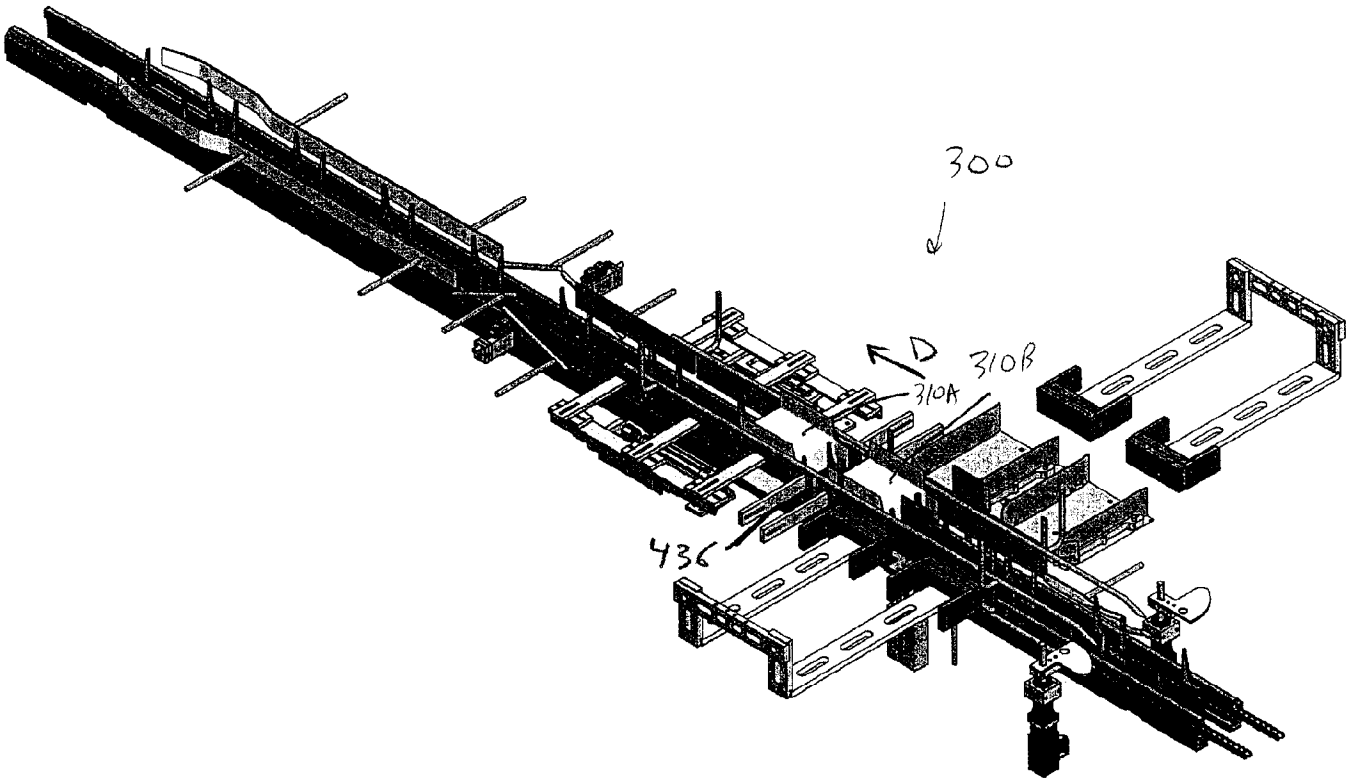
Figure 89:
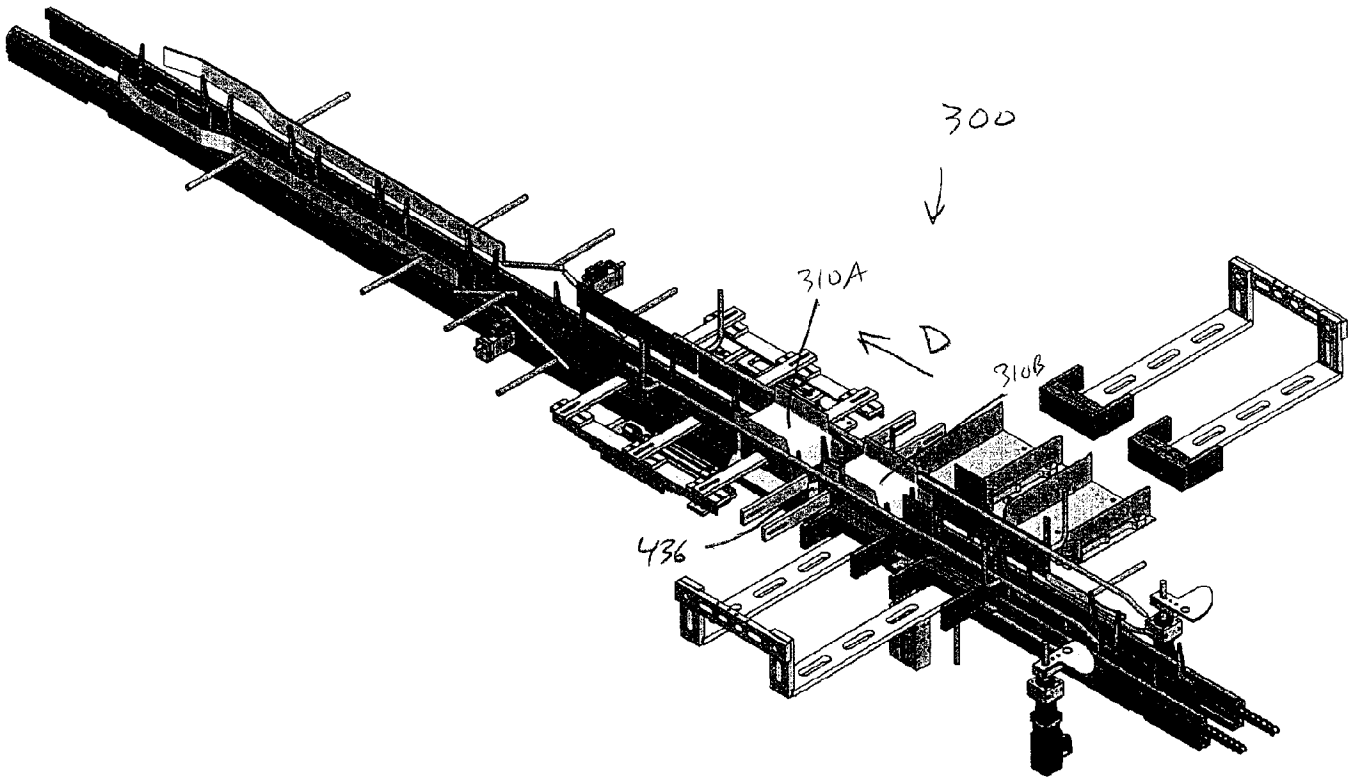
Figure 9D:
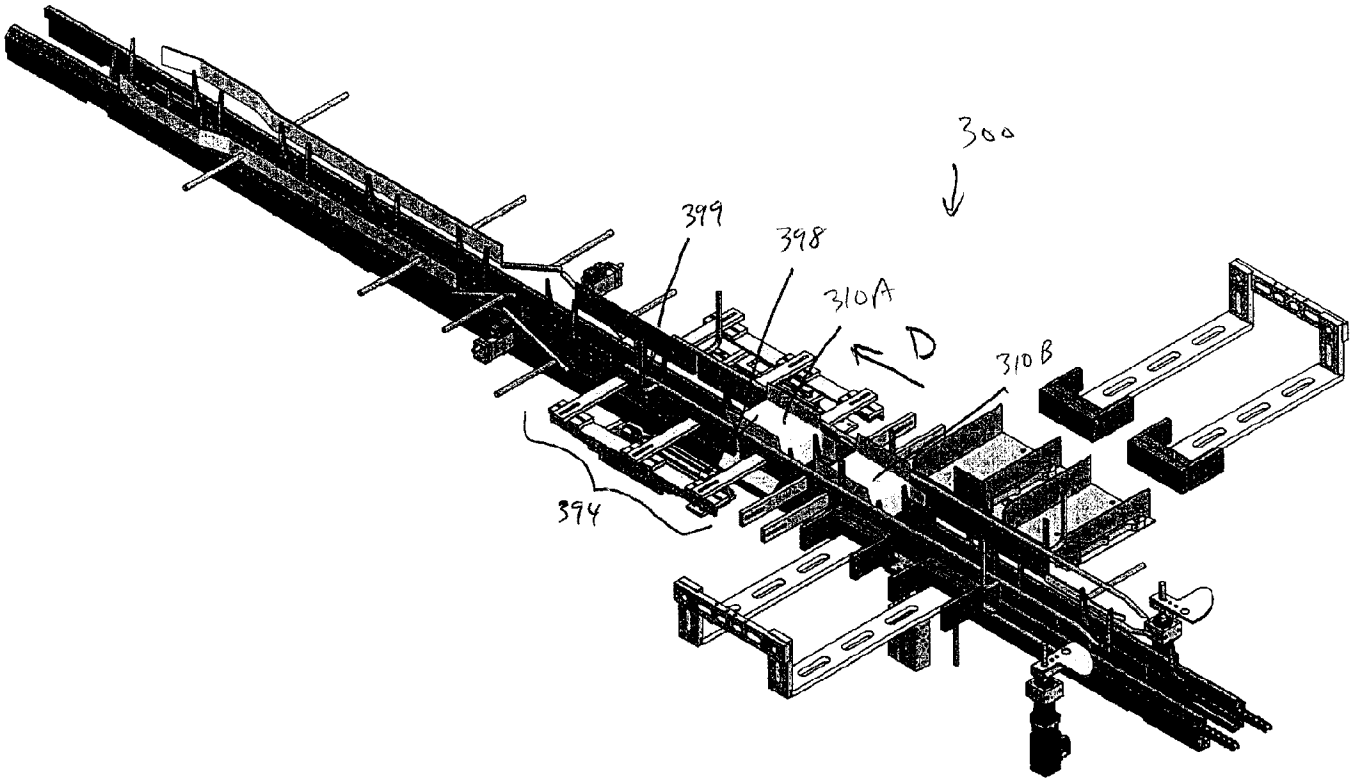

In FIGS. 88 and 89, closure of a leading minor flap 436 on the non-loading side of the other carton 310B is shown. The flap 436 on carton 310B is closed in the same manner as the leading minor flap 436 of carton 310A was closed.

Figure 91:
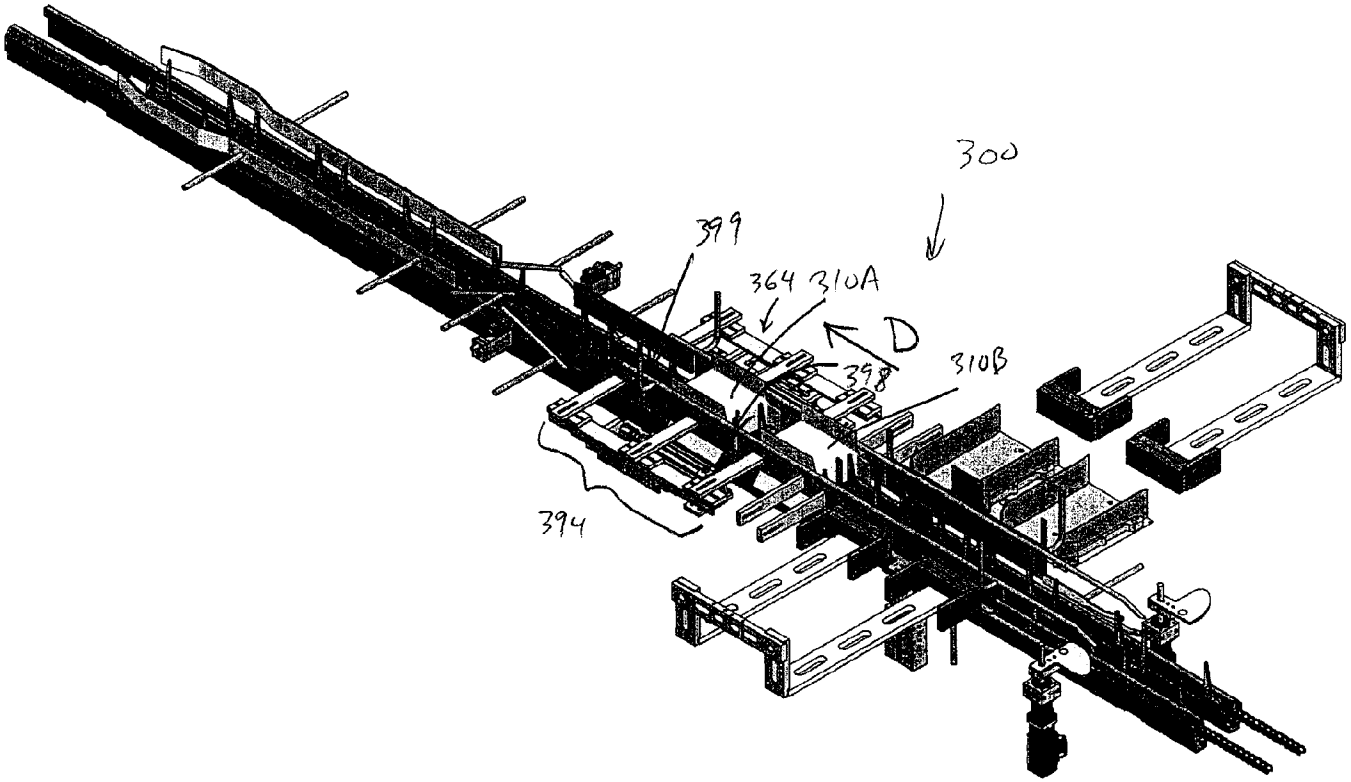
Figure 92:
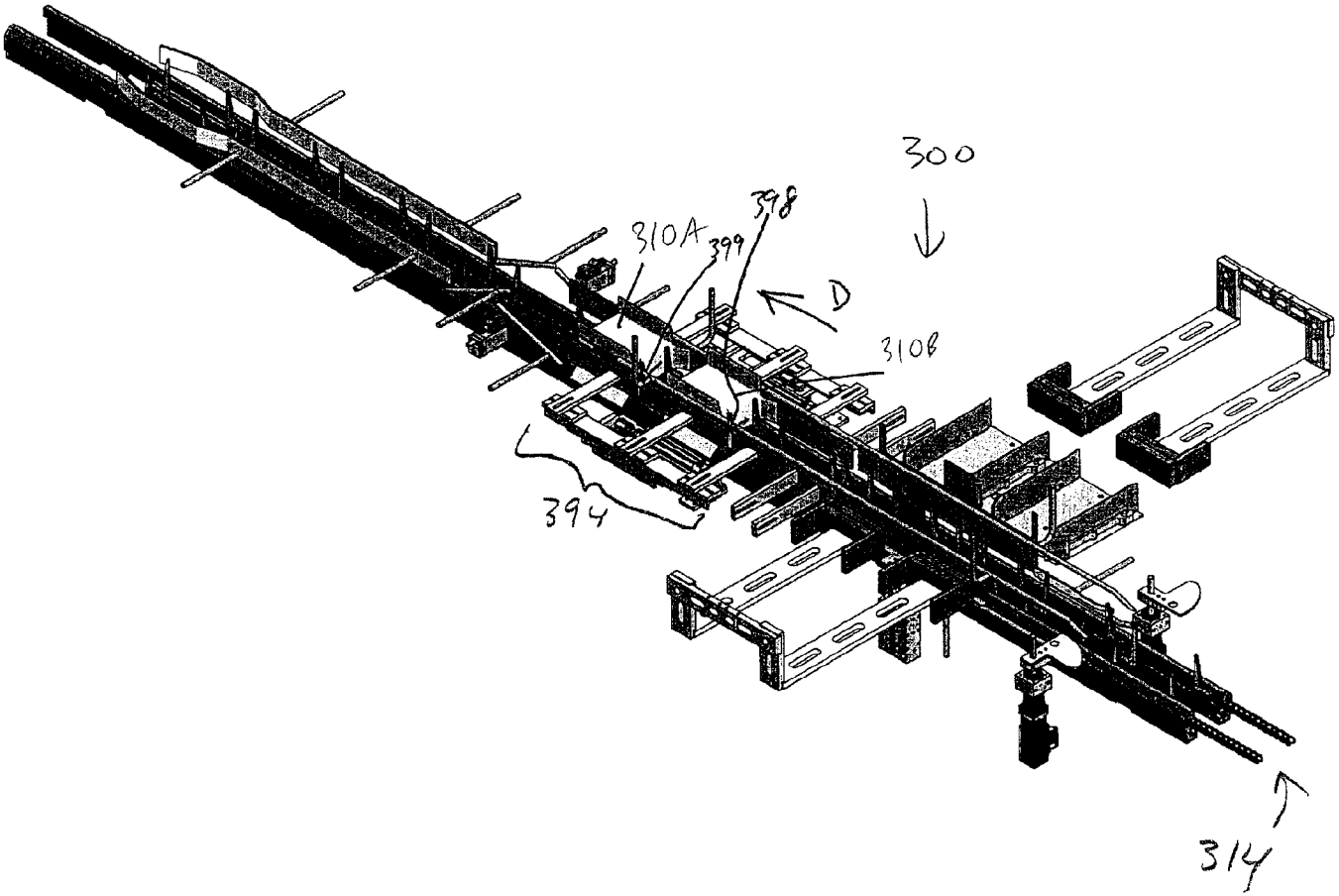

In FIGS. 90-92, the pair of cartons 310A and 310B is conveyed until their trailing minor flaps 438 are just downstream of slots 399 and 398, respectively, in the reciprocating rail 394, at which time the conveyor 314 enters a dwell period and indexing of the cartons 310A and 310B ceases.

Figure 93:
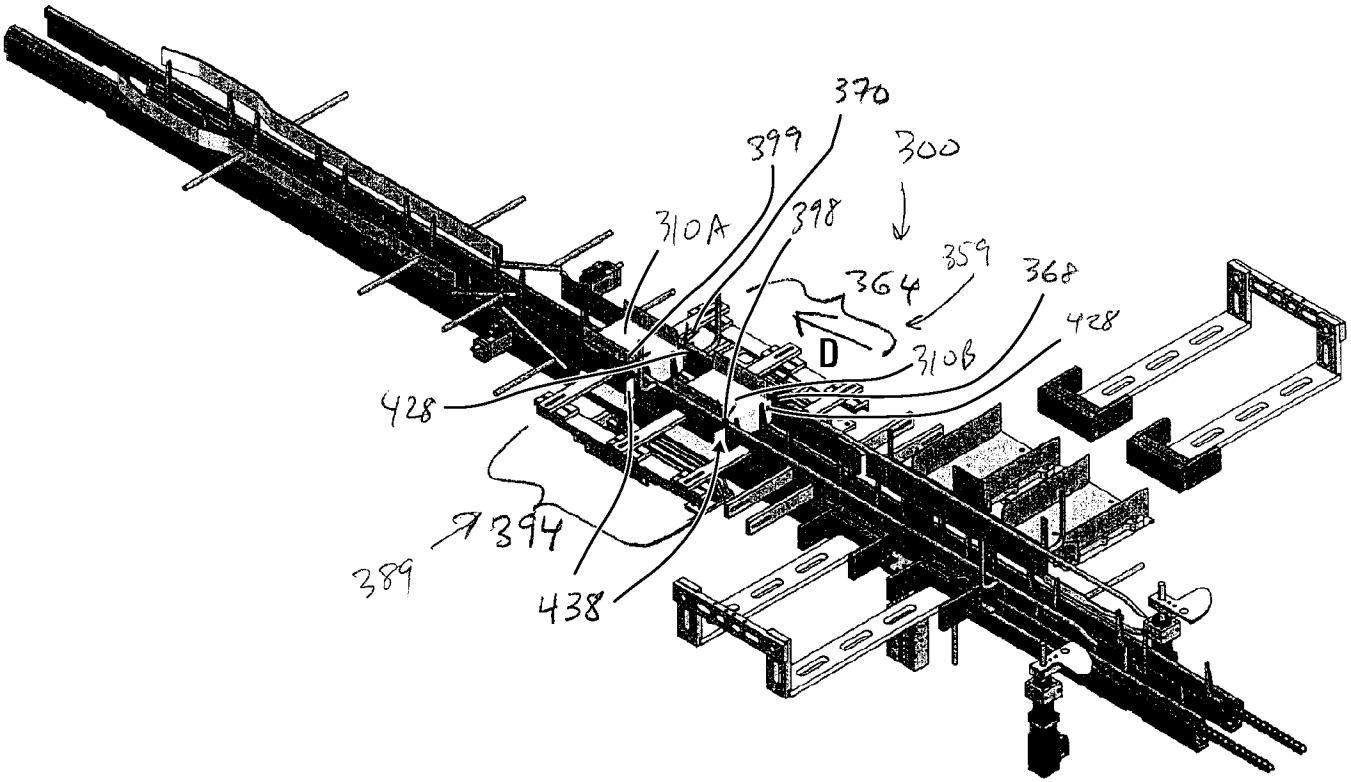
Figure 94:
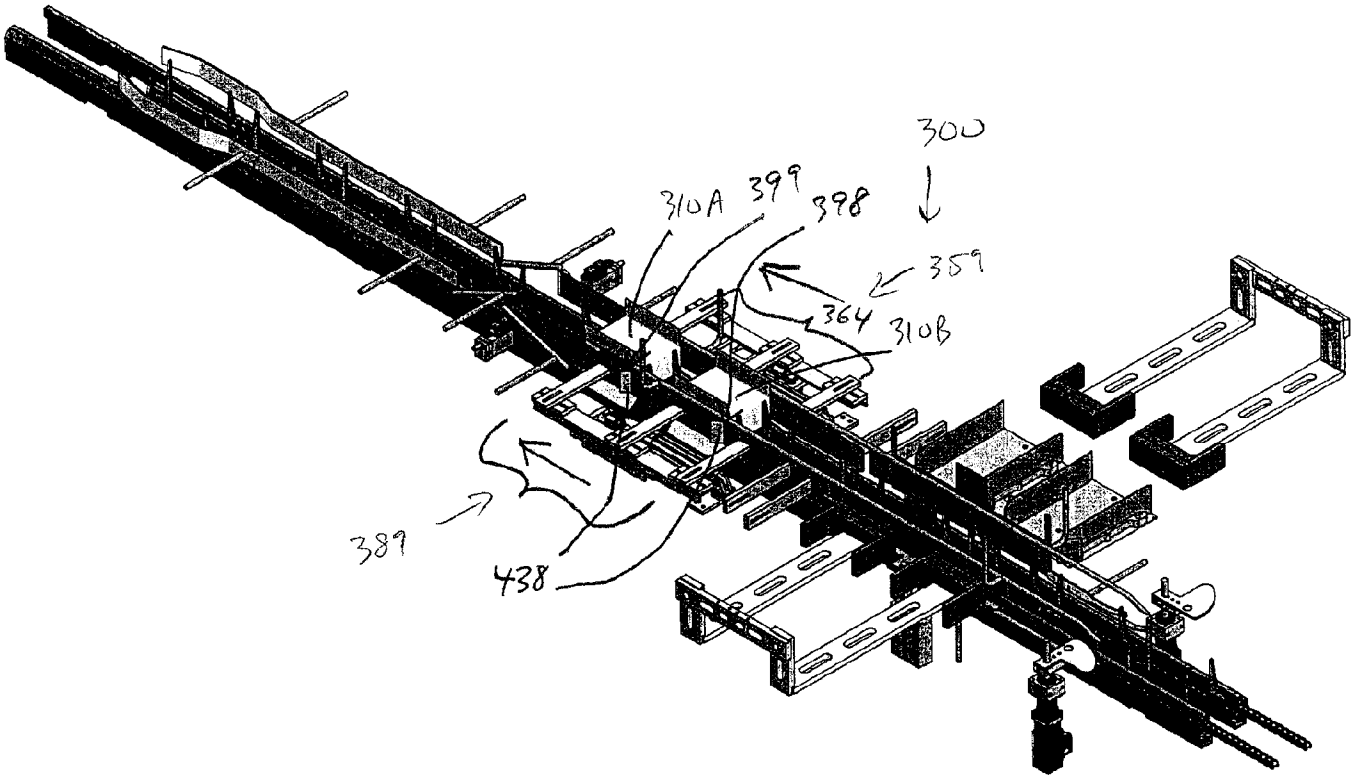
Figure 95:
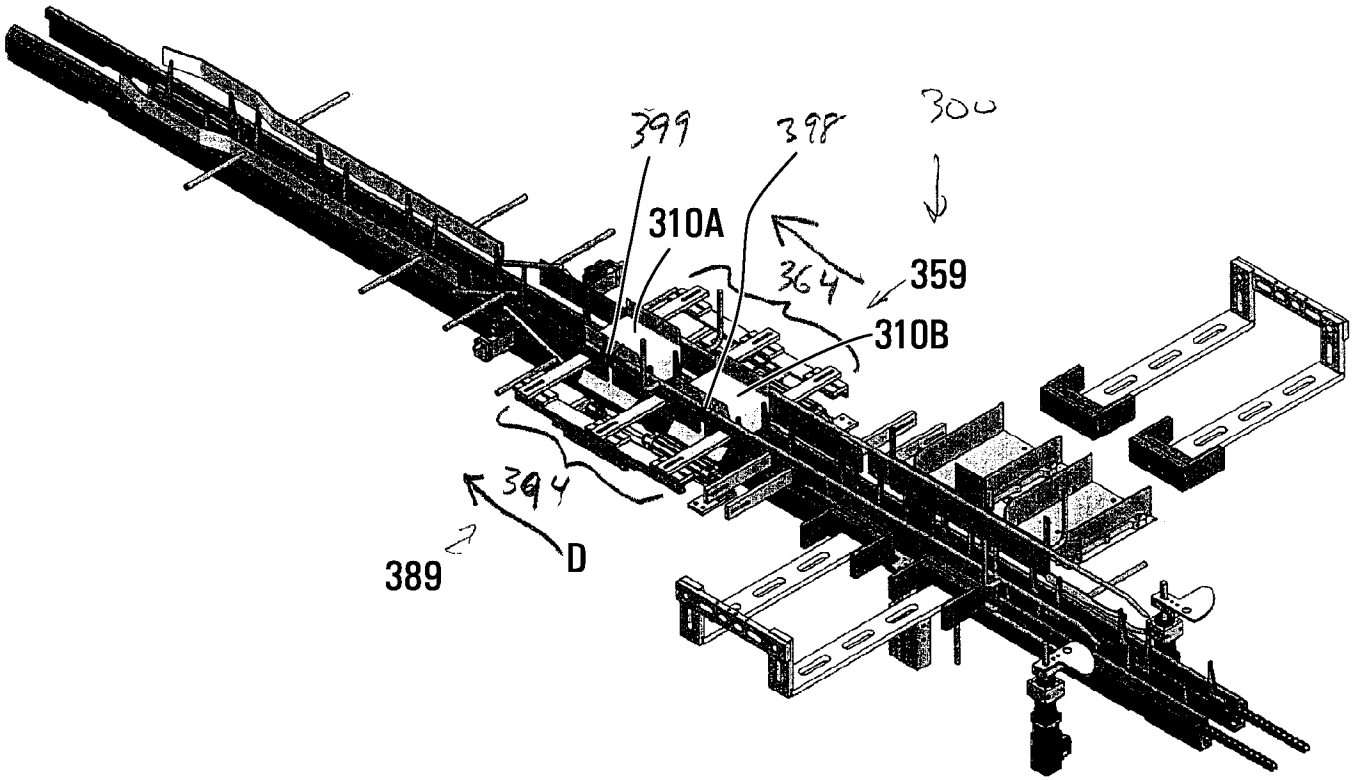

In FIGS. 93-95, the trailing minor flaps 438 of cartons 310A and 310B are closed by slots 399 and 398, respectively, in the reciprocating rail section 394 of the minor flap closing device 389, as the rail 394 is moved longitudinally downstream past the flaps 438. This is done much in the same way (except in mirror image) to the closing of the trailing minor flaps 228 of cartons 110A and 110B by the reciprocating rail 164, described above. The trailing minor flaps on the non-loading end of the cartons 310A and 310B may be done simultaneously with the closing of the trailing minor flaps 428 of cartons 310A and 310B on the loading end of the cartons by slots 370 and 368, respectively, of the opposing reciprocating rail 364 of minor flap closing device 359.

Figure 96:
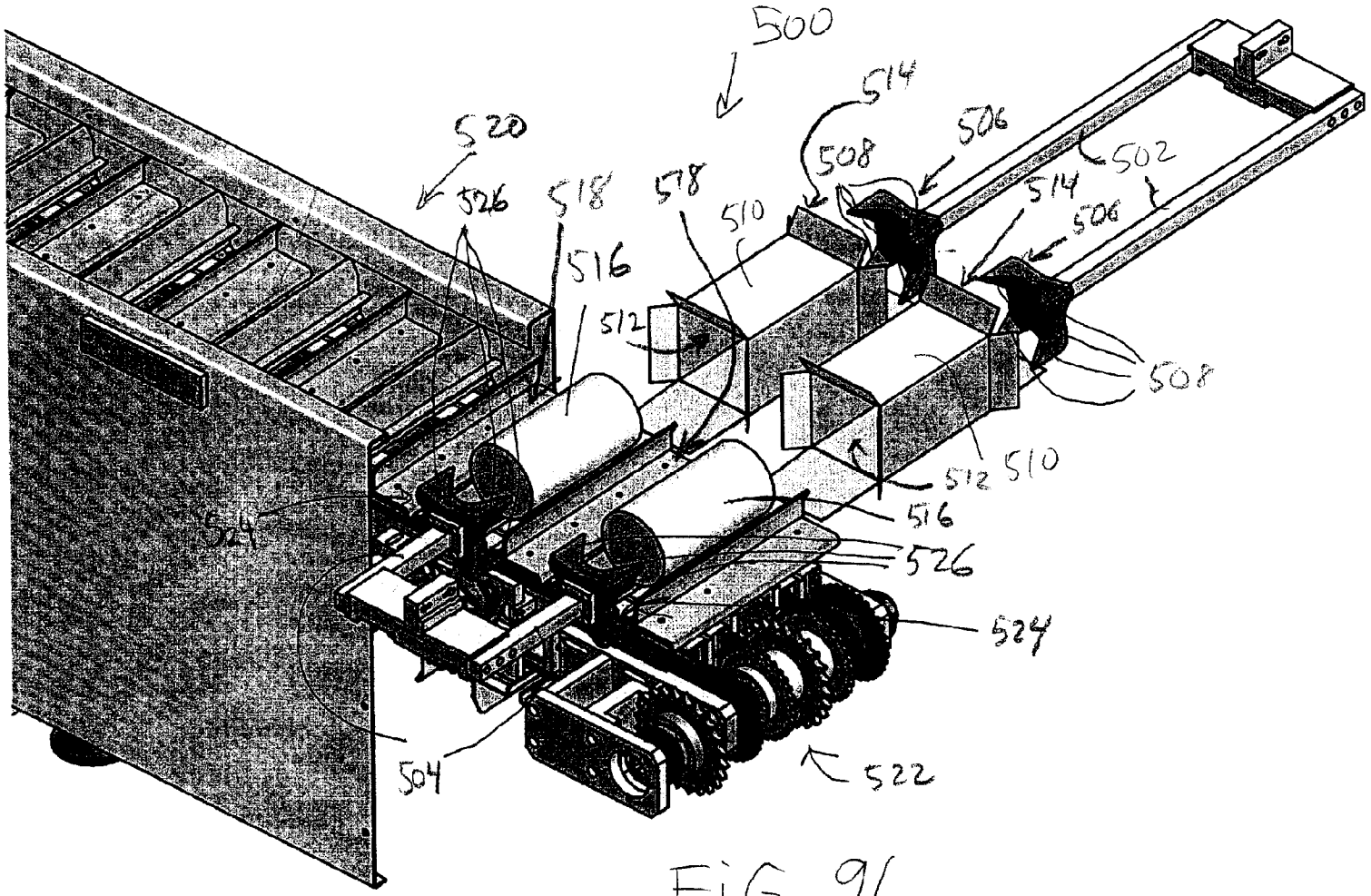
FIG. 96 is a perspective view of an alternative form of product loading arm and reverse product loading arm that may be used in some embodiments.

FIG. 96 is a perspective view of an alternative form of reverse reciprocating arms 502 and reciprocating arms 504 that may be used in some box closing apparatus embodiments. A pair of interconnected reverse reciprocating arms 502 each has a clawed end 506. In the present embodiment, each end 506 has four tapered claws 508 equally spaced about a periphery of the end 506. The number of claws can vary in other embodiments but will typically be at least two. The profile of each end is substantially square and slightly smaller than a transverse square interior profile of each a pair of cartons 510 with which the arms 502 are aligned. The cartons are opened on their loading ends 512 and non-loading ends 514, to accommodate extension of the reverse reciprocating arms 502 through the cartons 510 in the manner described above with respect to FIGS. 80-83. A pair of cylindrical rolled products 516, each of which may be a roll of plastic bags for example, is positioned for loading into respective cartons 510 within respective buckets 518 of a product conveyor 520, which may be driven using gearing 522. The reciprocating arms 504 have respective clawed pusher ends 524. In the present embodiment, each end 524 has four tapered claws 526, similar to claws 508, equally spaced about a periphery of the end 524. The number of claws can vary in other embodiments but will typically be at least two. The profile of each end 524 is similar to that of end 508 and may permit the end 524 to be partially inserted into the carton 510 during product loading.

Loading of the product 516 may be done using a similar cradling approach to what is described above with respect to FIGS. 80-83. When opposing clawed ends 506 and 524 cooperate to cradle the product 516, the ends of cylindrical products 516 tend to be pinched or squeezed inwardly (i.e. some pressure is applied from the circumferential exterior of the roll ends towards the axial center of the rolled products 516) by the tapered claws 508 and 526. This may advantageously discourage unrolling of the products 516 during product loading, as might otherwise occur due to friction of the exterior surface of the rolled products against the interior walls of the cartons 510 or possibly even due to the effects of inertia for example.

Of course, the above described embodiments are intended to be illustrative only and in no way limiting. The described embodiments of carrying out the invention are susceptible to many modifications of form, arrangement of parts, details and order of operation. The invention, rather, is intended to encompass all such modification within its scope, as defined by the claims.

When introducing elements of the present invention or the embodiments thereof, the articles "a," "an," "the," and "said" are intended to mean that there are one or more of the elements. The terms "comprising," "including," and "having" are intended to be inclusive and mean that there may be additional elements other than the listed elements.

The invention claimed is:

1. An apparatus for closing opposing first and second vertically and longitudinally oriented flaps on an open end of a box, the apparatus comprising:

(a) a vertically and longitudinally oriented rail having a generally vertically and longitudinally oriented planar surface, and with a first vertically oriented slot and a second vertically oriented slot provided through said planar surface of said rail; and (b) a mechanism operable to provide a first longitudinal relative motion between the first slot and the first flap of the box, the mechanism also operable to provide a second longitudinal relative motion, opposite to the first relative motion, between the second slot and the second flap of the box, the first relative motion operable to cause the first slot to receive and close first flap and the second relative motion operable to cause the second slot to receive and close the second flap.

2. The apparatus of claim 1 wherein said first and second flaps are resilient and are operable to push against an interior surface of said rail, and thereby to assist in being received through said first and second slots respectively.

3. The apparatus of claim 1 said apparatus being operable such that an external force can be exerted against a surface of at least one flap of said first and second flaps such that said at least one flap pushes against the interior surface of the rail.

4. The apparatus of claim 1 wherein during said first relative motion between the first slot and the first flap of the box, said first flap will be received into said first slot and pivot about a first fold line of said first flap to close the first flap, and wherein during said second relative motion between the second slot and the second flap of the box, the second flap will be received into the second slot and pivot about a second fold line of said second flap to close the second flap.

5. The apparatus of claim 1 wherein the first flap comprises a leading minor flap and the second flap comprises a trailing minor flap.

6. The apparatus of claim 5 wherein the rail is dimensioned to substantially cover or block the open end of the box so as to inhibit egress of any contents of the box during the closing of the leading minor flap and the closing of the trailing minor flap.

7. The apparatus of claim 1 wherein the rail comprises a fixed rail section comprising the first slot and a movable rail section comprising the second slot.

8. The apparatus of claim 1, wherein the mechanism for providing first relative motion comprises a conveyor operable to convey the box downstream past the first slot of the fixed rail section.

9. The apparatus of claim 8 wherein the conveyor is further operable to convey the box downstream past the second slot.

10. The apparatus of claim 8 wherein the mechanism for providing second relative motion comprises an actuator operable to move the second slot of the movable rail section downstream past the second flap of the box.

11. The apparatus as claimed in claim 8 further comprising a controller for controlling the operation of said conveyor and said actuator.

12. The apparatus of claim 1 wherein the first slot is oriented to face at least partially upstream in order to facilitate the receiving of the leading minor flap within the first slot.

13. The apparatus of claim 1 wherein the rail comprises an upstream planar rail portion and a downstream planar rail portion, and wherein the downstream planar rail portion is offset transversely, relative to the upstream planar rail portion, and wherein the first slot is between the upstream and downstream planar rail portions.

14. The apparatus of claim 13 wherein the downstream planar rail portion is non-coplanar with the upstream planar rail portion.

15. The apparatus of claim 13 wherein the second slot is oriented to face at least partially downstream in order to facilitate the receiving of the trailing minor flap in the second slot.

16. The apparatus of claim 1, wherein said rail is a longitudinally extending guide rail, said first and second slots being generally oriented in said first direction;

said first relative motion is in a second longitudinal direction that is generally perpendicular to said first direction; and said second relative motion is in a third longitudinal direction that is generally perpendicular to said first direction, and generally parallel but opposite to the second direction.

17. The apparatus of claim 1, wherein said box comprises opposing third and fourth flaps on a second end of said box opposite to said first end, the apparatus further comprising:

a second rail disposed on an opposite side of said box to said first rail, said second rail having a third slot and a fourth slot defined therein; and a second closing mechanism operable to provide a third relative motion between the third slot and the third flap of the box, the third relative motion for causing the third slot to receive and close the third flap, the mechanism also operable to provide a fourth relative motion, opposite to the first relative motion, between the fourth slot and the fourth flap of the box, the fourth relative motion for causing the fourth slot to receive and close the fourth flap.

18. The apparatus of claim 17, said apparatus operable such that during said third relative motion between the third slot and the third flap of the box, said third flap will be received into said third slot and pivot about a fold line of said third flap to close the first flap, and wherein during said fourth relative motion between the fourth slot and the fourth flap of the box, the fourth flap will be received into the fourth slot and pivot about a fold line of said fourth flap to close the fourth flap.

19. The apparatus of claim 18 further comprising a product pushing device operable to push the product into an open first end of said box and an opposed product containment device operable to co-operate with said pushing device to contain a product between the pushing device and the containment device during loading of the product through the open first end of the said box.

20. The apparatus of claim 1 wherein the rail and each of the first and second slots are stationary and each of the first and second flaps moves relative to the rail and a corresponding one of the first and second slots during a corresponding one of said first and second relative motions.

21. The apparatus of claim 1 wherein the rail and each of the first and second slots move during a corresponding one of said first and second relative motions.

22. An apparatus for closing a carton, the apparatus comprising:

(a) a carton conveyor operable for conveying a carton longitudinally with an open end of the carton facing transversely, the open end of the conveyed carton having a vertically and longitudinally oriented leading minor flap and a vertically and longitudinally oriented trailing minor flap; and (b) a minor flap closing device comprising:

(i) a first vertically and longitudinally oriented rail section comprising a generally vertically and longitudinally oriented planar surface having a first generally vertically oriented slot provided through said planar surface of said first rail section for receiving and closing the leading minor flap of the carton; and (ii) a second vertically and longitudinally oriented rail section comprising a generally vertically oriented planar surface having a generally vertically oriented second slot provided through said planar surface of said second rail section for receiving and closing the trailing minor flap of the carton.

23. The apparatus of claim 22 wherein said leading and trailing minor flaps are resilient and are operable to push against an interior surface of one or both of said first and second rail sections, and thereby to assist in being received through said first and second slots respectively.

24. The apparatus of claim 22 wherein said apparatus is operable such that an external force can be exerted against a surface of at least one flap of said first and second flaps such that said at least one flap pushes against the interior surface of the guide rail.

25. The apparatus of claim 22, said apparatus being operable such that when said leading minor flap is received into said first slot it will pivot about a first fold line of said leading minor flap to close the leading minor flap, and such that when the trailing minor flap is received into the second slot it will pivot about a second fold line of said trailing minor flap to close the trailing minor flap.

26. The apparatus of claim 22 wherein the first rail section is fixed and wherein the second rail section is operable to be moved longitudinally.

27. The apparatus of claim 26 wherein the first rail section is located upstream of the second rail section.

28. The apparatus of claim 26 wherein the first and second rail sections are dimensioned to substantially cover or block respective open ends of the carton during the closing of the leading and trailing minor flaps, so as to inhibit egress of carton contents.

29. The apparatus of claim 22 further comprising a product loading station upstream of the minor flap closing device, the product loading station for side-loading a product into the carton prior to the closing of the leading and trailing minor flaps.

30. The apparatus of 29, wherein said loading station is for side-loading one or more products into each of a plurality of boxes; and wherein said second rail section comprises a plurality of slots, each slot of the plurality of slots for receiving and closing a trailing minor flap of a respective one of the plurality of loaded boxes.

31. The apparatus of claim 22 wherein the first slot is oriented to face at least partially upstream in order to facilitate the receiving of the leading minor flap within the first slot.

32. The apparatus of claim 22 wherein the first rail section comprises an upstream planar rail portion and a downstream planar rail portion that is offset transversely, towards the carton conveyor, relative to the upstream planar rail portion, wherein the first slot is between the upstream and downstream planar rail portions.

33. The apparatus of claim 32 wherein the downstream planar rail portion is non-coplanar with the upstream planar rail portion.

34. The apparatus of claim 22 wherein the second slot is oriented to face at least partially downstream in order to facilitate the receiving of the trailing minor flap in the second slot.

35. The apparatus claim 22 wherein the second rail section comprises a downstream planar rail portion and an upstream planar rail portion that is offset transversely, towards the carton conveyor, relative to the downstream planar rail portion, wherein the second slot is between the upstream and downstream planar rail portions.

36. The apparatus of claim 35 wherein the downstream planar rail portion is non-coplanar with the upstream planar rail portion.

* * * * *